US009022011B2

(12) United States Patent
Andersson et al.

(10) Patent No.: US 9,022,011 B2
(45) Date of Patent: May 5, 2015

(54) ENGINE FUEL DELIVERY SYSTEMS, APPARATUS AND METHODS

(75) Inventors: Martin N. Andersson, Caro, MI (US); Andrew E. Bejcek, Mebane, NC (US); Massimo Casoni, Castelfranco Emilia (IT); William E. Galka, Caro, MI (US); Cyrus M. Healy, Ubly, MI (US); Alessandro Pascoli, Centro (IT); Ronald H. Roche, Cass City, MI (US); Mark S. Swanson, Cass City, MI (US); James E. Van Allen, Clifford, MI (US); John C. Woody, Caro, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 1410 days.

(21) Appl. No.: 12/739,787

(22) PCT Filed: Oct. 27, 2008

(86) PCT No.: PCT/US2008/081360
§ 371 (c)(1),
(2), (4) Date: Apr. 26, 2010

(87) PCT Pub. No.: WO2009/055809
PCT Pub. Date: Apr. 30, 2009

(65) Prior Publication Data

US 2010/0258099 A1 Oct. 14, 2010

Related U.S. Application Data

(60) Provisional application No. 61/094,973, filed on Sep. 7, 2008, provisional application No. 61/000,451, filed on Oct. 27, 2007.

(51) Int. Cl.
*F02D 41/04* (2006.01)
*F02D 41/14* (2006.01)

(Continued)

(52) U.S. Cl.
CPC ..... *F02D 41/1446* (2013.01); *F02D 31/006* (2013.01); *F02D 31/009* (2013.01); *F02D 35/0053* (2013.01); *F02D 2400/06* (2013.01); *F02M 17/04* (2013.01); *F02P 3/0815* (2013.01)

(58) Field of Classification Search
CPC ..... F02D 41/04; Y02T 10/47
USPC ..... 123/676; 701/102, 103
See application file for complete search history.

(56) References Cited

U.S. PATENT DOCUMENTS 3,983,882 A 10/1976 Billings
4,271,093 A 6/1981 Kobayashi (Continued)

OTHER PUBLICATIONS

Written Opinion & International Search Report for PCT/US08/81360, Jun. 8, 2009, 6 pages.

(Continued)

*Primary Examiner* — Mahmoud Gimie
*Assistant Examiner* — David Hamaoui
(74) *Attorney, Agent, or Firm* — Reising Ethington P.C.

(57) ABSTRACT

A method of operating an engine is disclosed, which includes determining a peak power condition for the engine, measuring a temperature associated with the engine at said peak power condition, comparing the temperature measured with a previously determined temperature associated with a known peak power condition of the engine, determining an offset value based on the comparison made in step, controlling at least one of an air-fuel mixture delivered to the engine or ignition spark timing based on said offset value. Various engine fuel delivery systems, carburetors, fuel injection and control systems also are disclosed.

19 Claims, 31 Drawing Sheets

(51) Int. Cl.

| | |
|---|---|
| ***F02D 31/00*** | (2006.01) |
| ***F02D 35/00*** | (2006.01) |
| ***F02M 17/04*** | (2006.01) |
| ***F02P 3/08*** | (2006.01) |

(56) References Cited

U.S. PATENT DOCUMENTS

| | | | | |
|---|---|---|---|---|
| 4,399,774 | A * | 8/1983 | Tsutsumi | 123/41.1 |
| 4,821,216 | A * | 4/1989 | Howell et al. | 701/99 |
| 5,067,460 | A | 11/1991 | Van Duyne | |
| 5,259,357 | A * | 11/1993 | Shimizu et al. | 123/638 |
| 5,270,645 | A | 12/1993 | Wheeler et al. | |
| 6,067,498 | A * | 5/2000 | Akiyama | 701/110 |
| 6,146,309 | A * | 11/2000 | Nishino et al. | 477/98 |
| 6,202,782 | B1 * | 3/2001 | Hatanaka | 180/301 |
| 6,360,726 | B1 * | 3/2002 | Javaherian | 123/491 |
| 6,498,479 | B1 | 12/2002 | Hamaoka et al. | |
| 6,512,974 | B2 | 1/2003 | Houston et al. | |
| 6,585,235 | B2 | 7/2003 | Pattullo | |
| 6,688,585 | B2 | 2/2004 | Braun et al. | |
| 6,848,956 | B2 * | 2/2005 | Ozawa | 440/1 |
| 6,928,996 | B2 | 8/2005 | Tobinai | |
| 7,000,595 | B2 | 2/2006 | Andersson et al. | |
| 7,222,015 | B2 * | 5/2007 | Davis et al. | 701/103 |
| 7,369,932 | B2 * | 5/2008 | Kim et al. | 701/100 |
| 7,506,517 | B2 * | 3/2009 | Uluyol et al. | 60/786 |
| 7,509,209 | B2 * | 3/2009 | Davis et al. | 701/103 |
| 7,546,836 | B2 | 6/2009 | Andersson et al. | |
| 7,963,103 | B2 * | 6/2011 | Nagaoka et al. | 60/286 |
| 8,166,951 | B2 * | 5/2012 | Takahashi et al. | 123/436 |
| 2003/0121496 | A1 | 7/2003 | Matte | |

OTHER PUBLICATIONS

SecondOffice Action dated Jun. 20, 2013 in CN 200880122990.9.

* cited by examiner

ENGINE FUEL DELIVERY SYSTEMS, APPARATUS AND METHODS

REFERENCE TO CO-PENDING APPLICATIONS

This application claims the benefit of and priority from U.S. Provisional Patent Application Ser. Nos. 61/000,451 filed Oct. 27, 2007 and 61/094,973 filed Sep. 7, 2008.

TECHNICAL FIELD

The present invention relates generally to engine fuel systems and more particularly to fuel systems for combustion engines and methods of operating combustion engines.

BACKGROUND

Many small internal combustion engines are supplied with a combustible charge of air and fuel using a carburetor. A typical carburetor includes a body defining a liquid fuel chamber, an air and fuel mixing passage, and one or more fuel passages in communication between the fuel chamber and the air and fuel mixing passage. The fuel passages communicate with the mixing passage between an air inlet at an upstream end and an air and fuel mixture outlet at a downstream end. Typically, a choke valve is disposed in the air and fuel mixing passage near the upstream end to control a quantity of air flowing into the mixing passage during engine cold starting and warm up. A throttle valve is disposed in the air and fuel mixing passage near the downstream end to control a quantity or flow rate of the air and fuel charge flowing out of the mixing passage to the operating engine. In operation, a pressure differential causes liquid fuel to flow out of the fuel passages and into the air and fuel mixing passage where the fuel becomes mixed with air to create the air and fuel charge.

The carburetor creates and controls the combustible charge of air and fuel by controlling the flow of liquid fuel into the air flowing through the mixing passage, and by controlling the flow of air into the mixing passage and/or the air and fuel mixture flowing out of the mixing passage. More specifically, the carburetor may be manipulated to adjust an air to fuel (A/F) ratio in accord with varying engine requirements during engine startup, idle, steady-state operation, maximum power output, changes in load and altitude, and the like. In one example, the choke valve may be closed to such an extent that pulsating vacuum induced by reciprocating pistons in the engine will be greater (or at a larger magnitude of sub-atmospheric pressure) than when the choke valve is open and, thus, will supply a greater or larger quantity of fuel into the mixing passage for a richer A/F ratio. In another example, one or more valves in communication with the fuel passages may be adjusted to supply more, or less, liquid fuel.

Automotive and other fuel injected large engines often use oxygen sensors or Lambda probes exposed to exhaust gas to indicate A/F ratio over a wide range of operating conditions. But such sensors or probes and related hardware and software can be cost prohibitive for some engine applications and particularly small engines or applications without a storage battery for the ignition system.

SUMMARY OF THE DISCLOSURE

A method of operating an engine is disclosed, which includes:

(a) determining a peak power condition for the engine;

(b) measuring a temperature associated with the engine at said peak power condition;

(c) comparing the temperature measured in step (b) with a previously determined temperature associated with a known peak power condition of the engine;

(d) determining an offset value based on the comparison made in step (c);

(e) controlling at least one constituent of an air-fuel mixture delivered to the engine or ignition spark timing based on said offset value. In one implementation, the measure temperature is the exhaust gas temperature. In one implementation, the peak power condition is determined by enleaning a rich air-fuel mixture delivered to the engine until a peak power condition is detected.

One form of a carburetor includes a carburetor body including an air and fuel mixing passage, a valve rotatably disposed in the mixing passage, and a control module. The control module may be carried on the carburetor body and includes a circuit board and a rotary position sensor carried on the circuit board and cooperating with a portion of the valve to sense rotary position of the valve.

Another form of a carburetor includes a body including a fuel and air mixing passage, a solenoid associated with the body and with one or more control passages through which fuel or air flow. The solenoid includes a valve that may be opened to permit communication between two or more passages and may be closed to prevent communication between said two or more passages. In one implementation, the solenoid is responsive to a control signal to selectively permit communication between said two or more passages to alter an air-fuel mixture ratio delivered from the carburetor.

Also disclosed is an electronic control system for use with a light-duty internal combustion engine. The control system includes a control module and a power generation unit having a charge circuit with a charge capacitor and a discharge circuit with a discharge switch, and the discharge switch is coupled to the charge capacitor and causes ignition of the light-duty internal combustion engine by its operation. The power generation unit controls the discharge switch during a first engine sequence and the control module controls the discharge switch during a second engine sequence.

BRIEF DESCRIPTION OF THE DRAWINGS

The following detailed description of preferred embodiments and best mode will be set forth with reference to the accompanying drawings, in which.

DETAILED DESCRIPTION OF PREFERRED EMBODIMENTS

Figure 1:
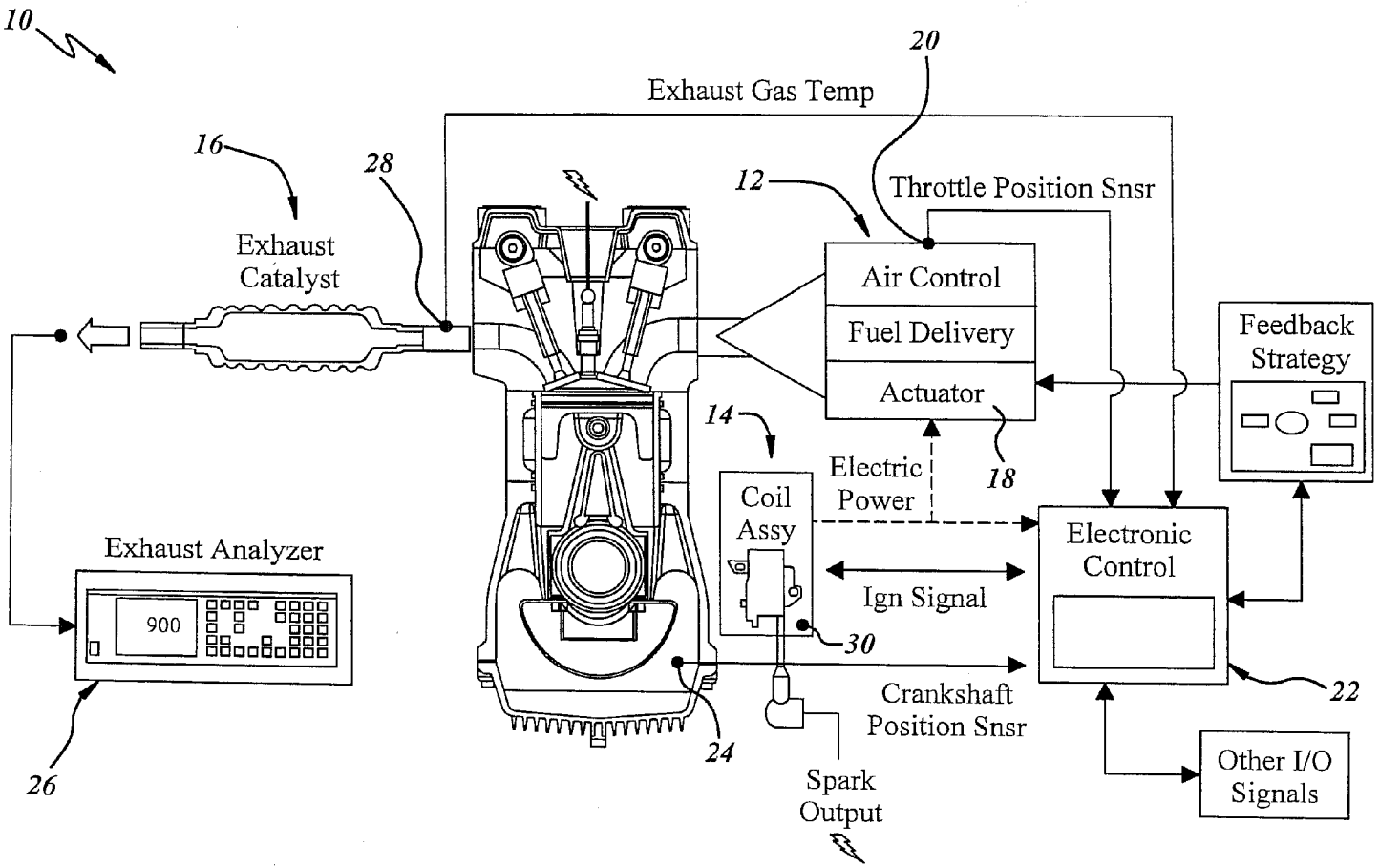
FIG. 1 is a schematic view of an exemplary fuel system.

Referring in more detail to the drawings, FIG. 1 is a schematic of an engine system with an engine 10 that may be operated in accordance with an exemplary method described herein below. The engine 10 may be any suitable two-stroke or four-stroke engine. Such engines may include, for example, single cylinder engines up to about 225 cc displacement such as for walk-behind lawn mowers, or single or multiple cylinder engines greater than about 225 cc displacement such as for riding lawn tractors or similar lawn or garden ground supported equipment. Other applications may include smaller two wheel or all-terrain-vehicle (ATV) engines up to about 150 cc displacement, or even low-cost larger displacement engines for snowmobiles or ATV's.

Still referring to FIG. 1, the engine 10 may include a carburetor 12 that provides a combustible charge of air and fuel to the engine, a power generation unit (PGU) 14 to produce engine ignition spark to ignite the combustible charge, and preferably an exhaust catalyst 16 to treat engine exhaust gases from the combustion of the charge of air and fuel. The carburetor has an air bleed valve 18, such as a solenoid valve, and an engine load sensor 20, such as a throttle valve position sensor. The engine also includes a control module 22 to control at least some functionality of at least the carburetor and/or the PGU, and the PGU may also power the control module and the solenoid valve of the carburetor. Also, the engine may include one or more devices 24 used in determining engine speed and/or other engine timing, and such devices may include a crankshaft position sensor, which may communicate with the control module. FIG. 1 also illustrates an exhaust analyzer 26 which may be used to evaluate the performance of the engine 10 and to initially calibrate the engine. The engine may further include an engine temperature sensor, such as an exhaust gas temperature (EGT) sensor 28, which may communicate with the control module.

The EGT sensor may be any suitable type of temperature sensor such as a combination of three inexpensive "K" type thermocouple junctions. In such a thermocouple arrangement, the junctions may be arranged in parallel and positioned in a circular array spaced 120 degrees apart and preferably disposed in an exhaust manifold gasket (not shown) between the catalyst and an engine exhaust outlet. Sandwiching the thermocouple within the confines of an exhaust manifold gasket provides added flexibility and avoids the thermocouple being in direct contact with the muffler or engine manifold. The junctions may be located in close proximity to the outer perimeter of the exhaust conduit for a quiescent boundary layer flow and improved signal stability due to the heat sink or absorption effect of localized exhaust conduit material, compared to a more radially inward location that may, in at least some applications, be more sensitive to rapidly changing temperature differentials of high velocity gas of exhaust cycles. The multiplicity of sensors in such an array in parallel provides a network of signal redundancy in the event one or more junctions become inoperative, such as electrically open or shorted, or carbon fouled. The monitoring of EGT variation and averaging of multiple thermocouple signals by the control module provides a relatively fast and simple indication of combustion efficiency.

As an alternative to EGT sensors, the engine temperature sensor may be carried by the engine cylinder head in close proximity to the combustion chamber(s) as an indication of the state of an engine combustion characteristic such as combustion efficiency. This may be applicable in at least some applications where measurement time may be less critical for feedback actuation, or where loading conditions may be more intermittent in nature, such as for Lawn/Garden Vacuum/Mulch machines or vegetation shredders. Also, a temperature sensor 30 may be carried by the PGU to provide a relative indication of engine starting or post-run soak back temperature for improved engine startability and warm up.

Control Module and Power Generation Unit (PGU)

Figure 2:
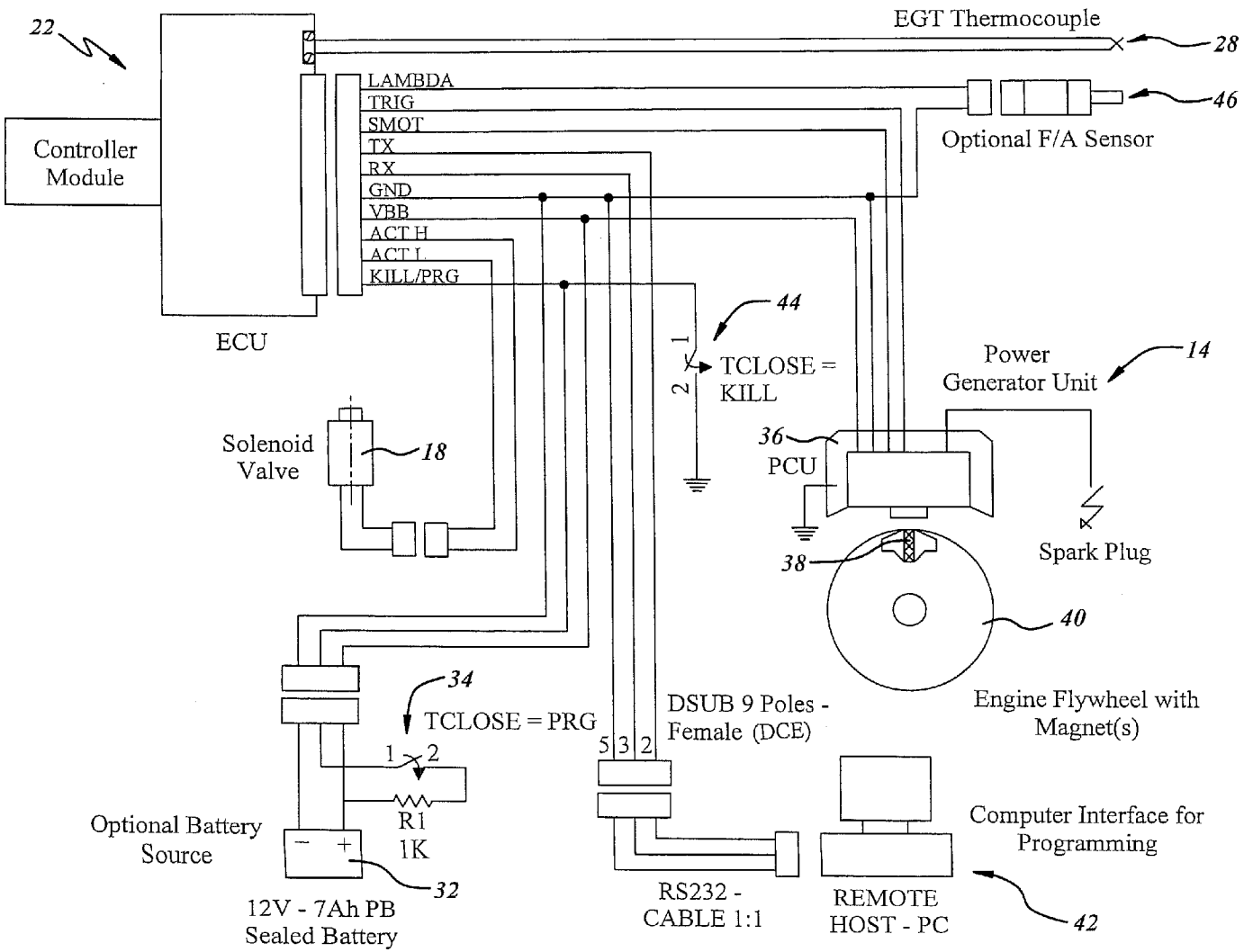
FIG. 2 is a schematic view of an exemplary control module in communication with related input and output devices of the fuel system of FIG. 1.

As shown in FIG. 2, the control module may be powered by a power source 32, such as one or more batteries, capacitors, or the like, that may be controlled with a power switch 34. In addition, or alternatively, the control module may be powered by the power generation unit (PGU) that may include a coil assembly 36 used in conjunction with one or more magnets 38 carried by an engine flywheel 40.

Figure 2A:
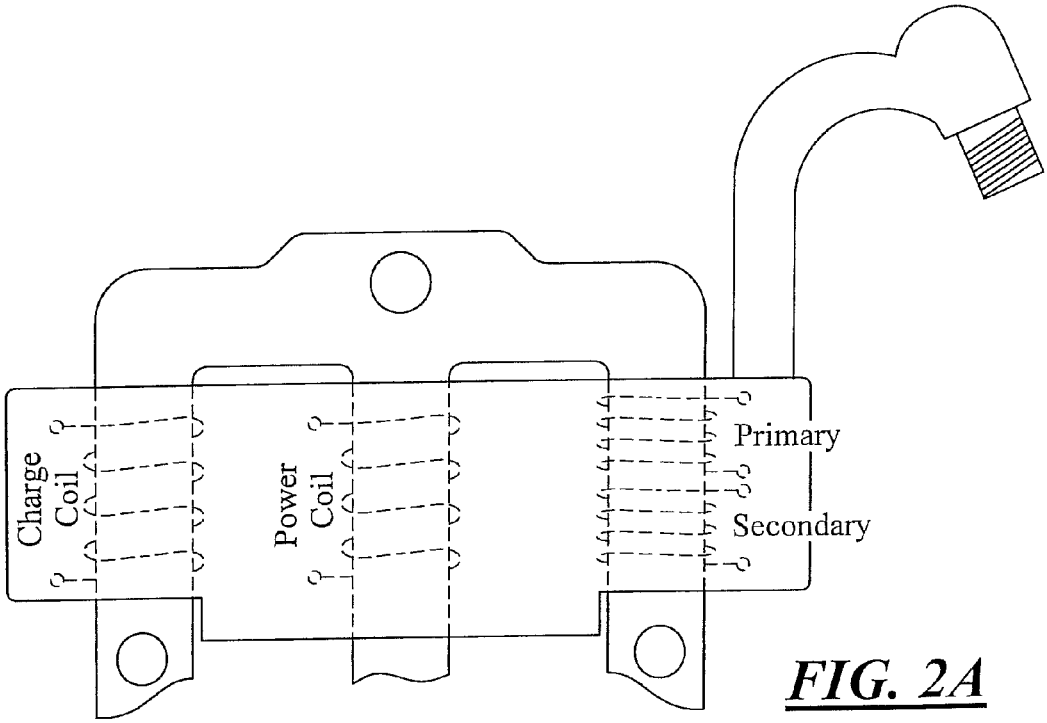
FIGS. 2A & 2B illustrate configurations of a Power Generator Unit lamstack layout for various coil windings.
Figure 2B:
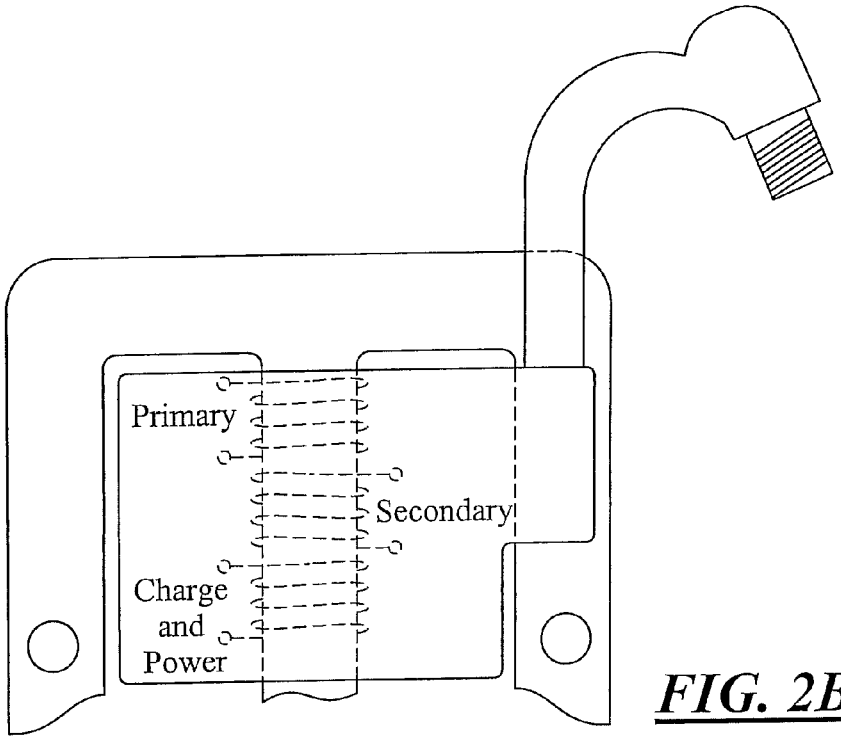

The PGU 14 may serve a dual function as an ignition module that exchanges ignition timing and power signals with the control module, and as a power generator that extracts electrical energy from the flywheel magnet(s). In this dual function role, the PGU not only provides high energy spark ignition harnessed in a conventional way by the rotating flywheel magnet as triggered by a signal from the control module, but also includes circuitry for electrical power generation and delivery to the control module and the solenoid valve in the carburetor. As shown in FIG. 2A, the PGU may include primary and secondary coils for developing spark energy to initiate combustion, and an external spark wire emanating from a high voltage coil connected to an engine spark plug. Typically, both the primary coil and the secondary coil may be located on one leg of an iron lamstack of the coil assembly, and a charge coil may be carried on another leg of the lamstack for conducting a magnetic field created as the rotating flywheel magnet passes in close proximity to the lamstack. The PGU may also include an additional power coil carried on a second or third leg of the iron lamstack. The use of this third leg coil can be implemented if desired to power the solenoid valve or other devices. But preferably, a conventional three legged lamstack PGU may provide the required power for the control module and sensors in addition to its own internal power needs. As shown in FIG. 2B, it may also be possible to include all the coil windings on a center leg stacked and arranged in a strategic orientation for lower manufacturing costs, and for improved magnetor flux conduction for flywheels equipped with multiple magnets.

In an exemplary embodiment, the PGU 14 is physically separated from the control module 22 such that they are located in different parts of the overall system. For instance, PGU 14 can be located adjacent flywheel 40 so that it can electromagnetically interact with magnets 38, and control module 22 can be located atop the carburetor or throttle body assembly so that rotary position sensor 90 can interact with throttle shaft 51, as will be subsequently explained. By splitting or separating the PGU 14 from the control module 22, the overall system may enjoy certain benefits.

For example, with a PGU that is separate and independent from a control module, the two components can simultaneously work in parallel and improve the performance of the overall system. Also, having separate PGU and control module units can reduce manufacturing costs by sharing more standard parts. Consider the example where two different small engine applications have the same carburetor but different flywheels. In systems where the PGU and control module are integrated or combined into a single component (i.e., non-separated electrical systems), two different combined components would be needed in order to accommodate the different flywheels; this is true even though the control modules are the same. In the exemplary embodiment described here, the two different flywheels could be accommodated with two PGUs and a single, commonly shared control module. These are, of course, only some of the benefits of using the exemplary PGU/control module arrangement, as other benefits could also exist.

Figure 44:
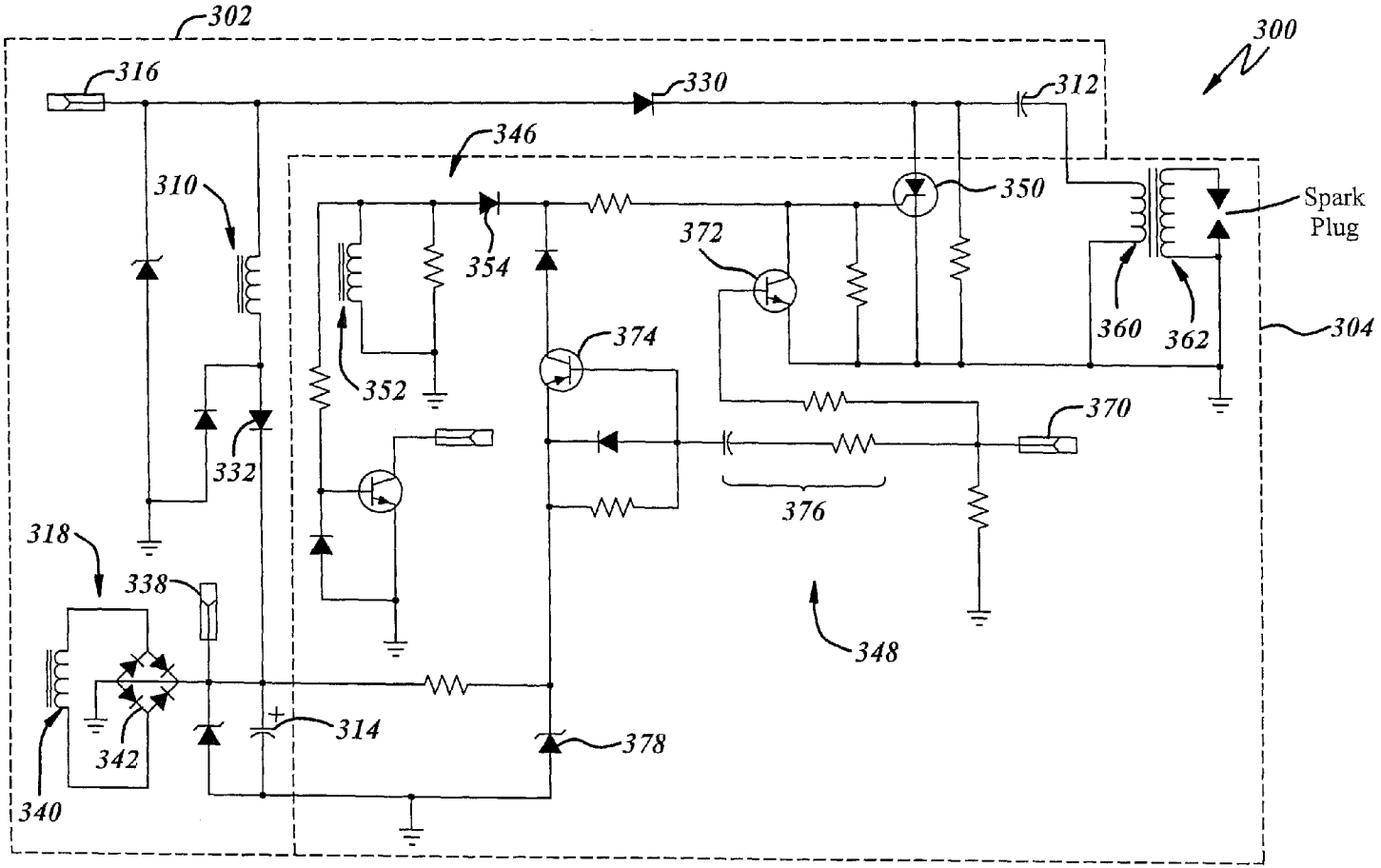
FIG. 44 is an exemplary embodiment of an analog Power Generation Unit (PGU) of a control system that may be used in the fuel system of FIG. 1.

Depending on the requirements of the application, either an analog or a digital PGU may be used. With reference to FIG. 44, there is shown an exemplary embodiment of an analog PGU 300 that interacts with flywheel magnets 38, a spark plug, control module 22, and any other suitable components known in the art. Analog PGU 300 generally includes a charge circuit 302 and a discharge circuit 304, but skilled artisans will appreciate that a variety of other component combinations could also be used.

Charge circuit 302 electromagnetically interacts with flywheel magnets 38 and may provide power for a variety of different devices throughout the system. According to this particular embodiment, charge circuit 302 includes a charge winding 310, a charge capacitor 312, a power capacitor 314, a kill switch 316, and an optional charge coil arrangement 318. Charge winding 310 is connected to charge capacitor 312 via a rectifying diode 330 so that electrical charge induced in the charge winding by the rotating magnets 38 can energize the charge capacitor. Charge winding 310 is also connected to power capacitor 314 via another rectifying diode 332. This arrangement enables charge winding 310 to energize charge capacitor 312 with a first portion or polarity of the energy induced in the winding, and energize power capacitor 314 with a second portion or polarity of the induced energy.

Charge capacitor 312 holds or maintains its charge until it is triggered for discharge by either the discharge circuit 304 of the PGU or the control module 22, as will be explained. Power capacitor 314 is connected to an output 338 and may provide power to control module 22 and/or other suitable devices.

Kill switch 316 provides the operator with a manual override for shutting down the engine, as is known in the art. In this particular arrangement, the kill switch is connected to one of the terminals of charge winding 310, however, other arrangements and embodiments could be used instead.

Optional charge coil arrangement 318 may be used to provide additional energy to various components throughout the system and, according to this embodiment, includes a charge winding 340 and a rectifying bridge 342. Although not shown, the charge induced in the optional charge coil arrangement 318 could be used to power an air/fuel ratio controlling solenoid or other electrical device.

Turning now to discharge circuit 304, this circuit includes two separate sub-circuits 346, 348 for triggering a discharge switch 350 (e.g., an SCR, thyristor, etc.), which in turn causes a high voltage ignition pulse to be sent to the spark plug. A first sub-circuit 346 includes trigger winding 352 which is connected to discharge switch 350 via rectifying diode 354. Assuming that the discharge path is not shorted, as will be explained, passage of flywheel magnets 38 causes trigger winding 352 to send a signal to the gate of discharge switch 350. Activation of the discharge switch causes capacitor 312 to discharge through a primary winding 360 of a transformer, thus causing a high voltage ignition pulse to be induced in secondary winding 362 and sent to the spark plug.

A second sub-circuit 348 may be used to control the ignition timing via control module 22, as opposed to controlling it exclusively with circuitry from the PGU. According to an exemplary embodiment, second sub-circuit 348 includes signal input 370, switches 372 and 374, and RC circuit 376. In between triggering events, signal input 370 is provided with a high signal from control module 22 that maintains switch 372 'on' and switch 374 'off'. With switch 372 'on', signals from trigger coil 352 are shorted so that they cannot control the state of discharge switch 350; i.e, a short in the discharge path, as mentioned above. When control module 22 determines that it is time to fire the spark plug, a low signal is provided to signal input 370 which turns switch 372 'off' and switch 374 'on'. With switch 374 'on' or conductive, a voltage on zener diode 378 (e.g., about 5 v) can be applied to the gate of discharge switch 350 via switch 374 without being shorted by switch 372, which is now turned 'off'. Skilled artisans will appreciate that the timing of these events can be affected and controlled by RC circuit 376.

It should be appreciated that the two sub-circuits 346, 348 described above provide the system with two separate ways of controlling the ignition timing. With respect to the first sub-circuit 346, the ignition timing may be controlled and/or influenced by the passing of flywheel magnets 38 by trigger winding 352; this can generally occur without any influence from control module 22. With respect to the second sub-circuit 348, the ignition timing may be controlled by a signal provided by control module 22 to signal input 370; this can generally occur without influence from the passing of the flywheel magnets by trigger winding 352. A discussion of when and how these two sub-circuits determine control of the ignition timing will be subsequently provided.

Figure 45:
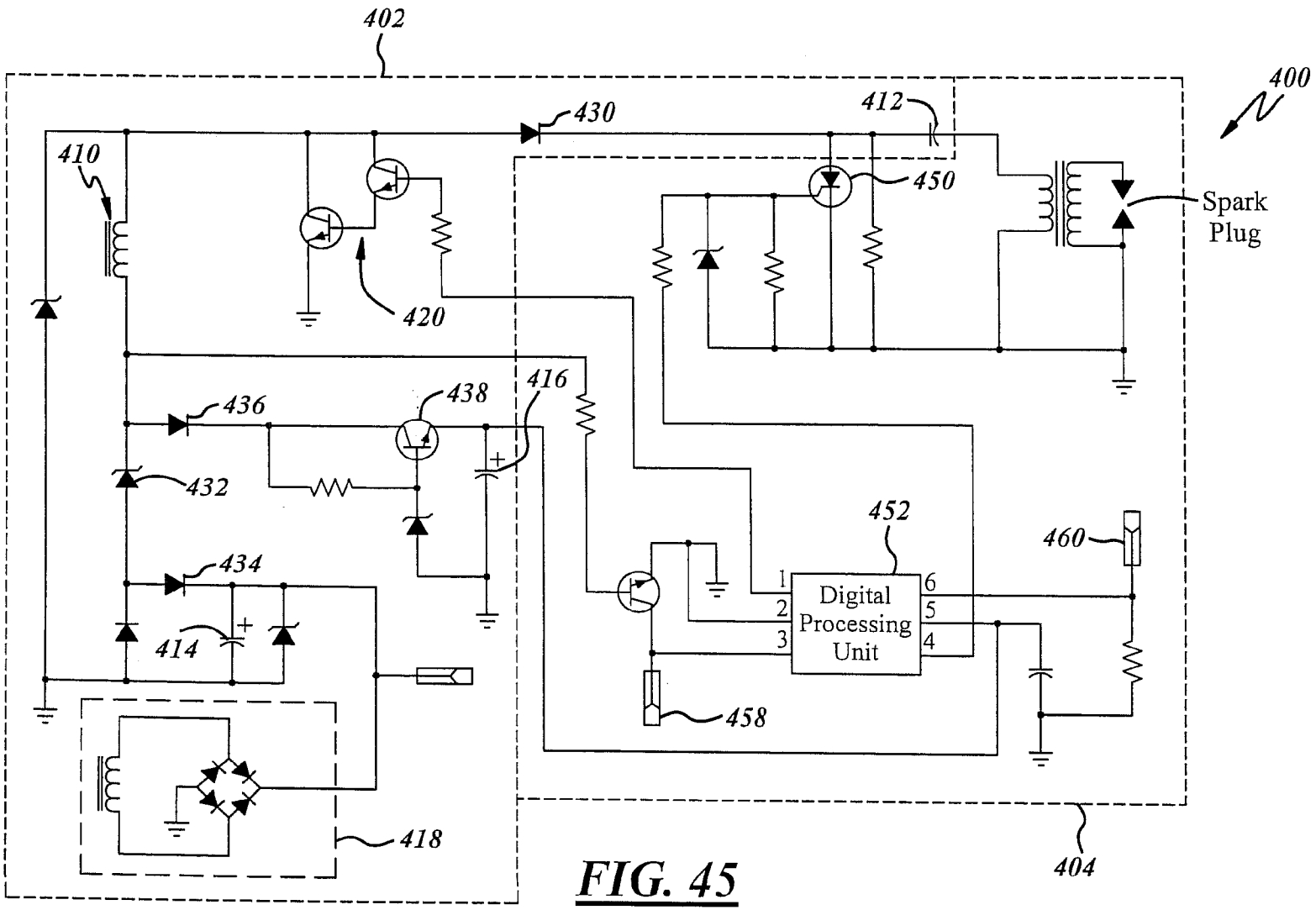
FIG. 45 is an exemplary embodiment of a digital PGU of a control system that may be used in a fuel system such as that shown in FIG. 1.

With reference to FIG. 45, there is shown an exemplary embodiment of a digital PGU 400 that interacts with flywheel magnets 38, a spark plug, control module 22, and other suitable components. Digital PGU 400 may be used in place of the analog PGU 300 just described and, according to this embodiment, generally includes a charge circuit 402 and a discharge circuit 404. Those who are skilled in the art will appreciate that a number of equivalent or similar components exist between analog and digital PGUs 300 and 400, and that much of the discussion provided above applies here as well.

Charge circuit 402 generally includes a charge winding 410, a charge capacitor 412, first and second power capacitors 414, 416, an optional charge coil arrangement 418, and a switching device 420. Charge winding 410 is connected to charge capacitor 412 via a rectifying diode 430 so that electrical charge induced in the charge winding by the rotating magnets 38 can energize the charge capacitor. Charge winding 410 is also connected to first power capacitor 414 via zener diode 432 and diode 434, and second power capacitor 416 via diode 436 and switch 438. Charge winding 410 can energize charge capacitor 412 with a first portion or polarity of the energy induced in the winding, and energize power capacitors 414 and/or 416 with a second portion or polarity of the induced energy. The energy stored on first power capacitor 414 may be used to power control module 22, and the energy stored on second power capacitor 416 may be provided to power the digital processing unit in PGU 400. Other powering arrangements could also be used.

Charge capacitor 412 and optional charge coil arrangement 418 are similar to those already described; thus, a duplicate description has been omitted here. It should be appreciated that a kill switch, as well as a number of other known components, could be included in PGU 400.

Switching device 420 is an optional component that may be used during the charging process to selectively short the charge coil 410 and improve the charging of charge capacitor 412. Switching device 420 is shown here as a Darlington arrangement, but it may be provided in any other suitable form that can selectively short charge coil 410. During the charging process, switching device 420 is turned 'on' at select times, which in turn creates a ground path for the energy in charge coil 410 so that it is shorted. This causes a flyback-type of effect to occur so that the amount of charge being deposited on charge capacitor 412 is even greater than during a normal charge cycle. For more information regarding switching device 420, please see U.S. application Ser. No. 12/017,200, which is assigned to the present assignee and is incorporated herein by reference.

Discharge circuit 404 includes a discharge switch 450, a digital processing unit 452 and a number of other circuit components, and may control the ignition timing in one of several ways. In a first mode, discharge circuit 404 is able to control the ignition timing without the assistance of the control module 22. For example, digital processing unit 452 may use input from a crankshaft angle sensor indicative of engine speed and/or position, as well as input from any other suitable sensor, and calculate an appropriate ignition timing based on the input. In a second mode, discharge circuit 404 controls the ignition timing based on a signal provided by control module 22. In this particular embodiment, digital processing unit 452 has a pin arrangement where pin 1 sends an output to switching device 420, pin 2 is connected to ground, pin 3 receives engine speed input from one or more sensors and is connected to engine speed output 458, pin 4 sends an output to discharge switch 450, pin 5 receives power for driving the processing unit, and pin 6 receives input from a single input 460 that is connected to control module 22. It should be appreciated that a variety of different inputs, outputs, pin arrangements, etc. could be used and that the exemplary embodiment shown and described here is just one possibility.

The PGU may perform several functions including the generation of low speed spark timing and ignition spark energy for engine starting and low speed run conditions preferably below 1,200 RPM. Typically, ignition spark energy for engine starting can be supplied to the engine by 150 to 200 RPM and is available to support favorable engine start events. As the engine begins to support combustion and accelerates to a post-start idle condition, for example, over 1,500 RPM to 1,800 RPM, electrical power may be harnessed and stored in an onboard capacitor, such as charge capacitors 312, 412. At about 1,100 RPM, sufficient electrical power may be available and delivered to the control module to preclude any adverse control module bootup events or re-cycled starts due to insufficient power thresholds or fluctuations at very low engine speeds. At this point, the control module may be sufficiently powered to take control of spark timing from the PGU, carry out engine parameter monitoring via sensors or the like, and return a spark digital trigger signal back to the PGU for initiating subsequent high energy ignition spark events.

Figure 47:
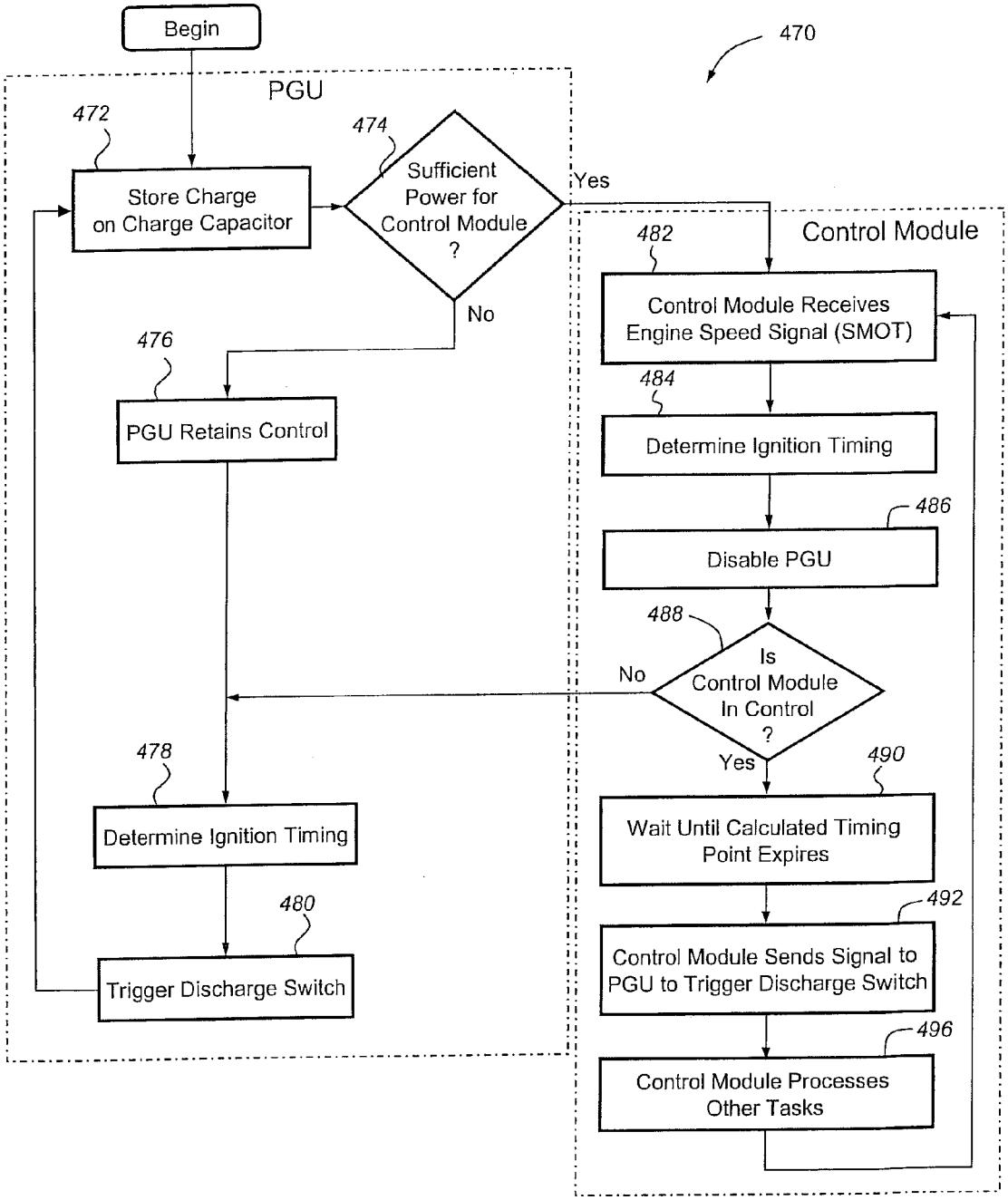
FIG. 47 is a flowchart of an exemplary hand-off procedure between a PGU and a control module.

According to the exemplary hand-off procedure 470 shown in FIG. 47, the PGU controls the ignition timing during the early stages of operation and then, once sufficient power has been generated and stored, control of the ignition timing and the like is handed off to the control module. The following description is provided in the context of digital PGU 400, however, it should be appreciated that this exemplary method could be used with analog PGU 300, as well as any other suitable PGUs.

Beginning with step 472, charge is generated and stored on charge capacitor 412. This may occur as soon as the flywheel magnets 38 start rotating past charge coils 410. Step 474 determines whether or not a sufficient amount of energy has been generated and stored to properly power control module 22. The exact amount of energy needed, the precise number of engine revolutions required, etc. generally varies by application. If there is not enough energy to operate control module 22, then PGU 400 retains control of the ignition timing and any other necessary functions. Step 476 disables a control signal from control module 22 (in FIG. 47, the control signal is provided via signal input 460). With the control signal from control module 22 disabled, the PGU must determine the ignition timing and can do so in a variety of ways.

According to one embodiment, digital processing unit 452 senses the engine speed and uses a look-up table to calculate a corresponding ignition timing, step 478. Look-up tables are only one potential resource for determining ignition timing, as algorithms and other suitable techniques could also be used. In the example of analog PGU 300, the ignition timing could be determined by the analog circuitry, as already explained. Once the ignition timing has been calculated, step 480 activates or triggers discharge switch 450 accordingly.

Referring back, if step 474 determines that enough energy has been generated and stored to properly power control module 22, then the control module may take over control of the ignition timing and/or any other required tasks. In step 482, control module 22 receives an engine speed signal provided by the signal output 458 of the PGU. With the engine speed information, and any other needed data, control module 22 can then use a look-up table or the like to determine the ignition timing, step 484. The control module 22 then disables the PGU from controlling the ignition timing in one of several ways, step 486. In the example of the analog PGU, control module 22 can use a 'high' signal on signal input 370 to disable the triggering capabilities of the PGU, as already explained. Or, in the case of digital PGU 400, the control module can use signal input 460 to communicate with digital processing unit 452 and instruct that unit to implement ignition timing commands determined by control module 22. In either of these exemplary cases, the control module 22 takes over control of the ignition timing.

Step 488 may check to make sure that control module 22 is in fact in control. In one example, this step could entail checking the status of the signal provided on signal input 460, however, other methods could be used as well. If the control module is not in control, then control is passed back to step 478 so that the PGU can take over ignition timing responsibilities, etc. One instance where this may be helpful is in a so-called 'limp home' mode. If there is a failure with control module 22 such that it is unable to provide the ignition timing for the system, then the PGU could again take over and provide ignition timing according to the technique already described. Such a capability can improve the redundancy and dependability of the system.

If step 488 determines that the control module is in control, then control is passed to step 490 which waits for the previously determined ignition timing to expire. Once the ignition timing expires or otherwise occurs, control module 22 sends a signal to the PGU instructing it to trigger discharge switch 450, step 492. In the case of the exemplary digital PGU 400, control module 22 changes the state of the signal provided via signal input 460 from a 'high' state to a 'low' state. This is, of course, only one possible way for firing the spark plug, as many other methods and techniques could be used as well.

Assuming that control module 22 is still in control of the system, step 496 causes the control module to process other tasks, such as controlling air/fuel ratios, etc. It should be appreciated that the exemplary embodiment 470 shown in FIG. 47 is only exemplary in nature. The precise flow of the programming logic, the number of processing steps, the sequence of steps, the nature of the steps, etc. could certainly vary from the schematic presentation provided in FIG. 47. Furthermore, it should be appreciated that a variety of ignition timing techniques—for example, more sophisticated techniques for manipulating timing advances and retards, for eliminating wasted sparks, etc.—could be used with ignition timing control of the PGU and/or the control module. It is not necessary for the PGU to employ any particular type of charge/discharge arrangement, such as the exemplary capacitive discharge ignition (CDI) embodiment shown here. Other types of arrangements and technologies, including fly-back type systems, may also be used.

Figure 46:
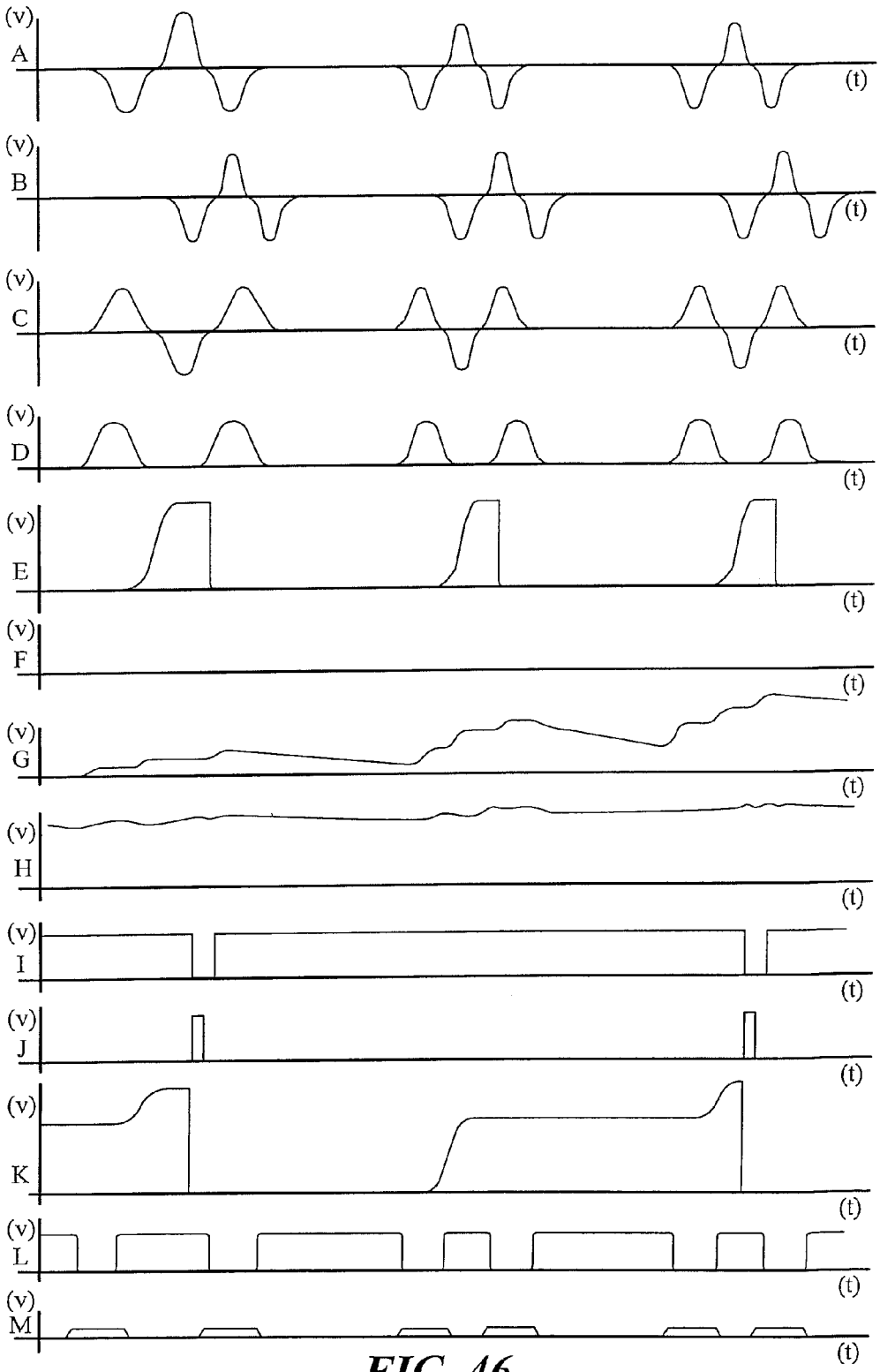
FIG. 46 is a graph including a number of timing plots that correspond to an exemplary analog PGU and an exemplary control module.

With reference to FIG. 46, there is shown a number of timing plots that correspond to an exemplary analog PGU and an exemplary control module. Timing plots A-E may pertain to analog PGU 300 and timing plots F-M may pertain to control module 22. More specifically, plot A pertains to the voltage in winding or coil 310, plot B pertains to the voltage in winding or coil 340, plot C pertains to the voltage in winding or coil 352, plot D pertains to the signal provided to switch 350, plot E pertains to the charge stored on capacitor 312 (with a wasted spark), plot F pertains to the signal on signal input 370 during start-up (i.e., when the PGU is in control of the ignition timing), plot G pertains to the amount of charge stored for operation of the control module during start-up, plot H pertains to the amount of charge stored for operation of the control module after start-up (i.e., once the control module takes over control from the PGU), plot I pertains to the signal on signal input 370 after start-up, plot J pertains to the signal provided to switch 350 from the control module after start-up, plot K pertains to the charge stored on capacitor 312 after start-up (without a wasted spark), plot L pertains to the crankshaft position/engine speed signal, and plot M pertains to the signal provided to switch 350 after start-up. Again, the timing plots shown in FIG. 46 are only exemplary and schematic in nature and are only provided to help describe one possible embodiment.

The PGU may also provide an engine crankshaft angular position and/or speed signal for use by the control module using hall-effect sensors (not shown) located in the PGU and triggered by the rotating flywheel magnets in proximity to the PGU. In other words, crankshaft position may be observed using the hall-effect sensors or by observation of charge coil voltages induced from the rotating flywheel magnet(s) instead of or in addition to a separate crankshaft position sensor. For multiple magnet configurations on the engine flywheel, some of the control module software may include assessment of cycle timing to ensure correct phasing of the engine cycles has been selected.

Efficient use of flywheel magnetic energy and subsequent conversion to electrical power used in the present application is disclosed in U.S. patent application Ser. No. 12/017,200 filed on Jan. 21, 2008 which is incorporated herein by reference in its entirety. In another example, the engine may include an ignition system to power a control module such as that disclosed in U.S. Pat. No. 7,000,595, which is assigned to the assignee hereof and is incorporated herein by reference in its entirety.

Referring again to FIG. 2, the control module may include a small electronic circuit board carrying one or more microprocessors, thermocouple amplifiers, current and voltage regulators, throttle position sensors and accompanying circuitry, and related communication interfaces. Functions of the control module may include software management of electronic engine control strategy including input signal conditioning, parameter monitoring, calculations, and the like, as well as carburetor solenoid valve control such as timing of power pulses, event duration, and voltage/current pulse width modulation, in addition to triggering engine spark events and timing advance. The control module may interface with a computer 42, such as via RS232 port standard, for programming and parameter monitoring, and may be adapted to receive power via an external battery supply for operation with the computer when the engine is not running.

In typical operation, the control module may receive an input SMOT pulse from the PGU for engine crankshaft position and related calculations for engine speed from this signal which may form the basis for various timing relationships for spark trigger and carburetor solenoid valve control. The control module may include components for thermocouple conditioning like filtering and amplification in monitoring engine temperature. A cold junction reference may be detected using an NTC sensor located close to a thermocouple connector on the circuit board. This onboard thermistor may also function as an indication of ambient temperature, or soak back temperature of the carburetor after a period of engine operation. The resulting input temperature signal may be used for reference engine temperature and may be software programmable for gain and offset coefficients along with a sampling period. Additional thermocouple channels may be accommodated in the event auxiliary temperature signals are desired for a particular application, such as ambient air temperature, inlet air temperature into the carburetor bore, cylinder head temperature, crankcase oil temperature, cooling water temperature or the like.

The control module may provide a digital output signal (e.g. 0-5V level) back to the PGU for triggering the high voltage spark event to support a wide range of ignition timing control variations based on engine speed and load conditions as indicated by a throttle position sensor signal. This trigger may occur as a falling edge of a trigger pulse command so that when a trigger digital line is high at 5V, internal spark generation in the PGU is inhibited. The spark event may be triggered at a falling edge of this signal and may remain normally low until the next commanded spark event.

A power supply voltage threshold may be monitored during engine starting and shutdown events whereby a sufficient Vbb supply bias is available for bootup and sustained operation of the control module as delivered by the PGU. Otherwise, ignition control for starting and low speed transition may be handled by default by the PGU until sufficient electrical power has been established to fully power the control module, as explained above in more detail.

A double function input may be provided for stopping the engine and for reprogramming memory stored performance tables or maps, or firmware. Normally a Kill/Prog terminal has an internal 5V pullup when not connected, and a short to ground can be used to flag the engine stop request, although this function may be addressed using a signal terminal on the PGU. Otherwise, a connection to Vbb on this terminal before control module powerup enables a programming sequence and places the control module in a mode to establish communication with an external computer such as for upload or download exchange of software, or the like.

Also, the control module may be activated or deactivated by opening or closing a kill switch 44. The control module may also include an interface for communication with an external computer of any kind. Again, the control module receives any of a number of suitable engine parameter signals such as from EGT and throttle position sensors, and transmits any of a number of suitable engine control signals such as a carburetor solenoid valve opening signal.

The control module may also receive an air to fuel ratio signal from an A/F sensor 46. This provides an option to use a narrow band or "switching Lambda" sensor for detection of oxygen concentration in the exhaust gas (which tells whether the A/F ratio is above or below stoichiometric, but does not provide any useful linearity or proportional output for feedback use). A wide range sensor that would provide usable linear response would need to have an external control unit for the signal processing and associated control circuitry. Both of these type sensors add significant expense and complexity to the feedback methodology for the EEM application.

The control module may include any suitable electronics hardware and software to receive engine input signals, process those signals, and transmit engine output signals. For example, the control module may include a control module, memory, and interfaces. The interfaces may include A/D converters, signal conditioners, and/or other electronics or software modules, and may conform to protocols such as RS-232, parallel, small computer system interface, and universal serial bus, etc. The control module may be configured to provide control logic that provides some of the functionality for the engine. In this respect, the control module may encompass one or more microprocessors, micro-control modules, application specific integrated circuits, and the like. The control module may be interfaced with the memory, which may be configured to provide storage of computer software that provides at least some of the functionality of the engine and that may be executed by the control module. The memory may be configured to provide storage for data such as engine models, sensor data, or the like. The memory can be any suitable memory including any type of RAM, ROM, EPROM, and/or the like.

The control module also drives the solenoid valve of the carburetor by discrete actuator high and actuator low signal lines applied across each side of the solenoid coil. The actuator high signal is a high side driver output with On/Off capability, and the actuator low signal communicates Pulse Width Modulation (PWM). The solenoid driving arrangement provides synchronous, asynchronous, and phasing of actuator pulse durations (on, off, and/or centering functions per actuation event). Thus, the control module can drive the solenoid valve by duty cycle, PWM, or a mixed mode of actuator electrical driving characteristics. The control module via suitable software parameters can vary applied voltages used for initial peak power, the corresponding peak duration, and holding voltage for an actuator pulse.

Carburetor

Figure 4:
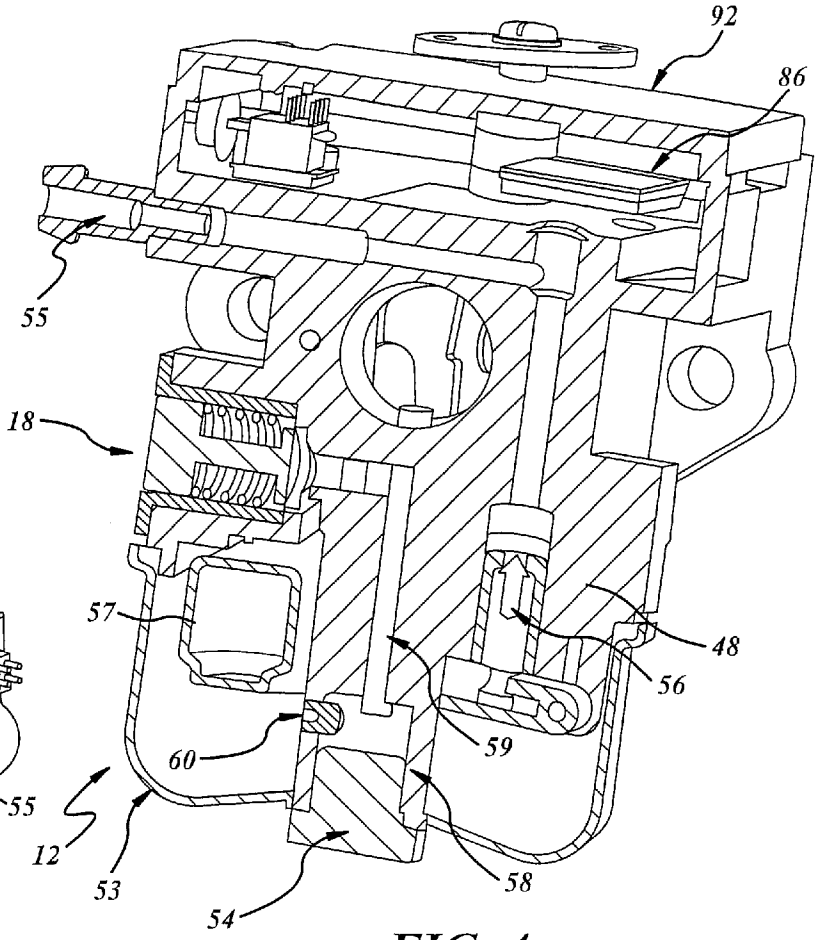
FIG. 4 is a perspective cross-sectional view of the carburetor of FIG. 3.
Figure 3:
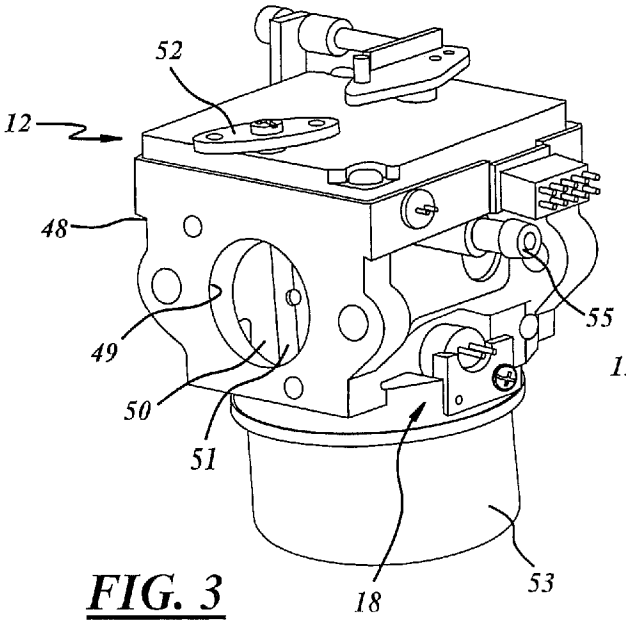
FIG. 3 is a perspective view of an exemplary carburetor for use with the engine system of FIG. 1.

Referring now to FIGS. 3-4, the carburetor 12 may be a float-bowl carburetor that may include the solenoid valve 18 in an air bleed path described below. Those of ordinary skill in the art will recognize that, aside from the novel aspects described herein, the carburetor may be of conventional design. The carburetor may include a body 48 having an air and fuel mixing passage 49 extending therethrough, and a throttle valve 50 disposed in the mixing passage and carried by a valve rotating device such as a shaft 51 extending through the body and a lever 52 connected to the shaft.

Referring to FIG. 4, the carburetor also may include a float bowl 53 sealingly carried on the body by a fastener 54 (FIG. 4), a fuel inlet and passage 55, an inlet needle 56 in communication with the inlet passage, and a float 57 to urge the inlet needle closed. The body may include a fuel nozzle 58 extending into the float bowl and including a nozzle passage 59 and a fuel restriction jet 60 to the limit mass flow rate of fuel into the nozzle at a pressure differential across the jet. The nozzle bore extends through the nozzle and is in fluid communication with and between the fuel bowl and the mixing passage.

Figure 5:
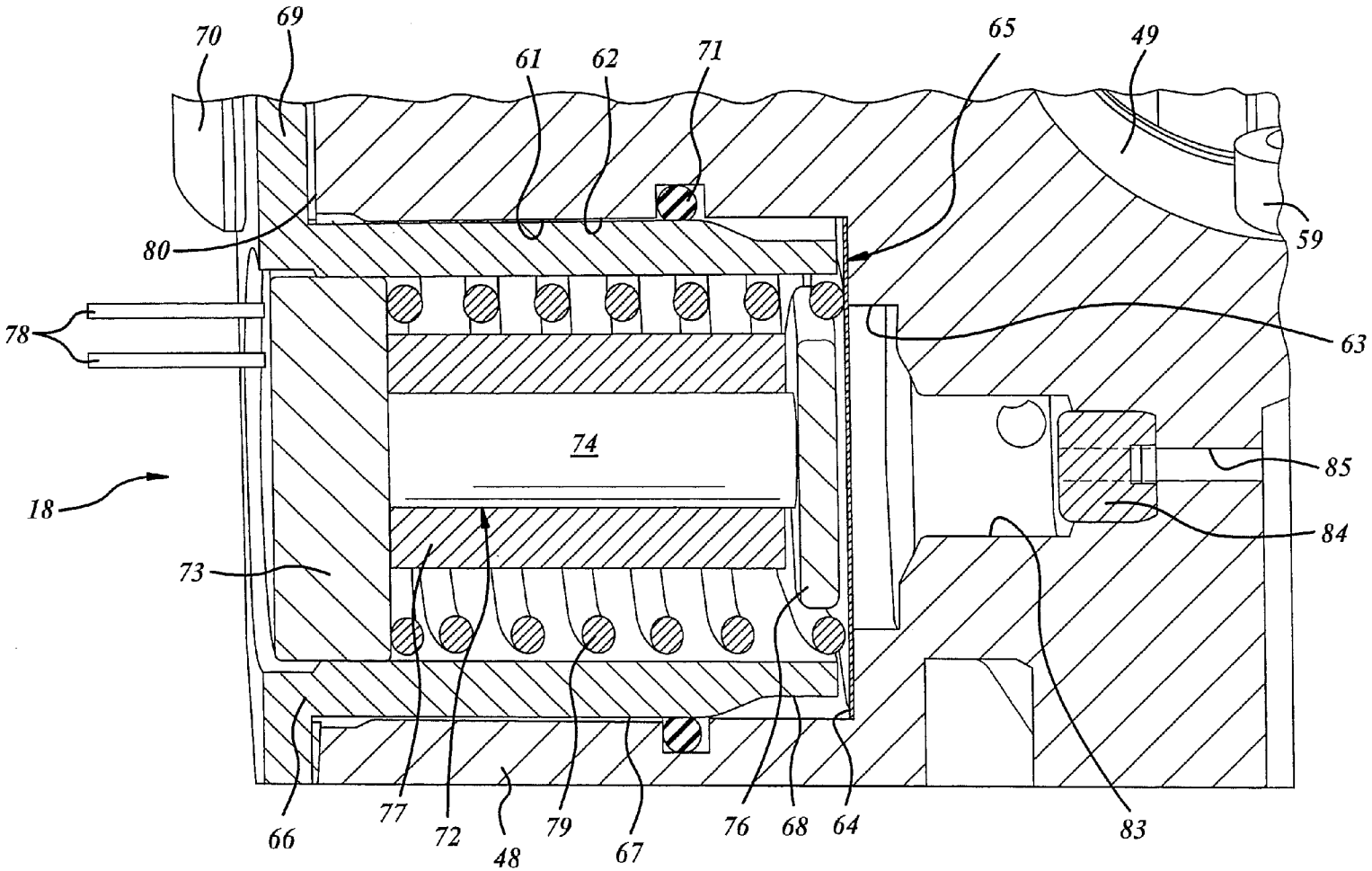
FIG. 5 is an enlarged fragmentary cross-sectional view of the carburetor shown in FIG. 4.
Figure 7:
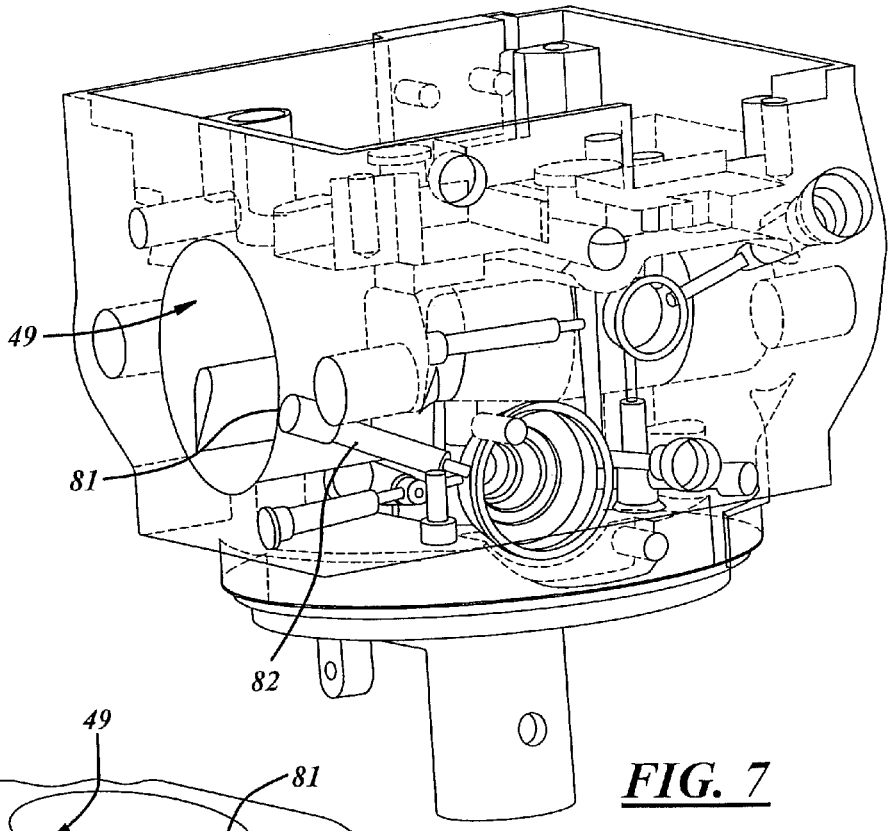
FIG. 7 is a semi-transparent, side perspective view of a portion of the carburetor of FIG. 3, illustrating air and fuel passages.
Figure 6:
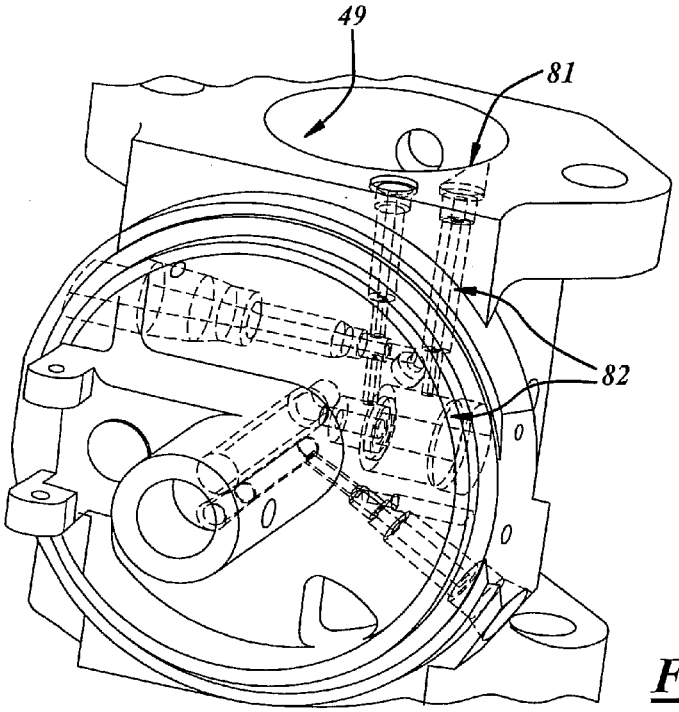
FIG. 6 is a bottom perspective view of a portion of the carburetor of FIG. 3, illustrating air and fuel passages in hidden lines.
Figure 8:
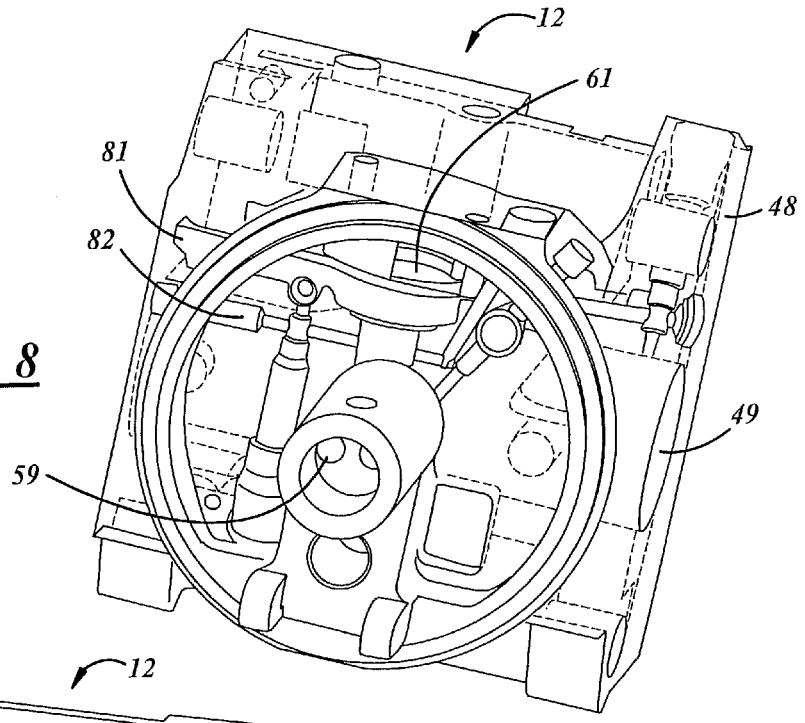
FIG. 8 is a semi-transparent, bottom perspective view of a portion of the carburetor of FIG. 3, illustrating air and fuel passages.
Figure 9:
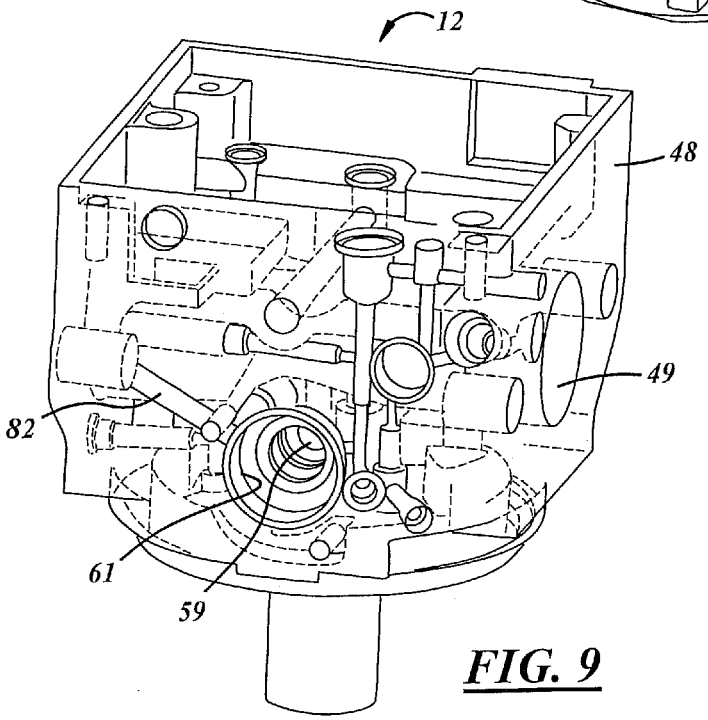
FIG. 9 is a semi-transparent, side perspective view of a portion of the carburetor of FIG. 3, illustrating air and fuel passages.

Referring now to FIG. 5, the carburetor body may include a pocket 61 to receive the solenoid valve 18. The pocket may communicate with the mixing passage via the nozzle bore of the main nozzle as will be described with respect to FIGS. 6-9. The pocket may include a first bore 62, a second bore 63, and a valve seat 64 therebetween. The solenoid valve may include a ferrous plate 65 disposed at the valve seat within the first bore. The solenoid valve may also include a housing 66 that may have a cylindrical portion 67 with a diametrically relieved end 68 and a flange portion 69, which may be fastened to the body with one or more fasteners 70.

The flanged outer housing allows external shimming for controlling the air gap and an inner armature 72 that is pressed into this housing to enable flatness and squareness upon assembly of the armature and housing a fixture plate surface. This eliminates machine tolerance issues for the widths and depths of the armature and housing.

An O-ring 71 may be disposed between the pocket and the body to seal the valve to the body. The valve may also include a stationary armature 72 that may be bobbin shaped and may have an outboard end 73 or disc, a rod 74, and an inboard end 76 or disc adjacent the valve plate. The solenoid valve may additionally have a copper wire coil winding 77 disposed around the rod and winding leads 78 extending through the outboard disc. The coil may be provided around the metallic armature bobbin 72 to induce magnetic flux in the housing to attract the valve plate to complete the established flux path upon coil energization. The housing and armature bobbin may be machined from magnetized steel, and fixtures may be used to assemble the solenoid to ensure axial alignment of the stationary armature and housing, and to ensure the housing is in contact with the valve plate during coil energization and is coincident and coplanar with the inboard end of the armature.

Finally, a coiled compression spring 79 may circumscribe the rod and winding and may be disposed between the outboard disc and the valve plate to urge the valve plate to a normally closed position against the bottom of the pocket. The spring may be composed of stainless steel between 0.5 mm and 0.66 mm in diameter to provide desirable compression force on the valve plate. The spring constant in at least one implementation may be between 20 to 100 g/mm to overcome residual magnetism of the assembly, and to push the valve plate back onto the seat upon coil deenergization with minimal inertia delay or impulse rebound during valve closure.

The solenoid armature may be received with a slight press fit into the outer housing flange to seal any gap or crevice between them. Also, there may be a Delrin insulator block added to the armature for the coil windings which also helps to provide a seal. The seal need not be perfect because fuel in this chamber is not pressurized, and is in fact slightly subatmospheric since it is functioning on the air bleed circuit. Because fluid can build up behind the disk if there is no provision to allow for drainage of fuel, a small orifice or channel in the end of the outer housing (where the disk seats when energized) may be provided.

When the solenoid valve is energized, the valve plate 65 is magnetically attracted to the inboard disc 76 against the bias force of the spring 79 to open an air bleed path. Opening of this valve provides enleanment via reduction of the nozzle pressure differential established between the float bowl and manifold vacuum with a corresponding change in fuel quantity supplied through the main jet. As this valve is cycled, a change to the overall average A/F ratio is achieved (and this may occur during each air/fuel induction event if desired) to change engine combustion efficiency which may subsequently be detected by a corresponding change in the engine temperature.

Delrin plastic insulators may be used to support termination of the coil wires emanating from the bobbin armature, and Kapton insulation tape may be provided on all surfaces exposed to the winding. Geometry parameters of the valve design including, but not limited to, a housing flange, bore pocket, and disk diameter, may be arranged to ensure compatibility between anticipated calibrations for bleed air orifice diameter (and flow area per mm^2), the annular pocket flow area, and the perimeter band flow area upstream of the carburetor bore valve seat. An air gap between the valve plate and the housing surface may be controlled using one or more shims 80 on the outside of the housing flange, in contact with the carburetor body to achieve the desired spacing. Exemplary air gaps between about 0.2 mm and 0.35 mm have demonstrated adequate performance for magnetic attraction versus disk travel inertia during cycling in one implementation. Also in that implementation, a valve plate thickness between 0.1 mm and 0.25 mm may provide favorable response at a diameter of about 12 mm. These dimensions may achieve a relative low mass weight between 0.100 grams to 0.230 grams for the valve plate to support favorable inertia response at higher frequency excitations. Further in that implementation, coil resistance and wire turns may be below 3 ohms with at least 180 turns of wire or ranging up to 15 ohms with, for example, at least 500 turns or more of smaller diameter coil wire. Geometry constraints inside the housing bore in the noted implementation may limit the diametrical growth of the coil to, for example, no more than 8 mm and may limit coil turns for a given gauge size of wire, which may be about 0.2 mm to 0.3 mm in diameter at 29 ga to 32 ga.

Referring now to FIGS. 6-10, the air bleed path may include an inlet port 81 and passage 82 in communication with the air and fuel mixing passage 49. Referring to FIG. 5, the inlet passage communicates with the valve at a valve chamber, which may be defined axially between the valve O-ring 71 and the valve seat 64, and radially between the diametrically relieved portion of the body and the inner diameter of the pocket. When the valve is energized such that the valve plate is retracted, the air bleed path continues from the valve chamber to the second bore 63 and a downstream bore 83. From the downstream side of the valve, the air bleed path extends through a check valve 84 and a passage 85 into the nozzle bore 59.

Figure 11:
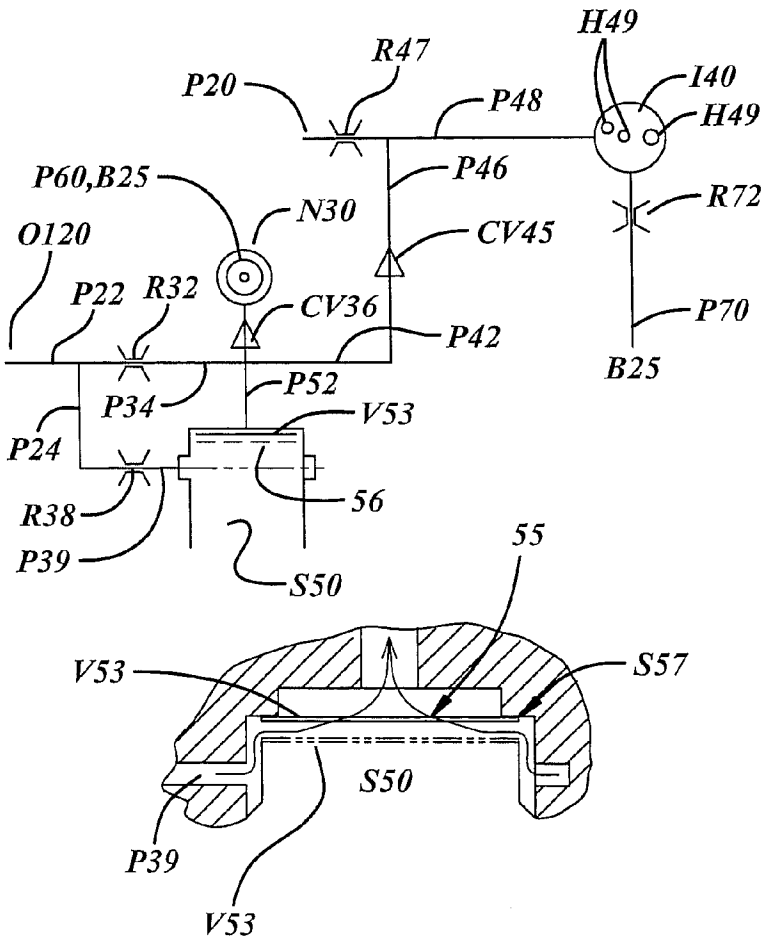
FIG. 11 is a schematic view of air and fuel passages of the carburetor of FIG. 3.
Figure 10:
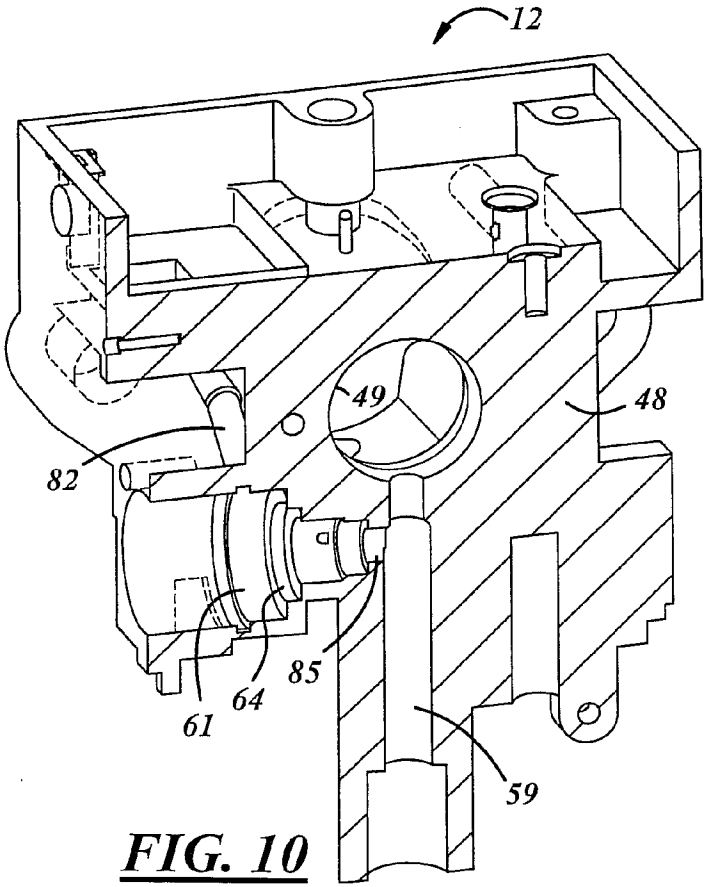
FIG. 10 is a semi-transparent, cross-sectional perspective view of a portion of the carburetor of FIG. 3, illustrating air and fuel passages.

Referring to FIG. 11, an exemplary air bleed schematic is illustrated. When the engine is at idle or light load: The carburetor throttle is at, or is very near, idle and fuel flows from a fuel bowl B25 thru a passage P70, a fuel restriction R72 and into an idle pocket I40 and out at least one small progression hole H49. A fuel flow quantity or rate may be determined by the size of the restriction R72 and the pressure differential across it. Vacuum generated by the engine and transmitted thru at least one of the holes H49 may be relieved by fuel flowing through the restriction R72 and air flowing through the other holes H49 that are not delivering fuel, by air flowing thru a restriction R47 exposed to approximately atmospheric pressure at opening P20, and by air flowing through opening O120, passage P22, restriction R32, passage P42, check valve CV45, passage P46, and passage P48. With a solenoid valve S50 in a closed (power off) mode there is no flow thru a passage P52 as a solenoid valve plate V53 is in a closed position against a seat S57. With the solenoid valve S50 closed, restrictions R32 and R47 control a majority of air bleed to an idle system. When the solenoid S50 is opened there is airflow thru restriction R38, and passages P24 and P39, around the valve plate V53 and thru passage P52 to increase total airflow to the idle pocket I40 thereby reducing a pressure differential across restriction R72 and fuel flow thru same. The quantity of fuel flow reduction may be determined by the size of restriction R38. Vacuum generated at idle may close check valve CV36 and prevent fuel from being drawn from a fuel nozzle N30 and into the idle system.

Engine at moderate or heavy load. With increasing air flow thru the carburetor, vacuum at the carburetor nozzle N30 will increase. This increased vacuum will draw fuel from the fuel bowl B25 thru a main fuel restriction (not shown) in the carburetor bowl B25 and thru nozzle passage P60. The quantity of fuel may be determined by the size of the restriction R72 and the pressure differential across it. The vacuum generated by a carburetor venturi (not shown) is reduced by the air bleed from opening O120 and restriction R32 thru passage P34 and check valve CV36. With the solenoid S50 closed there is no additional air bleed thru passage P24 and restriction R38. When the solenoid S50 is opened there is additional air flow thru passage P24 and restriction R38, around the valve plate V53, through passage P52 and check valve CV36 to reduce the flow thru the main fuel restriction R72 and the main fuel restriction (not shown). There will not be any air flow to the nozzle N30 thru P42 from the idle system due to check valve CV45.

Engine at partial throttle. There will be a position of the carburetor throttle where the vacuum on the idle pocket I40 is approximately equal to the vacuum on the nozzle N30. When this occurs there will be fuel flow thru both the idle system and the nozzle N30. Opening and closing the solenoid S50 will change the air bleed and fuel flow of both systems in the same manner described above.

Thus, it is shown that one solenoid valve S50 may control an air and fuel ratio at idle, wide open throttle, and everywhere in between.

Also, the air bleed path may facilitate an emulsion of fuel and air in the main nozzle just upstream of the carburetor mixing passage during sub-atmospheric pressure gradients such as during engine intake cycles. This emulsion of fuel and air may support increased atomization and turbulence for outflow of fuel exiting the main nozzle and entering the mixing passage, and may facilitate improved fuel flow delivery in response to the level of fuel contained in the float bowl, which is referenced to atmospheric pressure and the resulting height of fuel residing in the nozzle in relation to the pressure differential in the carburetor mixing passage. Those of ordinary skill in the art will recognize that these fuel and air delivery paths can also be provided with various trim jets, air bleed orifices in nozzles, and mixture needles to assist in optimization of fuel delivery at low speeds (idle conditions) and high speeds (engine load and higher RPM conditions).

The solenoid valve may be applied to a high speed circuit for air bleed management effects to influence air and fuel delivery to the engine at a particular operating condition. However, the carburetor may be calibrated more lean at high speed conditions and such that the valve can be applied to a low speed circuit, such as for engine applications that may have a higher emission weighting factor at low speeds. In other words, although the engine may be configured by default for high speed air and fuel optimization by way of the carburetor solenoid valve applied to the nozzle air bleed circuit, it is also possible to calibrate the engine according to an overall lean high speed circuit with the carburetor solenoid valve modulated at idle and low to mid range speeds for improved engine efficiency at other than high speed and loading conditions Other provisions could be included for overtemperature protection at lean high speed conditions, or for richer warmup conditions and related temperature compensation issues. This type of configuration may support applications where measured exhaust emission compliance is weighted more heavily at low speed conditions. Also, the carburetor and further refinement of the integral actuator valve may allow air/fuel calibrations over a wide range of control and engine operating conditions (low speed idle through high speed and load conditions), especially in combination with scheduled ignition timing curves (digital Power Generator Unit and control module) supporting the feedback performance maps. In other words, it may be favorable to have one or more of the valves controlling air bleed at both slow and high speed conditions, provided that sufficient bleed air authority is available to support desired air and fuel delivery under a variety of engine operating conditions.

Other configurations may be used for discrete management of fuel flow in lieu of the current approach for air bleed authority. For example, the valve could be placed in direct communication with a lower portion of the nozzle or with fuel passage feeds into mixture circuits for more precise and discrete interruption or control of fuel flow.

Figure 12:
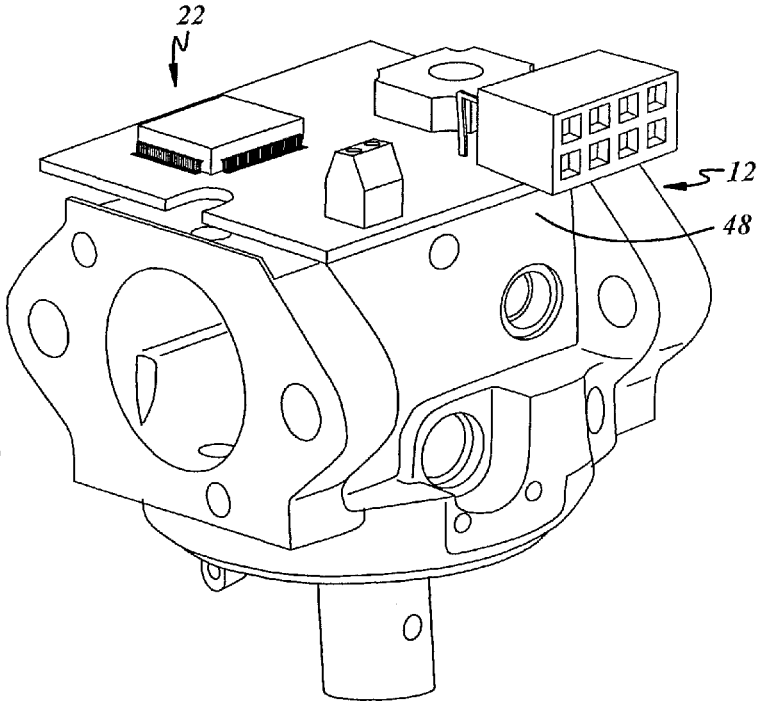
FIG. 12 is a perspective view of a portion of the carburetor of FIG. 3, illustrating a control module carried on a body of the carburetor.
Figure 13:
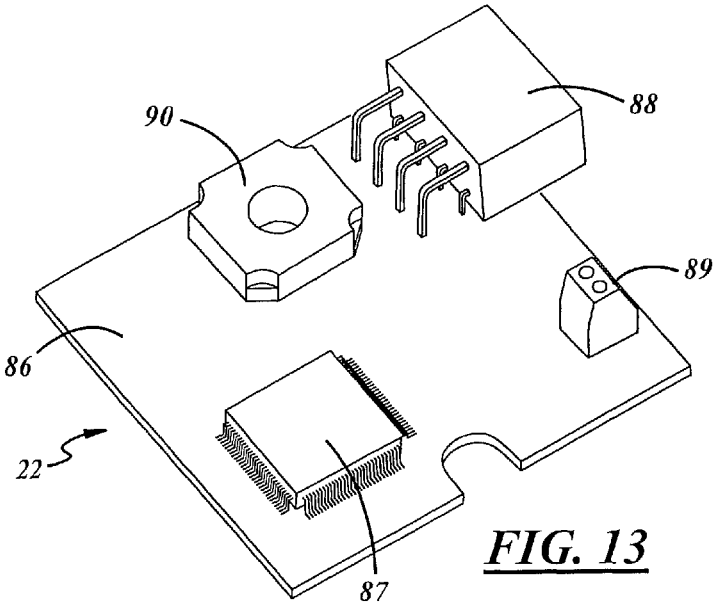
FIG. 13 is a perspective view of the control module of FIG. 12.
Figure 14:
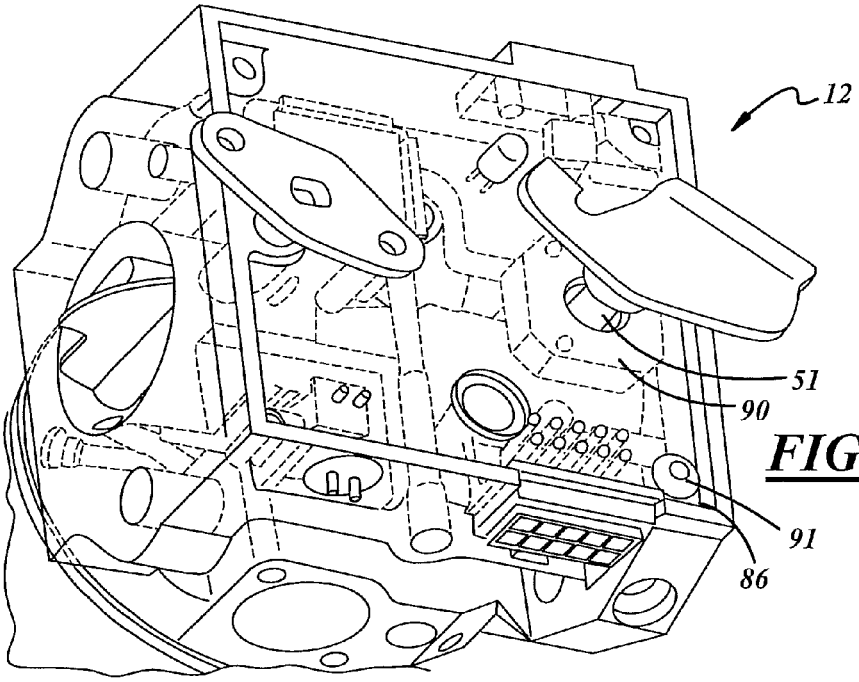
FIG. 14 is a semi-transparent, top perspective view of the carburetor of FIG. 3, illustrating a relationship between a control module and valve shafts.
Figure 15:
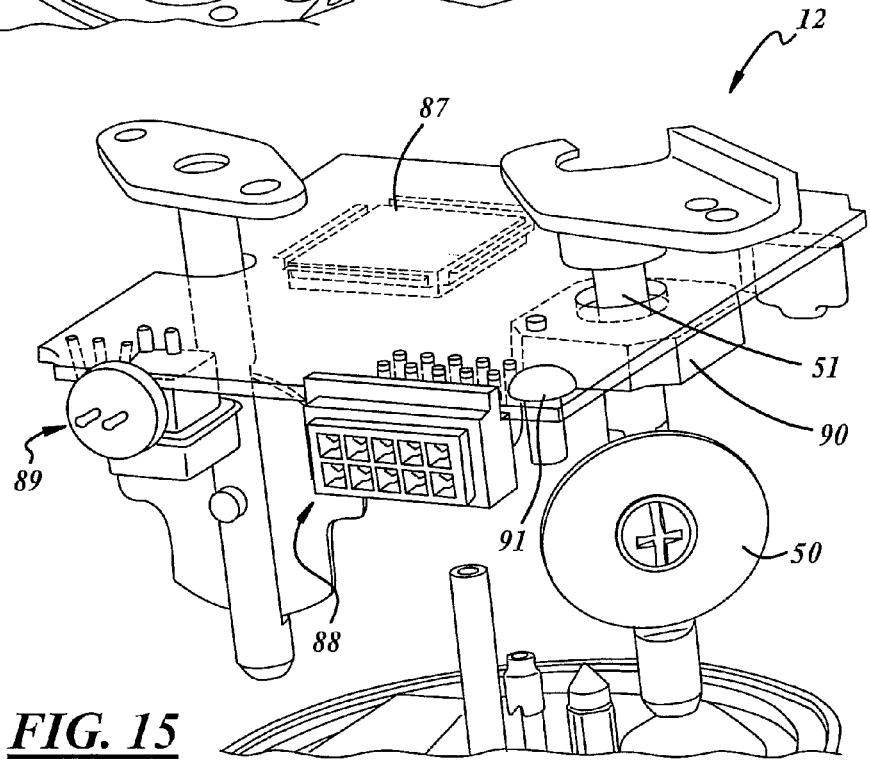
FIG. 15 is a semi-transparent, exploded perspective view of the carburetor of FIG. 3, further illustrating the relationship between a control module and valve shafts.

Referring now to FIG. 12, the body 48 of the carburetor 12 may carry the control module 22. Referring to FIG. 13, the control module 22 may include a circuit board 86, one or more controllers or processors 87, a main connector 88, a thermocouple connector 89, and a rotary position sensor 90. Referring to FIGS. 14 and 15, a preferable mounting configuration for this control module is recessed into a top portion of the float carburetor for collocation of the position sensor 90 with the carburetor throttle shaft 51. The throttle shaft may extend through an opening, cutout, slot or the like in circuit board 86 and suitably engage the rotary position sensor 90 to avoid external mounting or additional wires for the throttle position sensor. The control module 22 may be encapsulated with a resin or other material in order to hermetically seal and protect the module from environmental contaminants. In such a case, it may be advantageous to use a rotary position sensor that is of the non-contact type, such as the one described here.

Figure 35:
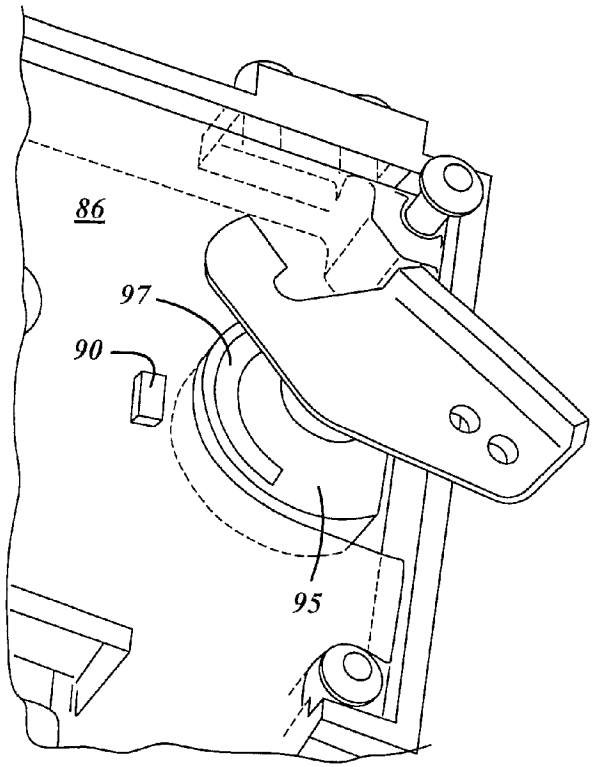
FIG. 35 is an enlarged, fragmentary view of a portion of the carburetor of FIG. 34.
Figure 34:
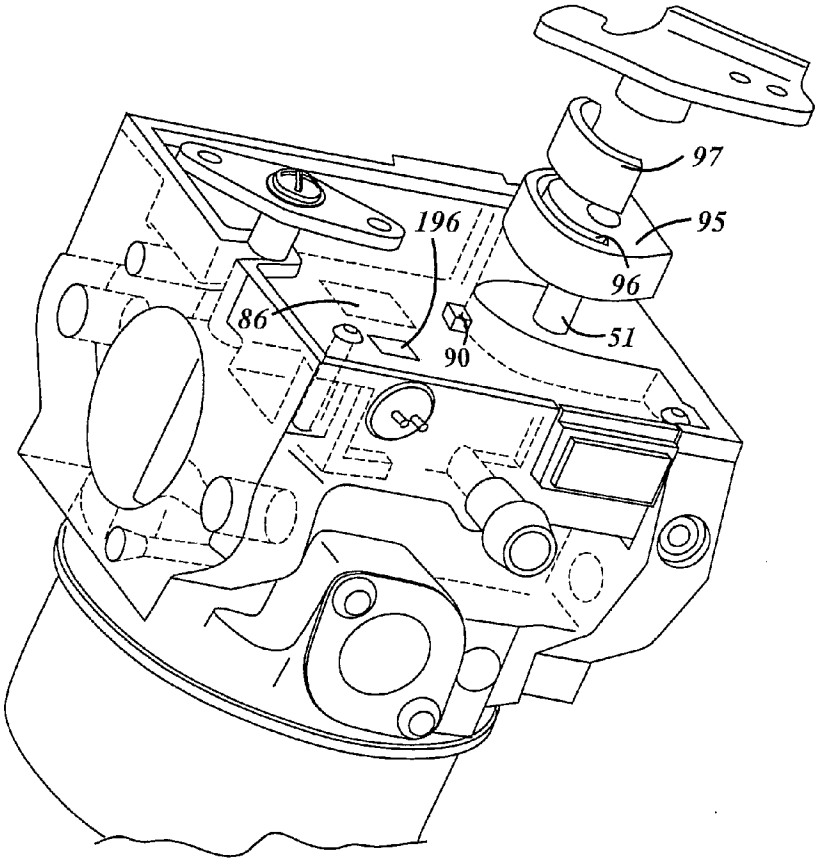
FIG. 34 is an enlarged, fragmentary and partially exploded view of an exemplary carburetor.

In an exemplary embodiment shown in FIGS. 34 and 35, rotary position sensor 90 is a magnetoresistive (MR) sensor that determines the angular position of throttle valve 50 by sensing the direction of a magnetic field that changes according to the position of the throttle valve. A rotor component 95 is fixed to throttle shaft 51 and includes an arcuate pocket 96 for retaining arcuate magnet 97. The shaft, rotor and magnet can corotate together. Rotor component 95, according to the exemplary embodiment shown here, is a partially disk-shaped component that is made from a non-magnetic material, such as plastic. Rotor component 95 can be keyed to throttle shaft 51 or attached in some other way that enables the two components to rotate together. Pocket 96 is located towards an outer circumference of rotor component 95 and is sized and shaped to securely receive the arcuate-shaped magnet 97. Magnet 97 produces a magnetic field having a direction and/or intensity, as sensed by rotary position sensor 90, that varies according to the position of throttle valve 50. In one embodiment, magnet 97 is made of a permanent magnetic material and includes a partial annular section of a standard ring magnet where the annular section is concentric with throttle shaft 51. The annular section may instead be extended up to 360° of rotation, thus achieving a whole ring magnet, for example.

Rotary position sensor 90 is mounted to circuit board 86 so that it can magnetically interact with magnet 97 and provide control module 22 with a corresponding throttle position signal. In this particular embodiment, rotary position sensor 90 is mounted to circuit board 86 such that the sensor surface is generally parallel to the rotating magnetic field, and the sensor is neither coaxial with the axis of throttle shaft 51 nor is it coplanar with magnet 97. Put differently, rotary position sensor 90 can be mounted off to the side of throttle shaft 51 and at a position that is underneath rotor component 95. Depending on the particular application, it may be desirable to mount rotary position sensor 90 at a position on circuit board 86 that is as close to the axis of throttle shaft 51 as possible; this includes mounting sensor 90 at a position that is radially inboard of magnet 97, with respect to the axis of throttle shaft 51. Rotary position sensor 90 may be constructed so that it completely surrounds the throttle shaft opening in circuit board 86 (see example in FIG. 13), or it can simply be placed off to the side of the throttle shaft opening (see example in FIG. 35).

Figure 36:
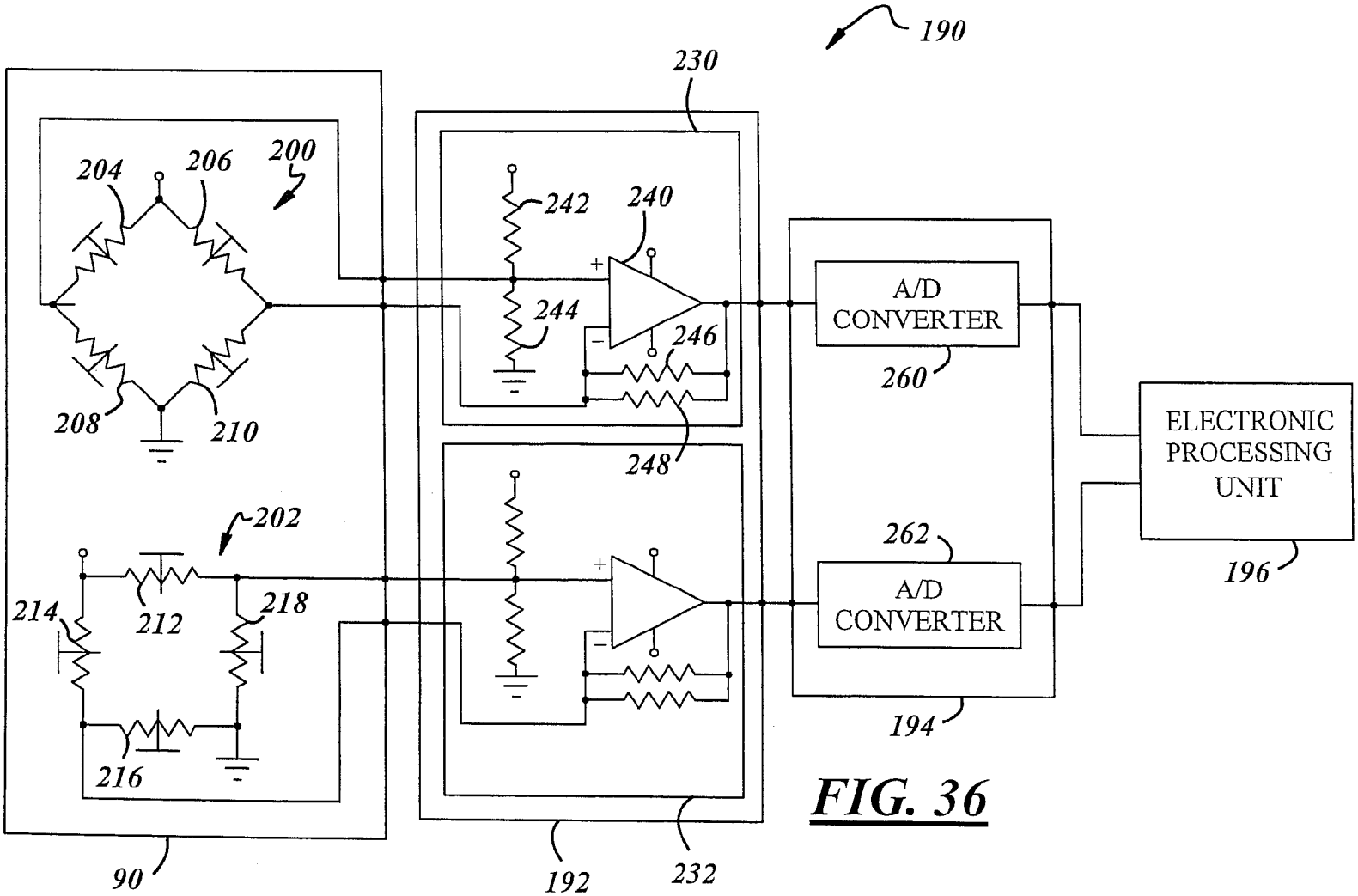
FIG. 36 is a schematic diagram of an exemplary sensor processing circuit.

Turning to FIG. 36, there is shown a schematic view of an exemplary sensor processing circuit 190 that includes rotary position sensor 90, an amplification circuit 192, a digitalization circuit 194, and an electronic processing unit 196. Of course, this is only an example of a circuit that could be used rotary position sensor 90, as numerous other circuits having a different combination of circuit components could be used instead.

The exemplary rotary position sensor includes a pair of resistive bridges 200, 202 (e.g., Wheatstone bridges) integrated onto one chip or substrate, where each of the bridges has four separate MR elements 204-218. The two resistive bridges are angularly offset from one another by 45°—a so-called 'dual bridge' configuration—and respectively provide sin and cos signals that correspond to the rotating magnetic field. Use of a dual bridge configuration causes the output of sensor processing circuit 190 to be ratiometric; thus, any errors caused by fluctuations in the power supply, ground reference, temperature drift, etc. generally affects all of the resistive elements 204-218 the same. This can have the effect of canceling out, or least mitigating, the resulting error. Each of the MR elements 204-218 can be made from a ferromagnetic alloy, such as permalloy, that exhibits an anisotropic magnetoresistance (AMR) effect. The total output resistance of each resistive bridge 200, 202 may range from 2 kΩ-5 kΩ, for example.

Amplification circuit 192 amplifies the signals provided by rotary position sensor 90 so that they can be properly analyzed and evaluated by electronic processing unit 196. In this particular embodiment, amplification circuit 192 is a dual-channel circuit that includes a pair of amplifiers 230, 232. Amplifier 230 is electronically coupled to resistive bridge 200 and may include a single operational amplifier 240 and four separate resistors 242-248. Depending on the particular application, it may not be important that amplifier 230 have a precise gain, so long as its gain is the same as that of amplifier 232; again, a result of the system being ratiometric. In some applications, a dual power supply (both positive and negative voltage) may not be available for amplifying both positive and negative sensor outputs. Thus, amplifier 230 provides an 'offset' so that the sensor output is always positive and can be amplified with only a positive power supply. As an example where the positive power supply is 5 v, an offset of Vcc/2 could be used so that negative sensor output values are offset to a value between 0-2.5 v and positive sensor output values are offset to a value between 2.5-5 v. This is, of course, only an example, as other offset values and techniques could be used.

Resistors 242-248 provide the amplification circuit 192 with several advantages. Resistors 242-248 are arranged so that amplifier 230 generates a voltage output that reflects slight variations in the resistance of bridge circuit 200, yet does so without having to provide a very high input impedance to operational amplifier 240 (e.g., an input impedance that is many times higher than the impedance of bridge circuit 200). In order to provide the voltage offset discussed above (i.e., Vcc/2), R(242)=R(244)=R(246)=R(248); where R(242) is the resistance of resistor 242, R(244) is the resistance of resistor 244, and so on. In this case, amplifier 230 would exhibit a gain of (R(246||248)/R(bridge)), where R(246||248) is the resistance of the parallel connection of resistors 246 and 218, and R(bridge) is the variable resistance of resistive bridge 200, which according to the example above varies from between 2 kΩ-5 kΩ. In order to achieve a gain of 50 where R(bridge) is 2 kΩ, for instance, an R(246||248) value of 100 kΩ would be needed. This ohmic value is still small enough that it would not likely introduce a significant amount of noise and/or parasitic capacitance into the amplifier, as could be the case when large resistors (e.g., one or more mega-ohms) are placed in the series with the inputs of the operational amplifier.

The arrangement of amplification circuit 192 allows for the use of less expensive components without sacrificing sensor accuracy. As skilled artisans will appreciate, having a low input impedance into an amplifier usually reduces the overall gain of the circuit with a negative impact. In this embodiment, however, the proper gain is achieved without having a low input impedance, and thus a circuit characteristics degradation for both circuits 230 and 232. The exemplary amplification circuit 190 can accurately function even though the feedback resistance of amplification circuit 192 is not many times greater than that of rotary position sensor 90. Also, it is possible to combine resistors 246 and 248 into a single equivalent resistor, however, the use of two resistors in parallel enables a single resistive component to be used for all four resistors 242-248. Put differently, only a single resistor needs to be purchased and, assuming that all four resistors came from the same manufacturing lot, they have a higher likelihood of exhibiting the same resistance. Another low-cost possibility is a four-resistor ladder, where the absolute precision is not necessarily that high, but the resistor-to-resistor variation is usually very tight. It should be appreciated that the above-provided description of amplifier 230 also applies to amplifier 232, and that a duplicate description has been omitted.

Digitization circuit 194 includes analog-to-digital converters 260, 262 that respectively convert the analog output of amplifiers 230, 232 into a digital form. Analog-to-digital converters 260, 262 could be could be a single converter with an input analog multiplexer, could be two converters integrated on a single chip or substrate, or they could be two separate electronic components packaged separately, to name a few possibilities. Of course, any number of other suitable circuit components, such as filtering, buffering, processing devices, etc. could also be used. The analog-to-digital converters 260, 262 may have a voltage reference proportional to the voltage applied to resistive bridges 200 and 202, in order to provide a true ratiometric response.

Electronic processing unit 196 is coupled to digitization circuit 194 and compares the output from the two resistive bridges 200, 202 in order to determine the position of throttle valve 50. In one embodiment, electronic processing unit 196 is mounted to circuit board 86 and is shared by the other components of the control module. The output from bridge 200 is a sin function and the output from bridge 202 is a cos function, thus, electronic processing unit 196 may use an arctan calculation to correlate the two outputs. Other signal processing steps, methods, techniques, etc. that are known in the art could be used as well. It should be appreciated that electronic processing unit 196 could include any suitable combination of microprocessors, microcontrollers, application specific integrated circuits (ASICs) and/or other circuit components capable of executing electronic instructions.

In operation, rotation of throttle valve 50 causes a corresponding rotation of throttle shaft 51, rotor component 95, and magnet 97. As magnet 97 rotates with throttle shaft 51, so too does the direction of the resulting magnetic field which affects the resistance of the various MR elements 204-218 in the two resistive bridges 200, 202. By using a dual-bridge configuration, the throttle position output from rotary position sensor 90 is both differential and ratiometric. In this particular embodiment, the two bridges are 45° offset from each other and thus produce output signals that are 90° phase shifted from each other. These sin and cos signals are provided to amplifiers 230, 232, respectively, where the signals are offset and amplified, as described above. The offset and amplified output from amplification circuit 192 is then provided to digitization circuit 194, where it is converted from an analog format to a digital one. Lastly, the digital output is sent to electronic processing unit 196, which uses the information to determine an arctan value that is representative of the angular position of the throttle valve 50, as is appreciated by those skilled in the art.

Because the sensor processing circuit 190 is a ratiometric dual-channel circuit, fluxuations in the supply voltage, ground reference, temperature, response of the components, etc. are assumed to affect each channel equally and therefore largely cancel themselves out. Furthermore, MR sensors react to changes in magnetic field direction, not intensity. Thus, wear-and-tear, manufacturing limitations (e.g., variations in the axial position of magnet 97 on throttle shaft 51), and other factors that can impact the intensity of the magnetic field, as sensed by the sensor, do not necessarily affect the readings of exemplary rotary position sensor 90.

It should be appreciated that the systems, circuits, components and methods described above are only exemplary in nature and that one of a number of different alternatives could be used. For instance, any combination of the following components could be used: magnetic flux or field influencing components, additional magnets including bias magnets, Hall effect sensors, contact-type sensors, optical sensors, multiple magnets, magnets other than arcuate shaped magnets, a single-bridge sensor having only one resistive bridge, temperature compensation means, low profile rotary sensors such as PIHER sensors, etc. These are, of course, only some of the possibilities.

Figure 16:
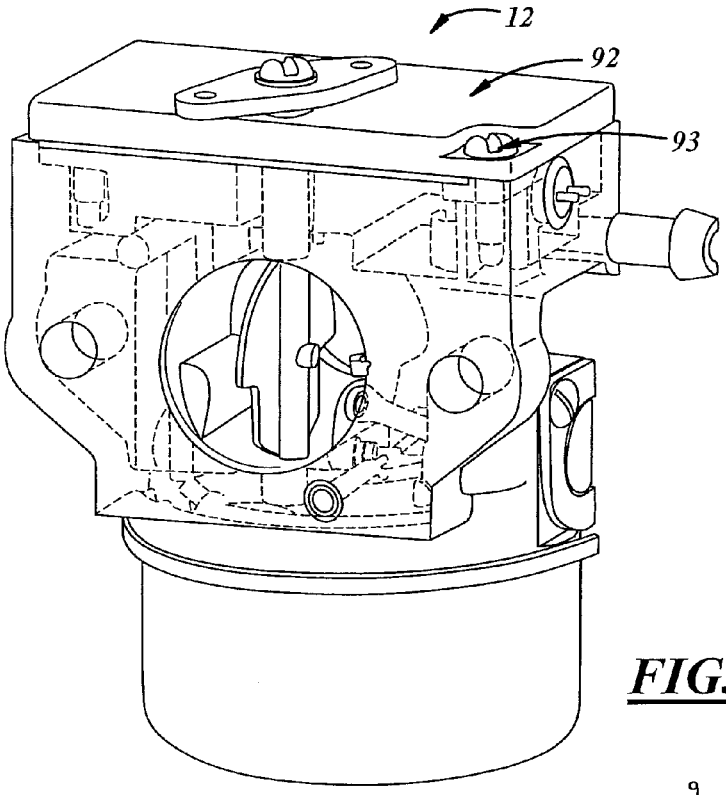
FIG. 16 is a fragmentary semi-transparent perspective view of the carburetor of FIG. 3 illustrating a control module cover.

As shown in FIGS. 4 and 16, the carburetor may also carry a cover 92 placed over the control module. The cover may be fastened to a corresponding portion of the carburetor body with one or more fasteners 93 or interlocking snaps that may be disposed at opposite corners.

Other forms of non-contact rotary position sensors instead may be used. For example, a metallic paddle (not shown) may be attached to the throttle shaft in close proximity to sets of spiral curves (not shown) etched into the surface of the circuit board. The curves may be excited by a carrier or demodulated waveform and, as the paddle scans the circular matrix, the control module could detect the difference in waveforms signal between the two curve sets as the paddle scans proportional to the commanded throttle position, thereby providing an indication of engine load without typical noise or step signal constraints imposed by more costly and conventional electromechanical or electro-resistive rotary position sensing devices.

Carburetor design provisions may also accommodate installation of the carburetor solenoid valve underneath the printed circuit board, biased towards the front of the carburetor for access to the nozzle air bleed circuit, to eliminate external wires connecting to the solenoid.

The control module, although conveniently packaged on the top of the float carburetor, may also be externally mounted or distantly located at the expense of wire harness extensions and placement on the engine/vehicle. In certain engine applications where additional space is available, the control module may be contained as part of the PGU. Additionally, either the control module, Power Generator Unit, or an integrated assembly of both units can have additional provisions for an ambient temperature or inlet air temperature sensor or other related engine sensors for a more precise scheduling of the air and fuel mixture.

Method

The below-described method, or portions thereof, may be performed with a computer program and the various engine parameters may be stored in memory as models, such as maps, look-up tables, or the like. The computer program may exist as software program(s) comprised of program instructions in source code, object code, executable code or other formats; firmware program(s); or hardware description language (HDL) files. Any of the above can be embodied on a computer usable medium.

In one implementation, a method of operating an engine, includes:

(a) determining a peak power condition for the engine;

(b) measuring a temperature associated with the engine at the peak power condition determined in step (a);

(c) comparing the temperature measured in step (b) with a previously determined temperature associated with a known peak power condition of the engine;

(d) determining an offset value based on the comparison made in step (c);

(e) controlling at least one of fuel delivery to the engine or ignition spark timing based on said offset value.

In one implementation, the temperature measured is the exhaust gas temperature.

In general terms, the initial air-fuel ratio for the engine operation is set to be somewhat richer than a stoichiometric or otherwise known or determined air-fuel ratio corresponding to peak power output for the particular engine with which the method is being used. This enriched air fuel mixture setting may take into account all ambient conditions including air temperature, humidity, engine temperature, atmospheric pressure and the like, to ensure that the air fuel mixture delivered to the engine is richer than the air fuel ratio for peak power output or other peak power condition of the engine. Thereafter, the air fuel mixture is leaned out in one or more increments to bring the engine part of the way or all of the way toward its peak power condition. When the engine reaches its peak power condition, the exhaust gas temperature is measured and that measured temperature is compared to a calibrated or otherwise known exhaust gas temperature associated with peak power output of the engine to determine a difference in the exhaust gas temperature between the actual instantaneous peak power condition of that engine and the expected calibrated exhaust gas temperature at the peak power condition. The difference between the actual exhaust gas temperature and the calibrated exhaust gas temperature may be used as an offset value to control the fuel delivery to the engine, spark timing of the engine, or some other engine controllable factor over a wide range of operating conditions as a function of the difference between the actual measured peak power condition and the calibrated peak power condition.

In this manner, the instantaneous operation of the engine is adjusted and controlled to compensate for a wide range of variables to provide a desired engine performance based on the various factors affecting engine performance at that time. Such various factors may include compensation for a clogged air filter, differences in ambient temperature, humidity, pressure and the like, as well as differences in type or grade of fuel and inefficiencies such as may be caused as by wear of various engine components and the like. Desirably, and at least in certain implementations, the method may reduce exhaust emissions, improve fuel economy, improve engine stability, improve performance of a vehicle, tool or implement power by the engine, reduce wear on the components and the engine by providing a desired air fuel ratio in use as opposed to an overly rich or overly lean fuel mixture, and these effects can be achieved at idle, wide open throttle and at all engines speeds and loads therebetween.

As the air-fuel mixture is enleaned from a relatively rich mixture, the engine speed will increase up to a peak power point, thereafter, further enleanment of the air-fuel mixture will result in a decrease in engine speed. Based on this, in one implementation, the peak power output of the engine can be determined as a function of engine speed. Instead of monitoring engine speed, engine torque could be monitored (e.g. with a torque sensor), or, engine exhaust gas temperature could be monitored based upon certain characteristic changes in the exhaust gas temperature that may be observed upon enleanment of the air fuel mixture.

In at least one implementation, the starting relatively rich air fuel mixture may be enleaned in several increments. These increments may be uniform or they may be variable (e.g. not of the same magnitude). When variable, the increments may be adjusted as a function of the magnitude of the speed change detected from the prior enleanment increment. Subsequent air fuel mixture enleanments could be made proportional to or, as a function of, the magnitude of the speed change sensed in the prior enleanment to reduce the number of enleanments that may be needed to determine the peak power setting or condition for the engine. The results from each enleanment could be done in a single test or could be done in several tests and averaged or otherwise filtered or manipulated, if desired. Further, engine stability and other factors like engine load can be monitored to ensure that the change in engine speed may be attributed to the change in the air-fuel mixture and not to other factors such as a change in engine load. Further, between enleanment steps, the air fuel ratio may be returned to its original, relatively rich starting mixture and the speed of the engine determined at the relatively rich starting mixture to determine if the engine responds to this starting mixture as it did prior to the enleanment tests.

If the engine operation has changed, which may be indicated by a speed change, then this difference can be compensated for in further tests, or the initial test data can be ignored and new tests initiated. Based on the sensed speed change from a prior enleanment test, the magnitude of a subsequent air-fuel mixture enleanment may be determined based upon a look up table or a multiplier calculated as a function of the sensed speed change.

When the peak power condition is determined and the offset value is likewise determined, the offset value may be utilized to operate the engine in any desired condition over the wide range of its operation between idle and wide open throttle. In other words, the offset value may be used to provide engine operation at or near peak power throughout the full range of engine operation (e.g. speeds and loads), or the offset value may be used differently at different engine operation conditions. For example, the engine may be operated with a relatively lean air-fuel mixture at idle to reduce low speed and low load exhaust emissions, and the engine may be run more rich, or with some other air fuel ratio relative to a stoichiometric air fuel ratio at different engine speeds/loads to control exhaust gas temperature, facilitate engine acceleration, or for any other reason. In this manner, while the peak power condition may be determined with the noted method, the engine may not be run at its peak power condition at all, or it may be run at its peak power condition over only a certain band or range of the engine operation.

In a speed governed engine, the enleanment step and engine speed change determinations must be made within the number of revolutions before the engine governor is enabled and thereby affects engine speed. In at least some applications, mechanical governors may be enabled or affective after about forty revolutions of the engine crankshaft and so the enleanment and engine speed determinations must be made within forty revolutions or less.

Figure 17A:
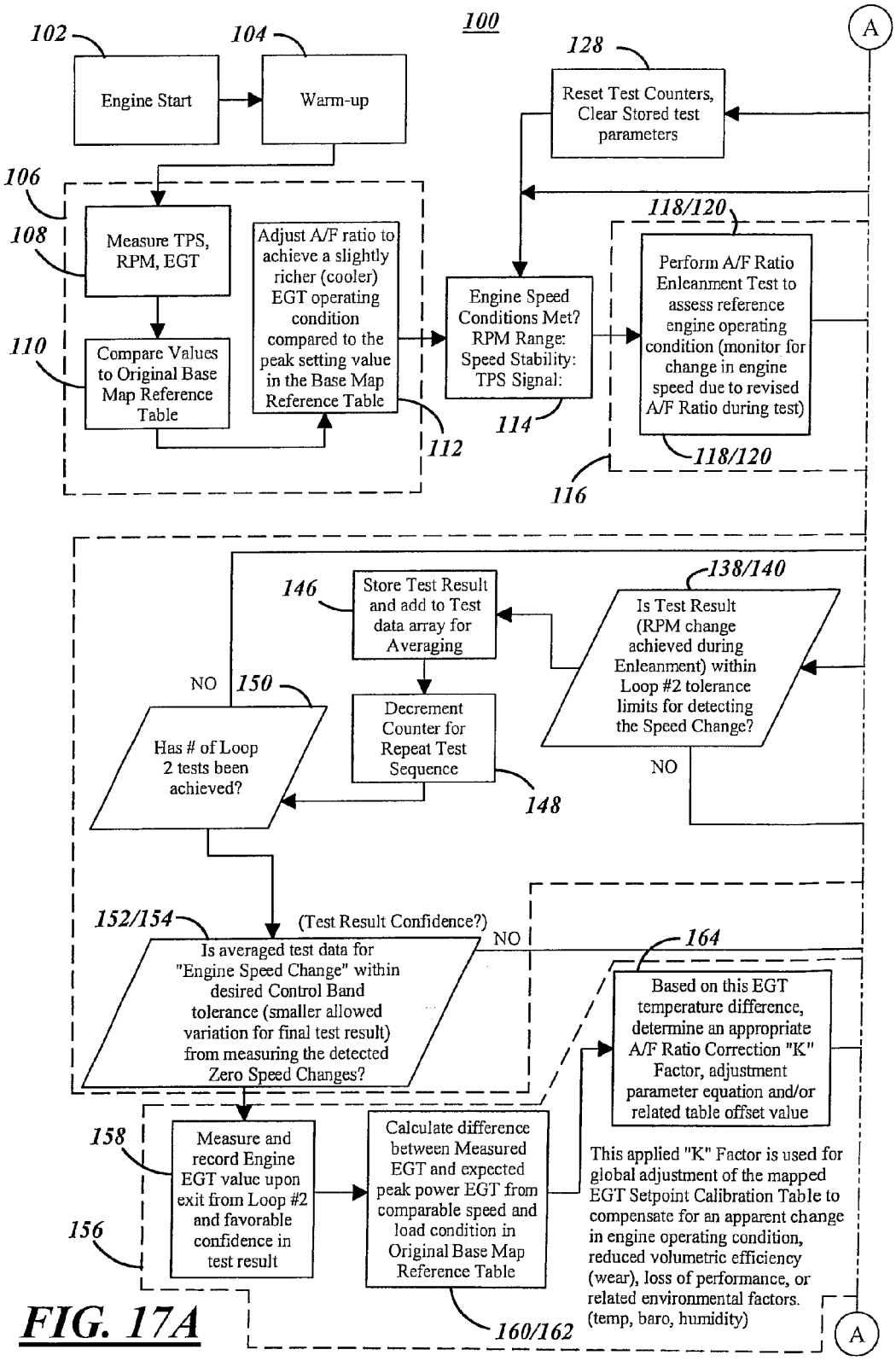
FIGS. 17 (A and B) are flow charts of an exemplary method of operating an engine.
Figure 17B:
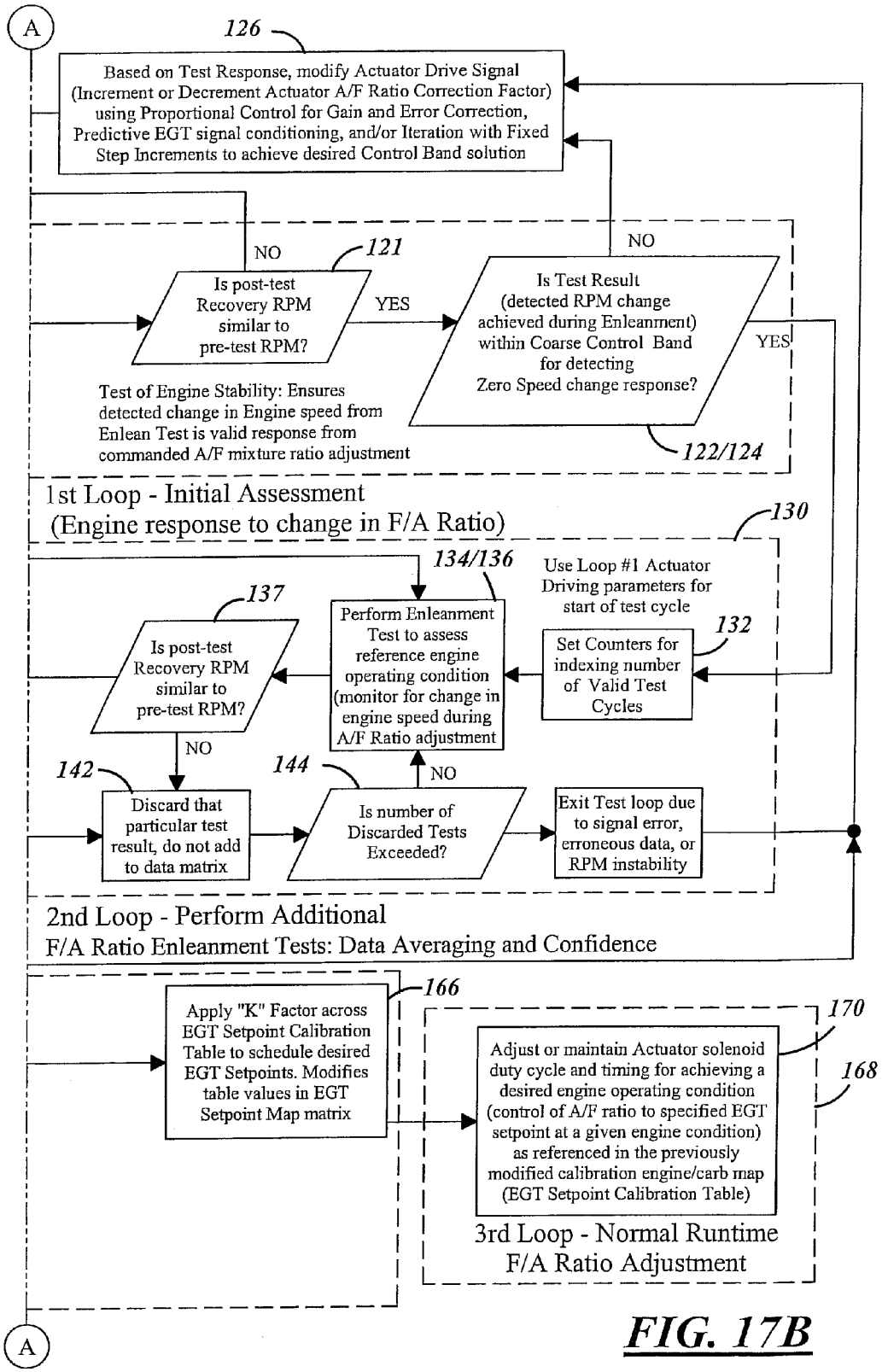

Referring now to FIG. 17, one presently preferred method 100 of controlling an engine responsive to model-corrected engine temperature, such as exhaust gas temperature, is shown. The method 100 may be provided to optimize engine power and/or run quality, minimize exhaust emissions, or the like. The method 100 generally may include a cranking routine 102, a warm-up routine 104, an initial engine temperature setting routine 106, an engine stability routine 114, one or more enleanment routines such as a coarse enleanment routine 116 and/or a fine enleanment routine 130, an engine temperature correction routine 156, and/or a normal operation routine 168. Although the specific method routines and steps disclosed below are generally described in reference to air and/or fuel control, the method may also include engine ignition control. For example, in addition to the specific steps described below, the method may include operational steps disclosed in the incorporated U.S. Pat. No. 7,000,595.

The cranking routine 102 may include engine ignition and/or combustible charge control to get the engine started from a cold or otherwise stopped state and may occur, for example, over any suitable timeframe or number of engine cycles such as one to ten engine cycles. During the cranking routine 102, ignition control may be carried out by the PGU until sufficient power can be supplied to the control module.

The warmup routine 104 may also include engine ignition and/or combustible charge control to ensure that the engine keeps running just after engine startup, and warmup may occur over a suitable time frame or number of cycles or crankshaft revolutions, and/or until the engine reaches a suitable temperature.

The initial engine temperature setting routine 106 may be carried out after the warmup routine and may be provided to facilitate convergence of downstream enleanment tests. This step may be performed to preset the A/F ratio richer than a reference peak power condition to ensure the subsequent enleanment test(s) induces a favorable speed change from an initial richer to a leaner condition.

At step 108, engine speed, load, and/or temperature may be determined in any suitable manner. For example, actual engine speed, engine load, and/or engine temperature may be directly determined or measured with suitable sensors such as the engine temperature sensor, indirectly determined or calculated as a function of time (such as the crankshaft position sensor) or as a function of position (such as the throttle position sensor). Engine speed, load, and/or temperature may be determined and/or stored continuously or intermittently throughout engine operation.

At step 110, the determined engine speed, load, and/or temperature may be compared to a model including model engine speeds, loads, and engine temperatures. According to one example, the model may be a model or reference model, such as an engine peak power model that may be populated with model engine speeds, loads, and engine temperatures according to A/F ratios that constitute peak power generated by the engine between and including the engine's minimum and maximum speed, engine load, and engine temperature quantities. Other models also or instead may be used. In one example, other speed-based non-zero change detection methods indicative of A/F ratio may be used. In another example, one or more of peak efficiency, peak torque, or other suitable types of models may be used. In any case, the model may include, for example, an empirical model developed from testing of an engine.

As used herein, a model may include any construct that represents something using variables, such as one or more multi-dimensional lookup tables, maps, algorithms, formulas or equations, and/or the like. Those of ordinary skill in the art will recognize that models typically are application specific and particular to the design and performance specifications of any given engine design.

At step 112, at least one engine parameter may be adjusted to obtain an actual engine temperature lower than the model engine temperature that corresponds to the engine speed and load determined in step 110. For example, the A/F ratio may be adjusted to obtain an actual engine temperature within a predetermined quantity lower than the model engine temperature. More specifically, the air bleed solenoid valve may be controlled to obtain an actual engine temperature within, for example, 5 to 500 degrees F. lower than the model engine temperature. Those of ordinary skill in the art will recognize that exhaust gas temperature is lower on each side of a stoichiometric condition, whether to the rich or lean side; the rich side being cooler primarily due to excessive amount of carbon combining with oxides during combustion to form carbon monoxide rather than carbon dioxide, and the lean side being cooler due to the excess dilution of the combustion gas from excess and unused oxygen and nitrogen. Therefore, presenting the A/F mixture richer prior to an enleanment event ensures the resulting shift in engine speed occurs from the left of stoichiometric to more easily detect the resulting change in engine parameters.

The engine stability routine 114 may be provided to ensure that the engine is operating in a stable manner before proceeding to downstream enleanment tests, which will not be useful unless operation of the engine is stable. First, at least one engine stability parameter may be determined. For example, at least one of engine speed, acceleration, or load may be determined in any suitable fashion. Second, the determined at least one engine stability parameter may be compared to at least one engine stability criterion. For example, engine stability criteria may include acceptable quantities or ranges of engine speed, acceleration/deceleration, and/or load. More specifically, an exemplary acceptable range of engine speed stability for a four-cycle engine may occur between about 1,200 to 5,000 RPM, an exemplary acceptable range of engine acceleration/deceleration may be between 0 and 200 RPM over 5 to 10 consecutive engine cycles, and an exemplary acceptable range of engine load may be represented by 0 to 5 degrees of angular throttle position. This determination may be made, for example, to ensure that the control module is fully powered and that ignition control has been handed off to the control module from the power generator unit after engine start up, and to monitor that there has been no sudden application of engine load change that may skew the enleanment test results. If the determined at least one engine stability parameter meets the at least one engine stability criterion, then the method may proceed to an enleanment step such as the coarse enleanment routine 116. Otherwise, the method may loop back anywhere upstream of the stability routine 114. The engine stability parameter and/or other current engine parameter data may be stored in memory before proceeding to routine 116. For example, engine speed at an exemplary 2,500 RPM may be stored.

The coarse enleanment routine(s) 116 and the further fine enleanment routine(s) 130 may be provided to determine a speed change or other parameter change upon enleanment to establish and verify that the engine is operating in accord with approximately peak power parameters as a reference for subsequently making corrections to the exhaust gas temperatures of a model for use of corrected gas temperature for control of normal operation of the engine.

At step 118, at least one engine parameter may be determined and used to assess the effects of enleanment on engine performance. For example, engine speed may be determined in any suitable manner. In addition, or alternatively, engine temperature such as exhaust gas temperature and/or fluctuations in exhaust gas temperature may be determined in any suitable manner. The determined at least one engine parameter may be referred to below as, simply, the engine parameter.

At step 120, the combustible charge may be enleaned from a pre-enleanment enleanment quantity to a default enleanment quantity if this is a first pass through this step, or a modified enleanment quantity, until a change in the engine parameter is less than a first or coarse predetermined quantity. As used herein, the term quantity includes a single value, multiple values, and/or a range of values. Also, the terminology enleanment quantity may include any parameters used in enleanment of a combustible charge of air and fuel, for example, an air bleed solenoid valve drive signal. Typically, it takes a series of engine cycles to eventually stabilize at a particular engine speed upon the implementation of an enleanment or A/F change (actuator drive signal)—the number of cycles is contingent on the A/F ratio being used, the engine load and inertia fluctuation during the duration of the test, and the subsequent data being measured and recorded.

In one example, the air bleed solenoid valve may be adjusted to be open over a wider range of the engine cycle such as from a pre-enleanment quantity of about 70 degrees of crankshaft rotation (CR) to a default coarse enleanment quantity of about 160 degrees CR. According to one example, when the engine parameter no longer changes significantly as a result of the applied enleanment test (for example at a particular actuator driving signal), then the coarse enleanment at step 120 may be terminated and the at least one engine parameter observed during enleanment stored in memory. The coarse enleanment may be terminated such that the combustion charge may be returned to its state or quantity just prior to the enleanment test, and an engine recovery period may be provided over a predetermined quantity of cycles, for example, 50 to 100 cycles. For example, the air bleed solenoid valve may be adjusted to be open over its pre-enleanment 70 degree value. Thereafter, the method may proceed to step 121.

At step 121, an engine parameter quantity after coarse enleanment and recovery may be compared to an engine parameter quantity just before coarse enleanment, and a determination made whether the post-coarse-enleanment and recovery quantity is similar to or within a predetermined quantity of the pre-coarse-enleanment quantity. This may ensure that a detected change in the engine parameter from the enleanment test is a valid response from the enleanment and/or that something has not disrupted the engine operating stability. The predetermined quantity may be any suitable quantity, which may be determined using empirical testing, modeling, hypotheses, or the like. An exemplary quantity may be 10 RPM. For example, an exemplary post-coarse-enleanment and recovery engine speed of 2,515 RPM may be compared to the pre-coarse-enleanment engine speed of 2,500 RPM and may be determined to be dissimilar or outside of the predetermined acceptable quantity of 10 RPM by 5 RPM. In this exemplary scenario, at step 121, the method loops back to any suitable location upstream of the enleanment routine 116, such as to routine 114. But, if at step 121, the post-coarse-enleanment and recovery engine parameter is within the predetermined acceptable quantity for operational stability of the pre-coarse-enleanment engine parameter, then the method may proceed to step 122.

At step 122, a quantity of the engine parameter resulting from enleaning may be compared to the engine parameter before enleaning. For example, an exemplary enleanment engine speed of 2,700 RPM may be compared to an exemplary pre-coarse-enleanment engine speed of 2,500 RPM.

At step 124, the difference between the engine parameter before coarse enleaning and resulting from coarse enleaning may be determined. If the difference is less than a predetermined coarse quantity, such as an exemplary quantity of 150 RPM, then the current enleanment quantity may be stored as a successful coarse enleanment quantity and the method may proceed to the fine enleanment routine 130. Otherwise, the method may loop back to a point anywhere upstream of the coarse enleanment routine, after the enleanment quantity is adjusted such as at step 126.

At step 126, the enleanment quantity may be modified from the default or current enleanment quantity to a modified enleanment quantity. For example, a default enleanment solenoid valve drive signal may be modified from 160 CR degrees open to 120 CR degrees open. This may be an iterative process to adjust the drive signal using one or more of the following techniques: proportional control for gain and error correction, simple iteration via fixed incremental adjustments, or predictive engine temperature signal conditioning to anticipate where engine temperature should be going.

At step 128, suitable test counters may be reset and stored test parameters may also be reset. For example, a counter may be provided to track the number of loops carried out through the coarse enleanment routine and enleanment quantity modification step 126. Also, the default enleanment quantity may be replaced with the modified enleanment quantity determined in step 126.

One or more loops through the coarse enleanment routine 116 and enleanment quantity modification step 126 may be needed to correct for undershoot or overshoot until the process converges on a successful coarse enleanment quantity, which may be, for example, a carburetor solenoid valve open time driving angle. To use a concrete value to exemplify the process, an exemplary successful coarse enleanment quantity of 135 CR degrees open will be used.

The fine enleanment routine 130 generally may include averaging of enleanment test data to smooth cycle-to-cycle perturbations in speed or other engine parameter detection. Such averaging may provide increased confidence that the engine has actually achieved a peak power operating condition from which actual speed, load, and engine temperature can be compared to the model peak power model to find a reliable engine temperature correction that may be applied during downstream normal operation. Between the coarse and fine enleanment routines, an engine recovery period operated at the pre-coarse-enleanment driving angle may be provided over a predetermined quantity of cycles, for example 50 to 100 cycles. Using the example above, the recovery period may be operated according to the exemplary pre-coarse-enleanment 70 degree driving angle.

At step 132, suitable counters to track a number of valid fine enleanment test cycles may be set.

At step 134, at least one engine parameter may be determined and used to assess the effects of enleanment on engine performance. For example, engine speed and/or engine temperature may be determined in any suitable manner.

At step 136, which may be similar to step 120, the combustible charge may be enleaned using the successful coarse enleanment quantity, for example 135 CR degrees open driving angle, until a change in the engine parameter is less than a second or fine predetermined quantity. For example, the air bleed solenoid valve may be adjusted to be open over the exemplary successful coarse enleanment quantity of 135 CR degrees open from the coarse enleanment routine to enlean the charge. According to one example, when the engine parameter no longer changes significantly as a result of the applied enleanment test (at a particular actuator driving signal), then the fine enleanment at step 136 may be terminated and the at least one engine parameter observed during fine enleanment stored in memory. The fine enleanment test may be terminated such that the combustion charge may be returned to its state just prior to the fine enleanment test, and an engine recovery period may be provided over a predetermined quantity of cycles, for example, 50 to 100 cycles. For example, the air bleed solenoid valve may be adjusted to be open over its pre-enleanment 70 CR degrees open value. Thereafter, the method may proceed to step 137.

At step 137, an engine parameter quantity after fine enleanment and recovery may be compared to an engine parameter quantity just before fine enleanment and a determination made whether the post-fine-enleanment and recovery quantity is similar to or within a predetermined quantity of the pre-fine-enleanment quantity. This may ensure that a detected change in the engine parameter from the fine enleanment test is a valid response from the fine enleanment and/or that something has not disrupted engine operating stability. The predetermined quantity may be any suitable quantity, which may be determined using empirical testing, modeling, hypotheses, or the like. An exemplary quantity may be 5 RPM. For example, an exemplary post-fine-enleanment and recovery engine speed of 2,510 RPM may be compared to the pre-fine-enleanment engine speed of 2,500 RPM and may be determined to be dissimilar or outside of the predetermined acceptable quantity of 5 RPM by 5 RPM. In this exemplary scenario, at step 137, the method loops back to any suitable location upstream in the process, for example by way of steps 142 and 144, as will be discussed herein below. But, if at step 137, the post-fine-enleanment and recovery engine parameter is within the predetermined acceptable quantity of the pre-fine-enleanment engine parameter, then the method may proceed to step 138.

At step 138, the quantity of the engine parameter resulting from fine enleaning may be compared to the quantity of the engine parameter before enleaning. For example, an exemplary fine enleanment engine speed of 2,600 RPM may be compared to an exemplary pre-fine-enleanment engine speed of 2,500 RPM.

At step 140, the difference between the engine parameter before fine enleaning and resulting from fine enleaning may be determined. If the difference is less than a maximum fine quantity, such as an exemplary value of 100 RPM, then the method may proceed to step 146. Otherwise, the method may loop back to a point anywhere upstream via steps 142, and 144 as will be described below.

At step 142, any stored data from the steps 137 or 140 in the fine enleanment routine may be discarded.

At step 144, a determination may be made whether a predetermined quantity of unsuccessful fine enleanments have been reached. Those of ordinary skill in the art will recognize that this step may be carried out using any suitable counters, or the like, in any suitable locations of the fine enleanment routine.

If, at step 144, the predetermined quantity of unsuccessful fine enleanments has been reached, then the method may loop back to step 126 to adjust the fine enleanment quantity being used. For example, the current 135 degree open driving angle quantity may be adjusted to an exemplary 130 degrees open. Otherwise, the fine enleanment routine is continued wherein the method loops back to step 134.

At step 146, the difference determined in step 140 (if within the maximum acceptable quantity) is stored and may be added to a data array to be averaged with differences from preceding or subsequent acceptable fine enleanment tests.

At step 148, one or more suitable counters may be decremented or incremented to track the number of times an acceptable fine enleanment loop has been carried out.

At step 150, it may be determined whether a predetermined number of acceptable fine enleanment tests have been reached. Any suitable number of acceptable fine enleanment tests may be used and may be suitably determined for a given engine design. An exemplary range may include from 5 to 50 tests or loops. If the determination is negative, then the method loops back to step 134, otherwise, the method proceeds to step 152.

At step 152, an average of stored parameter quantities, such as stored differences from steps 140 and 146 from the predetermined quantity of acceptable fine enleanment tests may be calculated. As used herein, average may include a mean, median, mode, or any combination thereof.

At step 154, the average of stored parameter quantities calculated in step 152 is compared to any suitable criterion such as a predetermined acceptable average quantity, which may be less than the fine enleanment quantity, such as 50 RPM. If, at step 154, the stored parameter quantity average is not less than the maximum acceptable average quantity, then the method may loop back to step 126, where the drive angle may be re-estimated such as at an exemplary 132 degrees open and used for another pass through the coarse enleanment routine. Otherwise, the method proceeds to the correction routine 156.

The correction routine 156 is provided to correct the engine model temperatures to provide corrected temperatures according to which the engine is operated during normal operation.

At step 158, engine speed, load, and/or temperature may be determined in any suitable manner.

At step 160, the determined engine speed, load, and/or temperature may be compared to a model including model engine speeds, loads, and engine temperatures. Any model may be used and, for example, the model may be the same as that discussed in step 110.

At step 162, a relationship between the determined engine temperature and the model engine temperature corresponding to the determined engine speed and load may be assessed in any suitable manner. For example, a ratio of the determined engine temperature to the model engine temperature corresponding to the determined engine speed and load may be stored for use downstream in the process. In another example, a difference between the determined engine temperature and the model engine temperature corresponding to the determined engine speed and load may be calculated in any suitable manner.

At step 164, an engine temperature correction may be determined in response to the ratio or the calculated difference between the determined engine temperature and the model engine temperature, in any suitable manner. For example, if the difference is negligible, perhaps less than some predetermined quantity (for example 25 degrees in EGT), then this may indicate that the engine is operating in accord with its design intent and no correction may be made. But, for example, if the difference is greater than some predetermined quantity, then one or more engine parameter quantities may be adjusted in accord with the difference in engine temperature. An exemplary predetermined quantity may be greater than 25 degrees in EGT, such as 150 degrees higher or lower than a reference model EGT. Suitable mathematical applications may be used to carry out the adjustment, such as incrementing or decrementing for offset or skew of model values, equations, or other adjustment based on the test results to provide an adjusted model for preferred temperature setpoints more conducive to the desired operating state of the engine.

At step 166, the determined temperature correction may be applied to engine control in any suitable manner. In one example, the correction may be applied to a default engine temperature setpoint model to create a modified engine temperature setpoint model. In another example, to save memory space, the correction may be applied to an output of the default engine temperature setpoint model to yield a corrected desired engine temperature setpoint. In any case, the engine temperature setpoint model may represent where the engine temperature should be for any given speed and load for desired engine performance.

Accordingly, whereas the reference model may be created for peak power regardless of fuel economy, emissions requirements, or the like, the engine temperature setpoint model may be created for desired or normal performance which may differ from the reference model. The engine temperature setpoint model may be developed with empirical testing of a given engine design and may be calibrated to run the engine according to any desired parameters. For example, the setpoint model may be developed to run the engine rich at higher speeds and loads to assist with engine cooling and/or to run leaner at lighter loads and speeds for better fuel economy, reduced exhaust gas emission, or responsiveness. Model setpoint parameters may also be adjusted for ambient temperature, engine temperature, barometric pressure that typically influence A/F ratio and subsequent combustion processes.

Following cranking 102, warmup 104, the enleanment routines 116, 130, and the correction routine 156, the engine may be run according to a normal mode or routine 168. Once steps 102 through 160 have been carried out and normal operation begins, steps 102 through 160 may not be carried out again until the engine is shut down and restarted.

At step 170 within the normal routine 168, the carburetor solenoid valve may be adjusted in any suitable manner based on the engine temperature correction to achieve the corrected desired engine temperature setpoint. For example, the corrected output quantity from the default engine temperature setpoint model from step 166 may be used as input to any suitable downstream actuator drive algorithms, equations or formulas, look up tables, etc. that may be used to determine, for example, an air bleed solenoid valve open driving angle quantity to achieve the corrected output quantity. Therefore, in targeting the corrected temperature setpoint, the engine may be quickly and reliably controlled to compensate for changes in engine operating conditions. Such changes may be caused by reduced volumetric efficiency perhaps because of engine wear, performance loss perhaps caused by manifold leaks or a restricted air filter, or actual environmental conditions such as temperature, pressure, humidity, etc. that vary significantly from the environmental conditions accounted for during engine calibration.

The method 100 can provide a low cost solution for non-stoichiometric or stoichiometric closed loop engine control using signals that can be used in conjunction with one or more models to command the air/fuel mixture from cold engine start-up to normal operation. Cold start, hot restart and warm-up transitions may be improved, including automatic monitoring of engine temperature for protection of engine over-temperature conditions from excessively lean air/fuel mixtures or engine load conditions.

Figure 30:
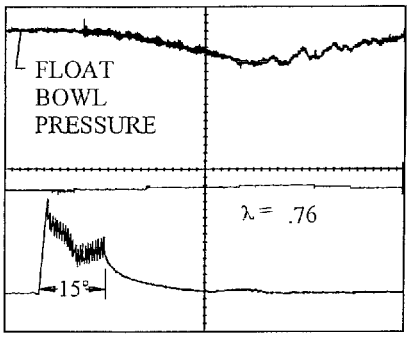
FIG. 30 is a plot of float bowl pressure, lambda and a solenoid actuation signal.
Figure 31:
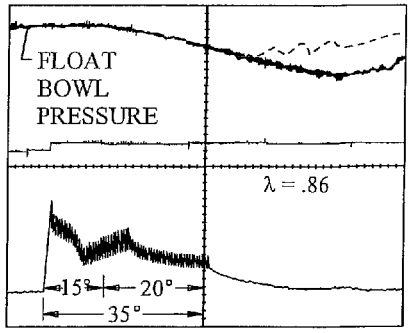
FIG. 31 is a plot of float bowl pressure, lambda and a modified solenoid actuation signal.
Figure 32:
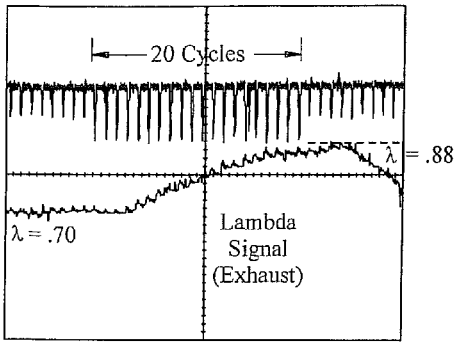
FIG. 32 is a plot of float bowl pressure and lambda over 20 engine cycles.
Figure 33:
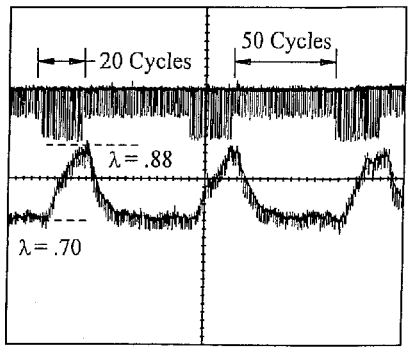
FIG. 33 is a plot of float bowl pressure and lambda over a plurality of engine cycles.

The ability to control the A/F ratio is demonstrated in FIGS. 30-33 which illustrate some representative A/F enleanment events. In FIGS. 30 and 31, the lowest line on the graph relates to solenoid current, the middle line on the graph shows lambda (A/F ratio), and the upper line is a plot of the float bowl pressure. In FIG. 30, the solenoid was opened for 15 degrees of CR and a lambda of 0.76 was achieved, and the float bowl pressure shows a decrease. In FIG. 31, the solenoid was opened for 35 degrees of CR and a lambda of 0.86 was achieved (enleaned compared to 0.76), and the float bowl pressure shows a larger decrease than in the example of FIG. 30. This demonstrates the ability to affect A/F ratios by application of a subatmospheric pressure source to the float bowl as noted herein. FIGS. 32 and 33 likewise demonstrate this ability. FIG. 32 demonstrates an enleanment over 20 engine cycles and a resulting lambda change from 0.70 to 0.88. FIG. 33 shows the changes in lambda over three enleanment cycles. Each enleanment event occurs over 20 engine cycles with 50 engine cycles without enleanment between successive enleanment events to permit the engine to return to normal operation as discussed above.

Control of the air/fuel mixture may be optimized to work in combination with an exhaust catalytic converter for exhaust gas low emission products, and may provide better operating conditions (lower catalytic muffler temperatures) for longer engine life. In addition, the improved control of fuel/air mixtures over a wide range of engine operating conditions supports the utilization of smaller catalytic muffler packages and reduced thermal loads for catalytic materials for both cost savings to the engine manufacturer and favorable extension for engine end-of-life operational requirements for emission compliance. Accordingly, the method may optimize engine exhaust emissions by compensation for restricted air filters, production tolerances for both engine and carburetor, variations in fuel constituency, atmospheric changes for humidity, ambient temperature and barometric pressures, and compensates for conditions of reduced engine efficiency from internal component degradation, wear, or leakage of gasketed interface surfaces (degraded hermetic sealing of crankcase or cylinder head interfaces).

Another advantage may be eliminating an external/internal battery or engine equipped alternator device(s) as an auxiliary energy source. The Power Generation Unit (PGU) may provide self-contained power generation delivered to the control module and solenoid valve without added complexity of additional flywheel magnets or externally mounted charge coils. In addition, the PGU may include features of a digital ignition module to control engine starting and idle stability prior to ignition control handoff to the control module, thereby enabling easy-pull manual starting with improved engine warmup and idle stability, as explained above in more detail. Furthermore, the PGU can provide a 'limp-home' feature where it takes over control of the ignition timing in the event that a malfunction or other failure occurs in the control module.

Although the method has been described with reference to enleanment tests from a relatively rich pre-enleanment condition, the invention may also be implemented with reference to enrichment tests from a relatively lean pre-enrichment condition. Although this option may not be as desirable, for example, because the engine may run hotter, it is well within the capabilities of one of ordinary skill in the art to implement the alternative after having read the above description with respect to enleanment. For example, step 112 could be performed to preset the A/F ratio leaner than a reference peak power condition and an enrichment test utilized to induce a favorable speed change from the initial leaner to a richer condition.

Figure 18:
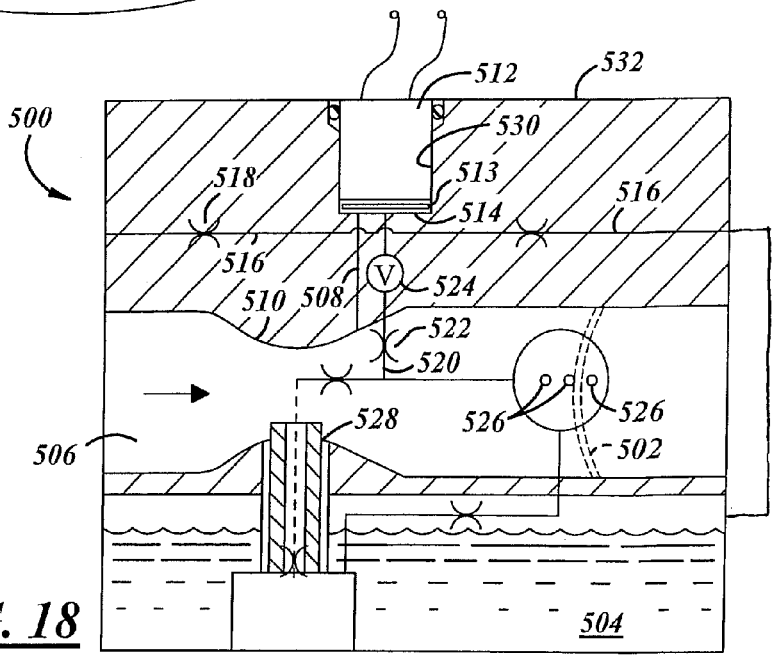
FIG. 18 is a schematic of a carburetor having a solenoid that may be actuated to alter an air-fuel mixture delivered from the carburetor.

An alternate carburetor construction is shown in FIG. 18. This carburetor 500 may be similar in many ways to the previously discussed carburetor 12 and include a throttle valve 502, optional choke valve (not shown), and the like. However, instead of controlling the magnitude or application of an air bleed to control an A/F mixture ratio, this carburetor 500 is constructed to permit control of a pressure signal to a float bowl 504 of the carburetor to control the fuel flow from the float bowl and to a fuel and air mixing passage 506 in the carburetor. Typical float bowl carburetors provide atmospheric pressure to the float bowl and a subatmospheric pressure present in the carburetor fuel and air mixing passage causes fuel to flow from the float bowl and into the fuel and air mixing passage for delivery to the engine. Application of a subatmospheric pressure signal to the float bowl 504 can decrease the pressure differential on the fuel in the float bowl and hence, decrease the flow rate of fuel from the float bowl to the fuel and air mixing passage 506. In this manner, the A/F mixture ratio may be controlled.

To provide a subatmospheric pressure signal to the float bowl 504, a pressure signal passage 508 may be provided that opens to the fuel and air mixing passage 506 downstream of a throat of a venturi 510 in the fuel and air mixing passage. Accordingly, a pressure drop generated at or present near the venturi is communicated with the pressure signal passage 508. The pressure signal passage leads to a solenoid valve 512 including a valve head 513 which, when closed, prevents communication of the pressure signal from the pressure signal passage 508 to the float bowl 504. However, when the solenoid valve is open (i.e. its valve head 513 is displaced from its valve seat), then the pressure signal passage is communicated with a transfer passage 516 that is open to the solenoid valve at one end and to the float bowl 504 at its other end. In this way, the subatmospheric pressure generated in the fuel and air mixing passage 506 can be communicated with the float bowl 504 (such as to an air space above liquid fuel in the float bowl) through the pressure signal passage 508, the solenoid valve 512 and the transfer passage 514 and 516.

As shown in FIG. 18, the transfer passage 514 may join an atmospheric reference passage 516 which provides air at atmospheric pressure to the float bowl. In this way, the reference passage 516 is open to the float bowl in any position of the solenoid to reference the float bowl to atmospheric pressure. A restriction 518 may be provided in the reference passage upstream of the transfer passage to control the air flow rate through that portion of the reference passage. To control the magnitude of the subatmospheric pressure signal provided to the float bowl, the flow area of the transfer passage 514 can be controlled as a function of the flow area of the restriction 518. The magnitude of the subatmospheric pressure signal in turn determines the amount by which the fuel flow rate from the float bowl 504 to the fuel and air mixing passage 506 is decreased. In addition, the duration that the solenoid 512 is open also affects the pressure in the float bowl 504 because the subatmospheric pressure signal is only applied to the float bowl when the solenoid is open (and when a subatmospheric pressure exists in the corresponding area of the fuel and air mixing passage). In this way, the A/F ratio delivered from the carburetor can be controlled by any method, including the method discussed above.

In at least some applications, there is very little fuel flow required at idle and so there is a relatively low pressure differential on the fuel in the float bowl. Because of this, it may be relatively difficult to control idle fuel flow by application of a subatmospheric pressure signal on the fuel in the float bowl. Further, the pressure at the pressure signal passage 508 may not be significantly subatmospheric at idle. With this in mind, an air bleed passage 520 can be used to partially or entirely diminish any subatmospheric pressure signal that may be communicated to the float bowl when the solenoid is open. A suitable restriction 522 may be provided in the air bleed passage 520 to control the flow rate therethrough (e.g. to prevent undue dilution of the subatmospheric pressure signal at higher engine speeds and loads) and a check valve 524 may be provided to prevent a reverse air flow through the passage 520.

In the region of engine operation wherein the fuel flow transitions from a low speed circuit including one or more ports 526 through which fuel flows to the fuel and air mixing passage and a high speed fuel circuit wherein fuel is provided to the fuel and air mixing passage 506 through a main fuel pipe 528, significant subatmospheric pressure may exist in the idle/low speed fuel circuit. This subatmospheric pressure may enlean the fuel and air mixture. To facilitate control of the pressure signals and fuel flow in this crossover region between low and high speed fuel circuits, the relative sizes or flow areas of the passages 508, 514 520 can be calibrated. In one embodiment, the passages that supply the subatmospheric pressure signal may be on the order of about 50% to 400% larger than the air bleed passages to accommodate low speed, high speed and transitional (from low to high speed) engine operation and permit control of the pressure on the fuel in the float bowl to permit control of the A/F ratio delivered from the carburetor.

As shown in FIGS. 18, and 24-26, the solenoid 512 may be mounted in a cavity 530 formed or provided in the carburetor body 532. In one implementation, the cavity 530 may be formed in an upper surface of the body (relative to the orientation of the carburetor in use, which may be as shown in FIG. 18), and the cavity may extend generally vertically such that the solenoid movement is generally inline with the force of gravity. This may facilitate the response and actuation of the solenoid. The cavity may be sealed with the solenoid therein by an O-ring, gasket, potting, press-fit of the solenoid in the cavity, or by any other suitable means. A plate 533 held down by fasteners 535 may be provided over the solenoid to hold it in place. Further, the control module circuit board 86 (FIG. 24) may be mounted adjacent to the upper surface of the carburetor body and covering the solenoid. In this construction and arrangement, the solenoid power inputs 534, 536 can be directly electrically connected to the circuit board 86 to eliminate the need for wires and/or separate electrical connectors. The circuit board 86 can then be enclosed, at least partially, by a top plate or cover 538 of the carburetor body. Of course, the solenoid could be remote from the carburetor and connected thereto, for example, by suitable tubes to provide the air/pressure signal communication as discussed.

Figure 23:
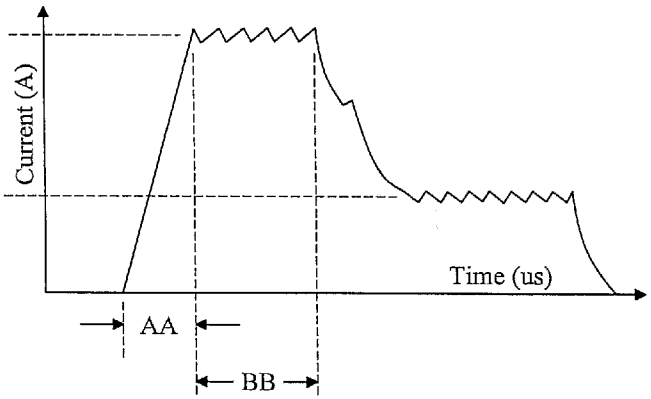
FIG. 23 is a plot of an exemplary signal that may be used to drive the solenoid of FIG. 20B.
Figure 25:
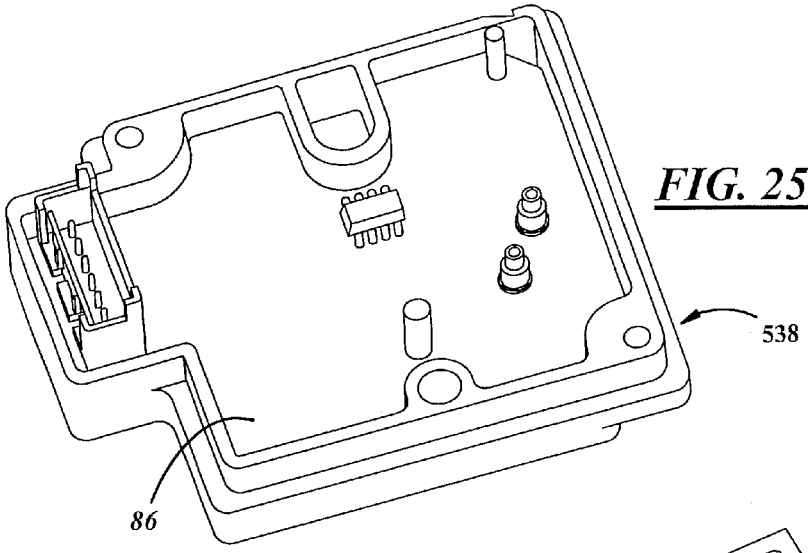
FIG. 25 is a bottom view of a cover of the carburetor of FIG. 24 with a circuit board carried by the cover.
Figure 26:
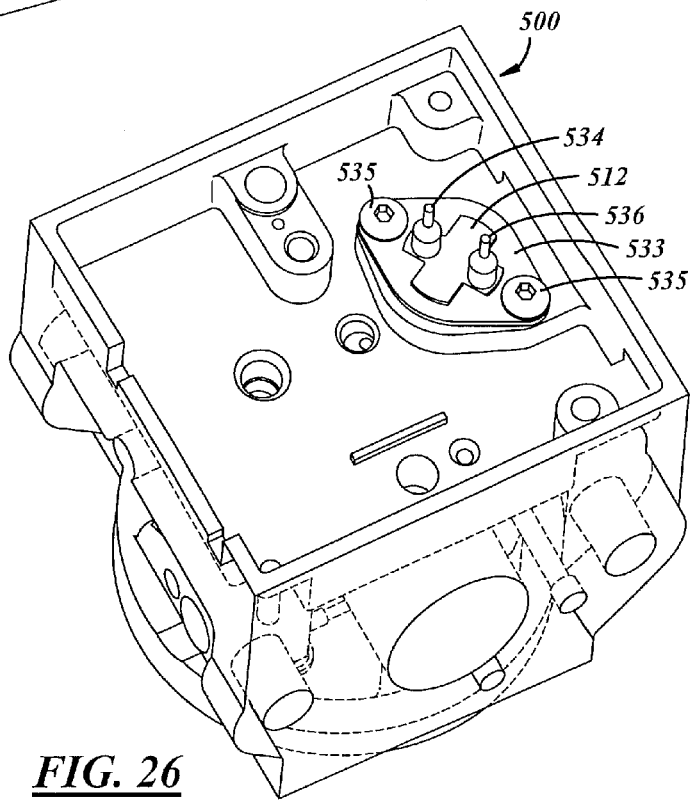
FIG. 26 is a perspective view of a carburetor with which the cover of FIG. 25 may be used.
Figure 28:
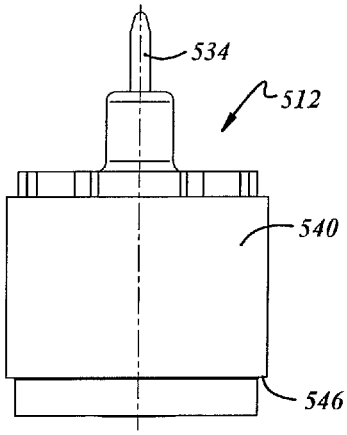
FIG. 28 is a front view of a solenoid.
Figure 29:
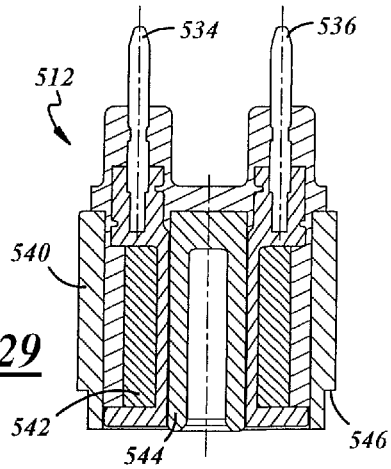
FIG. 29 is a sectional view of the solenoid of FIG. 28.

One form of a solenoid 512 is shown in FIGS. 28 and 29. The solenoid may have a cylindrical housing 540, coil 542 and plunger or core 544 driven for linear movement by actuation of the coil. Power inputs such as wires or pins 534, 536 may extend out of the housing and may be connected directly to a circuit board 86. A radially extending shoulder 546 may help trap an O-ring or other seal between the housing and a body in which the solenoid is inserted. A representative solenoid driving signal is shown in FIG. 23. As shown, the solenoid may be driven by an electrical signal having an initially high current to enable a fast response, and then a reduced current to hold the solenoid in its driven position for a desired time. The control module may use two solenoid driving methods in the initial high current phase. Initially, there may be a "fast peak" period where full system voltage is applied to the solenoid for a given time (labeled AA on FIG. 23) to quickly drive the current to its peak value. Then, a pulse width modulated peak period may be used where the duty cycle is adjusted to maintain a desired or average voltage for a time (labeled BB on FIG. 23). The current may then drop to a hold current to reduce power consumption while the solenoid valve is held open. Pulse width modulation may be used to maintain a desired average hold current level.

Figure 19:
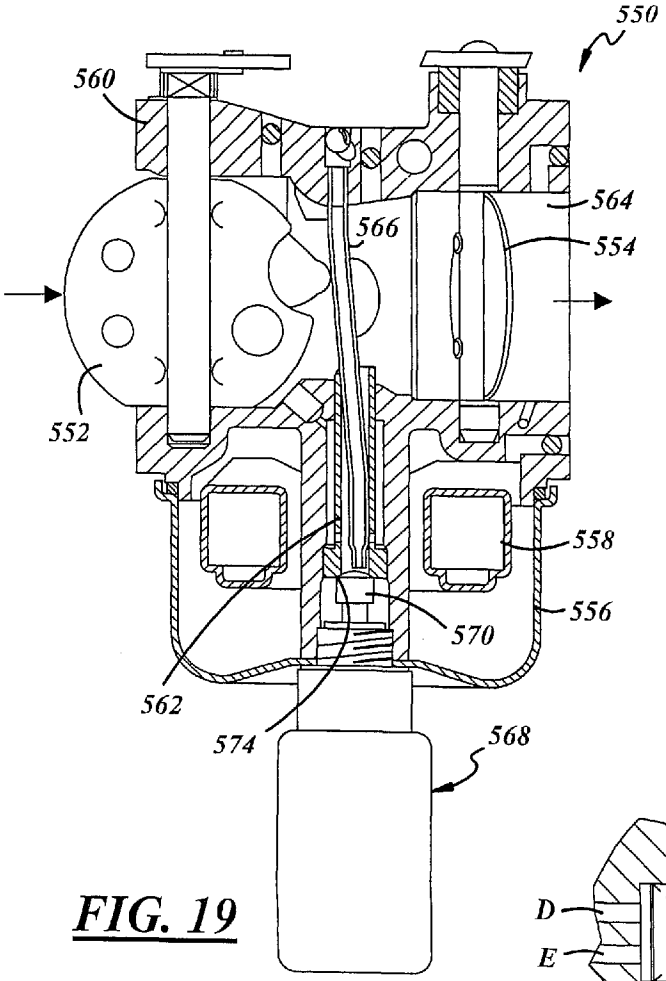
FIG. 19 is a sectional view of an alternate carburetor.

Another implementation of a carburetor 550 is shown in FIG. 19. In general, the carburetor can be constructed in the same manner as the previously discussed carburetors and may include a choke valve 552, throttle valve 554, float bowl 556, float valve 558, body 560, fuel nozzle or pipe 562, fuel and air mixing passage 564 and an idle tube 566 which may be used to pick-up fuel to support idle engine operation and may communicate with an idle fuel pocket or jets.

In this example carburetor, the solenoid 568 is responsive to selectively restrict or prevent fuel flow to the fuel and air mixing passage to enlean the A/F mixture delivered from the carburetor. That is, rather than influence an air bleed or a subatmospheric pressure signal to in turn influence fuel flow, the solenoid 568 is placed directly in a fuel flow path and by closing or restricting that fuel flow path, reduces fuel flow to the fuel and air mixing passage.

As shown, the solenoid 568 may be carried by or adjacent to the float bowl 556 with the valve head 570 received adjacent to the main fuel pipe 562. The valve head 570 may be retracted or advanced relative to the fuel pipe 562 to control the flow rate of fuel from the float bowl and through the fuel pipe. The solenoid may be closed for discrete intervals, or may be cycled between opened and closed positions to control the fuel flow. In an implementation where the valve head fully engages a valve seat 574 to close the valve seat, no (or very little) fuel flow would occur through the valve seat when the solenoid is closed. For any given engine operating condition (e.g. idle, wide open throttle, or anything in between), the maximum fuel flow could occur through the valve seat and hence, to the fuel and air mixing passage, when the solenoid valve is open (that is, the valve head is fully retracted from the valve seat). For any given engine operating condition, the fuel flow could be modulated or controlled by selectively closing the solenoid valve as desired to enlean the A/F mixture as desired.

Figure 20A:
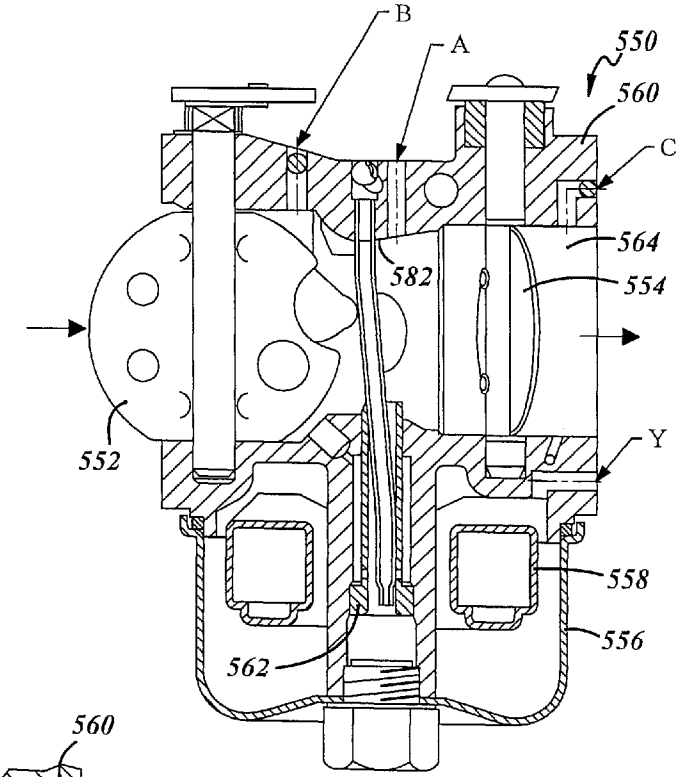
FIG. 20A is a sectional view of a carburetor constructed like that of FIG. 19.
Figure 20B:
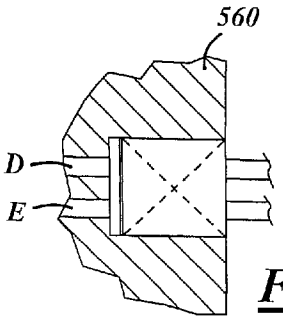
FIG. 20B is a fragmentary sectional view of a solenoid that may be used with the carburetor of FIG. 20A.
Figure 22:
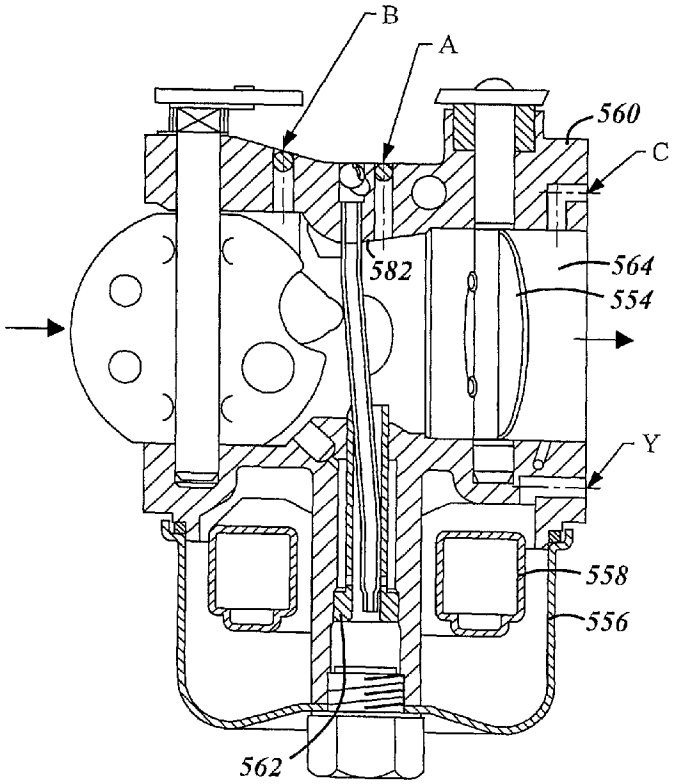
FIG. 22 is a sectional view of a carburetor constructed like that of FIG. 19.
Figure 21:
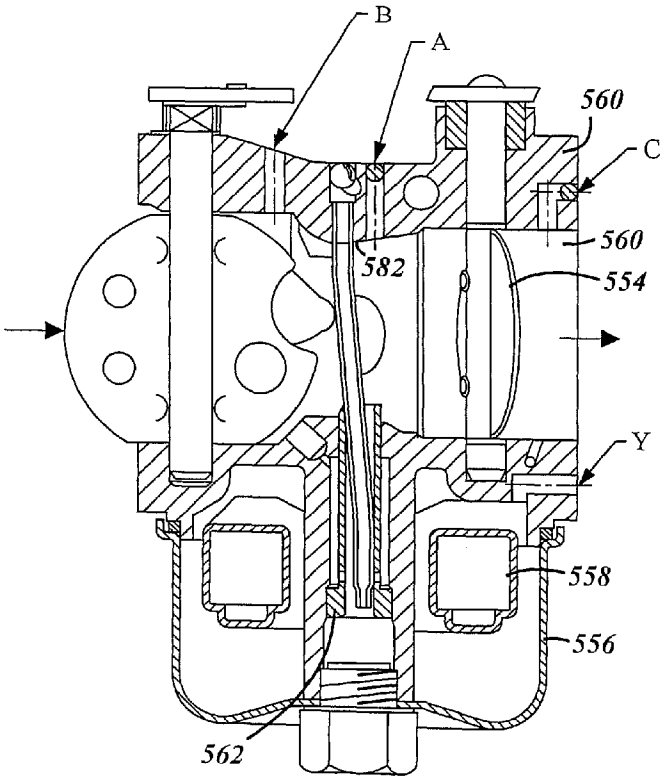
FIG. 21 is a sectional view of a carburetor constructed like that of FIG. 19.
Figure 24:
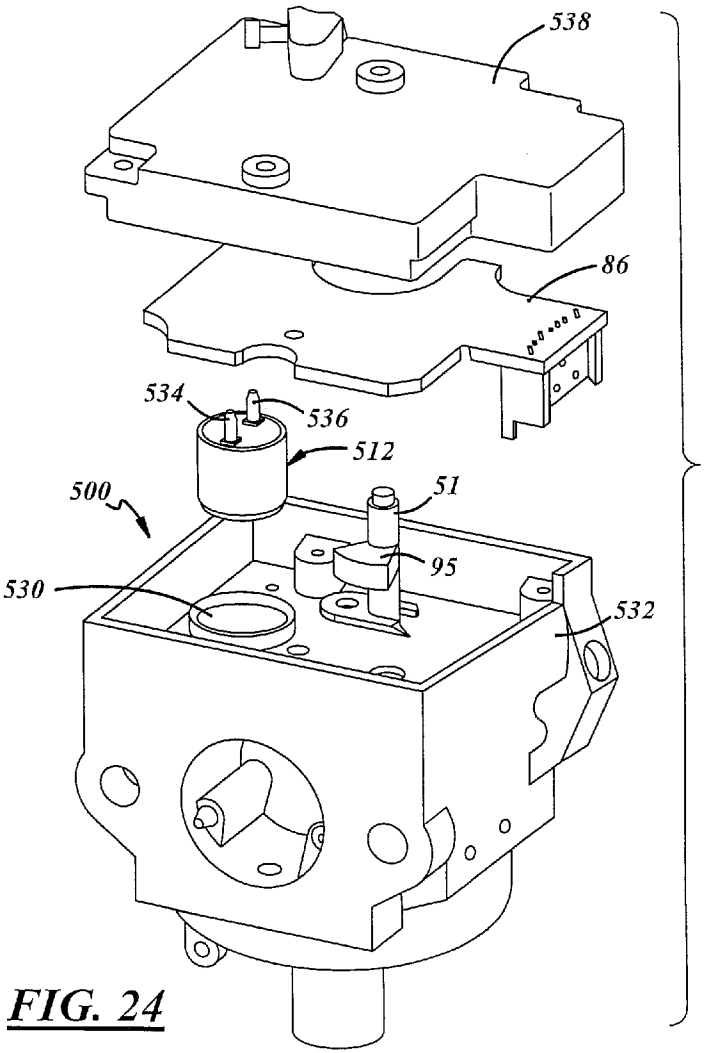
FIG. 24 is an exploded view of a carburetor of the type shown in FIG. 18.

The carburetor shown in FIGS. 20-22 may be substantially the same as the carburetor shown in FIG. 19, except that a solenoid 580 (FIG. 20B) is communicated with one or more air bleed, atmospheric reference or subatmospheric reference passages to control the pressure on the fuel in the float bowl, and hence, the flow rate of fuel from the float bowl. In FIGS. 20A and 20B, a first port D which is communicated with the solenoid is also communicated with the float bowl via a passage Y. A second port E which is communicated with the solenoid is also communicated with a subatmospheric reference source, such as a passage A which opens in the area of a venturi 582 in the fuel and air mixing passage. When the solenoid 580 is closed to prevent communication between ports D and E (and hence, to prevent communication between the passage A and the float bowl), there is a maximum fuel flow for all engine operating conditions, idle, WOT and speeds/loads in between them. When the solenoid is open, ports D and E are communicated and hence, the subatmospheric signal from passage A is communicated to the float bowl 556. This results in an enleaned A/F mixture, and a minimum fuel flow condition at idle, WOT or in between. Fuel flow between the minimum and maximum can be obtained by cycling or controlling the duration that the solenoid is opened or closed to achieve different A/F mixture ratios.

In the carburetor of FIG. 21, a first port D that is communicated with the solenoid 580 is also communicated with the float bowl via a passage Y. A second port E that is communicated with the solenoid 580 is also communicated with a subatmospheric reference source, such as passage B which opens upstream of the venturi 582 in the fuel and air mixing passage 564. At least at higher speed or higher load engine operation, the passage B generally provides a subatmospheric pressure signal of lesser magnitude than the passage A of the carburetor of FIG. 20. In the carburetor of FIG. 21, when the solenoid is closed to prevent communication between ports D and E (and hence, to prevent communication between passage B and the float bowl), there is a maximum fuel flow for all engine operating conditions, idle, WOT and speeds/loads in between them. When the solenoid is open, ports D and E are communicated and hence, the subatmospheric signal from passage B is communicated to the float bowl 556. This results in an enleaned A/F mixture, and a minimum fuel flow condition at idle, WOT or in between. Fuel flow between the minimum and maximum can be obtained by cycling or controlling the duration that the solenoid 580 is opened or closed to achieve different A/F mixture ratios.

In the carburetor of FIG. 22, the first port D that is communicated with the solenoid 580 is also communicated with the float bowl via a passage Y. The second port E that is communicated with the solenoid 580 is also communicated with a subatmospheric reference source, such as passage C which opens into the fuel and air mixing passage 564 downstream of the venturi 582 and downstream of the throttle valve 554 (at least when the throttle valve is in its idle position). At idle and low speed/load engine operation, the subatmospheric pressure signal may be of greater magnitude in the area of passage C than in the area of passage A or B of the previously described carburetors. But at higher engine speeds or loads, the subatmospheric pressure signal may be of lesser magnitude than at passages A or B. Nevertheless, when the solenoid is closed to prevent communication between ports D and E (and hence, to prevent communication between passage C and the float bowl), there is a maximum fuel flow for all engine operating conditions (e.g. idle, WOT and speeds/loads in between them). When the solenoid is open, ports D and E are communicated and hence, the subatmospheric signal from passage C is communicated to the float bowl 556. This results in an enleaned A/F mixture, and a minimum fuel flow condition at idle, WOT or in between. The enleament may be relatively greater at engine idle/low speeds due to the relatively strong subatmospheric pressure signal that is present at passage C. Fuel flow between the minimum and maximum can be obtained by cycling or controlling the duration that the solenoid is opened or closed to achieve different A/F mixture ratios.

Figure 37:
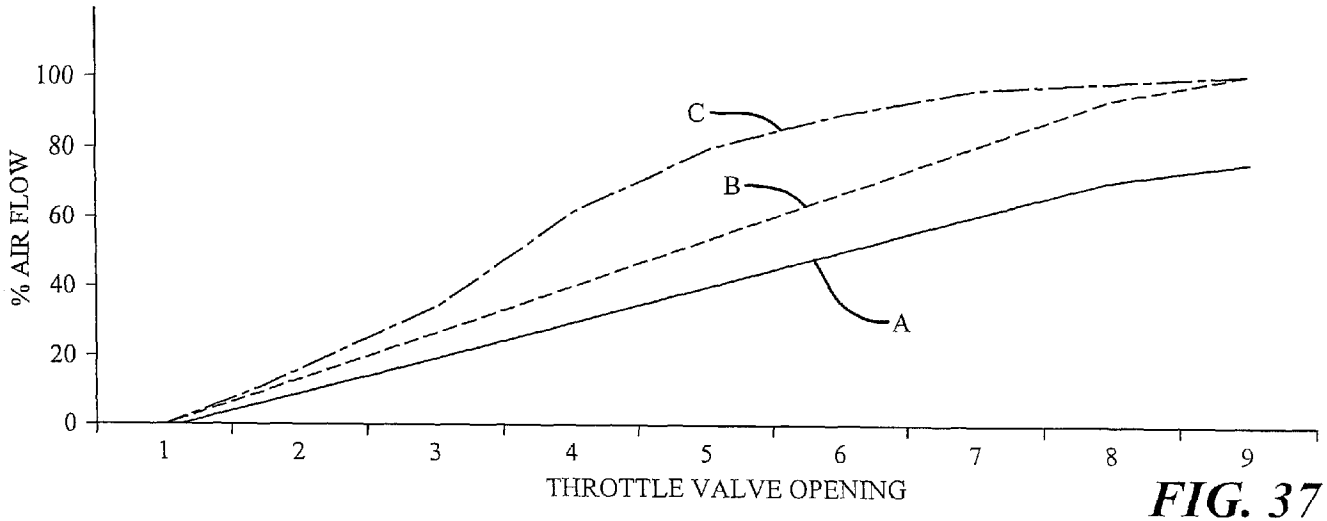
FIG. 37 is a graph showing airflow v. throttle valve opening in a diaphragm carburetor.

In exemplary butterfly throttle valve carburetors of the type discussed above and hereafter, FIG. 37 shows representative air flows v. throttle valve opening degree or extent. In FIG. 37, the ordinate is divided in percentage, from 0 to 100, and the abscissa represents: 1) throttle valve opening in degrees (shown by line A); 2) throttle valve opening stated as a percentage of total throttle valve movement (shown by line B); and 3) airflow stated as a percentage of maximum airflow from 0% (no airflow) to 100% (maximum airflow). The percentage of airflow is shown by line C. From this graph, it can be seen that in this exemplary representation, the throttle valve moves about 75 degrees between its fully closed and wide open positions. During this throttle valve movement, the air flow is not linear as shown by line C. For example, when the throttle valve is 53% open, the airflow is at about 80% of its maximum and opening the throttle valve the remaining 47% provides only about another 20% of the air flow.

Figure 38:
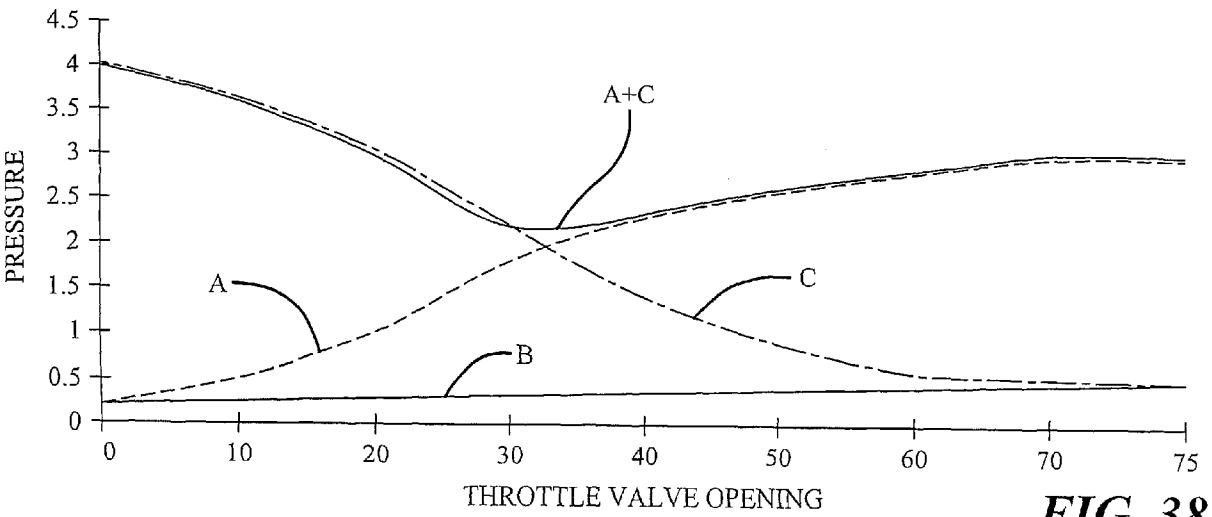
FIG. 38 is a graph showing relative magnitude of pressure at various locations within a carburetor and as a function of the extent to which a throttle valve is opened.
Figure 39A:
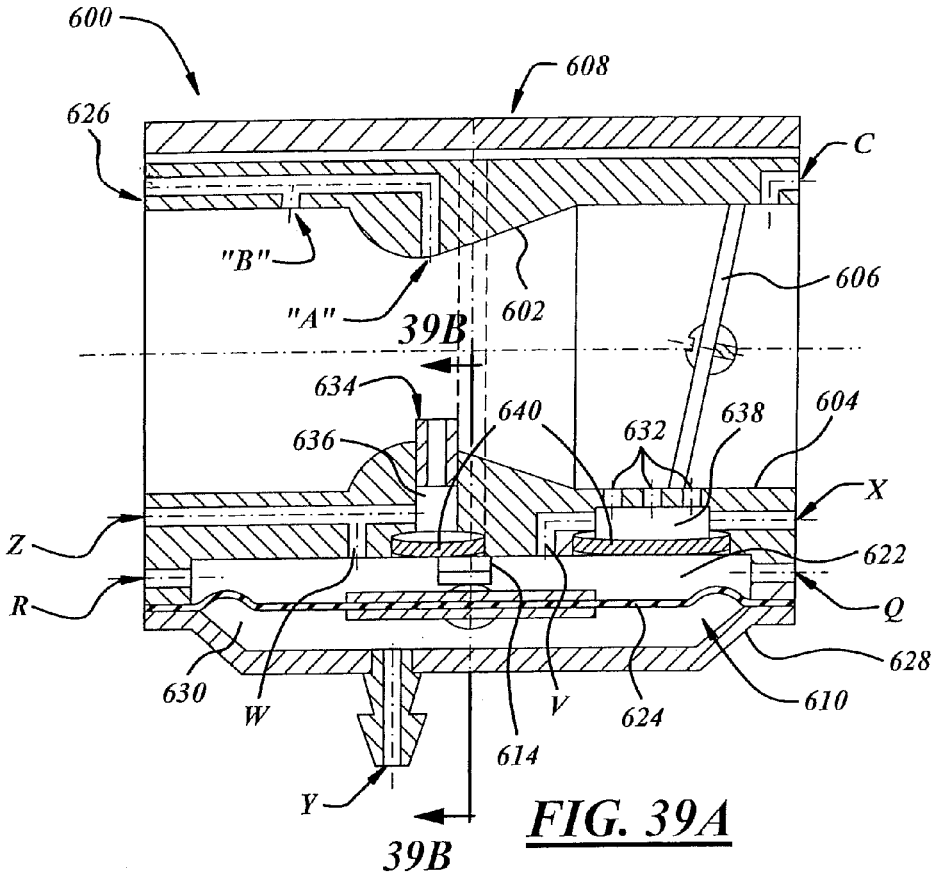
FIG. 39A is a sectional view of an exemplary diaphragm type carburetor with which a solenoid valve may be used to adjust an air-fuel mixture ratio.
Figure 39B:
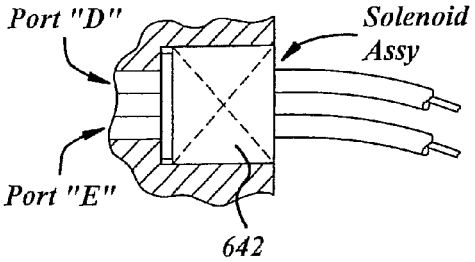
FIG. 39B is an enlarged, fragmentary sectional view of a fuel metering assembly of the carburetor of FIG. 39A.
Figure 39B:
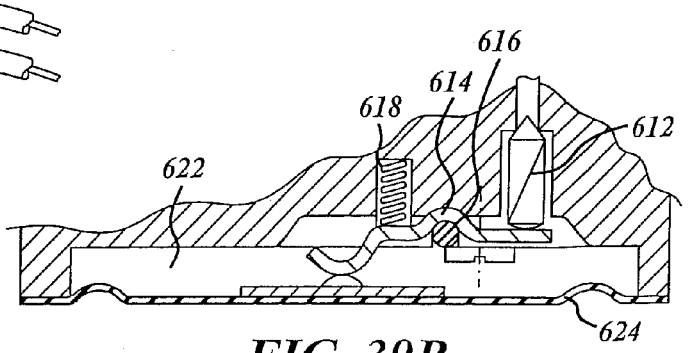

FIG. 38 illustrates exemplary data of relative magnitude of a subatmospheric pressure source, as a function of the extent to which the throttle valve is open, at different locations along the fuel and air mixing passage of an exemplary diaphragm type carburetor 600 shown in FIG. 39. In FIG. 38, the relative magnitude of the subatmospheric source is provided on the ordinate and degrees of opening of the throttle valve are shown on the abscissa. Four plot lines are provided, with one plot line for each of three different locations marked A, B and C on the carburetor of FIG. 39, and one plot combining the subatmospheric pressure signals from locations A and C (shown as line "A+C" on FIG. 38). Location A is in the area of a venturi 602 in the fuel and air mixing passage 604. Location B is upstream of the venturi 602. And location C is downstream of the venturi 602, and downstream of the throttle valve 606 (at least when the throttle valve is in its idle position).

Line A in FIG. 38 shows that the magnitude of the subatmospheric pressure signal at location A in the carburetor of FIG. 39 is near zero when the throttle valve 606 is closed, increases relatively slowly as the throttle valve is opened up to about 20 degrees, increases more rapidly as the throttle valve is opened between 20 and 50 degrees, and then levels out near a maximum value between about 60 and 75 degrees of throttle valve movement where 75 degrees represents a fully opened throttle valve. In this example, the maximum value is about 15 times greater than the minimum value. Line B shows that the magnitude of the subatmospheric pressure signal at location B is near zero when the throttle valve is closed, and gradually increases to only about 2.5 times its starting value when the throttle valve is fully opened (75 degrees). Line C shows that the magnitude of the subatmospheric pressure signal at location C in the carburetor of FIG. 39A is at its maximum when the throttle valve is closed, and at its minimum when the throttle valve is wide open. Therefore, line A+C follows the line C when the magnitude of the signal at location C is greater than at location A and then follows line A when the magnitude of the signal at location A is greater than at location C in the carburetor. Accordingly, subatmospheric pressure sources or signals are available at different locations in the carburetor 600, and at different magnitudes over the range of throttle valve movement between closed and wide open positions. As shown above in various float bowl carburetors, and as will be shown below in various diaphragm carburetors, these subatmospheric pressure sources can be utilized to control the ratio of the A/F mixture delivered from the carburetor.

Referring again to FIG. 39A, the diaphragm type carburetor 600 may have a butterfly type throttle valve 606. Such diaphragm type carburetors may also include a diaphragm fuel pump 608 as is known in the art and disclosed in U.S. Pat. No. 4,271,093, the disclosure of which is incorporated herein by reference. Fuel discharged from the diaphragm fuel pump 608 is delivered to a fuel metering assembly 610 (best shown in FIG. 39B) which may be constructed and arranged as shown in U.S. Pat. No. 4,271,093.

Generally, the fuel metering assembly 610 may include an inlet valve 612 carried on a lever 614 that is pivoted about a pin 616 and acted on by a spring 618 to normally close the inlet valve against a valve seat to prevent fuel flow from the fuel pump 608 through the valve seat. When the inlet valve 612 is open, fuel flows through the valve seat and into a fuel metering chamber 622 which is communicated with the fuel and air mixing passage 604. The fuel metering chamber 622 is defined in part by a fuel metering diaphragm 624 and by a cavity in the carburetor body 626. The fuel metering diaphragm 624 also defines, with a cover 628, a reference chamber 630 which may be vented to atmospheric pressure in at least some applications. The fuel metering diaphragm 624 (or a projection carried thereby) engages the lever 614 when the pressure in the fuel metering chamber 622 is below a threshold to pivot the lever and open the inlet valve 612 to admit fuel into the fuel metering chamber 622. Fuel in the fuel metering chamber is delivered into the fuel and air mixing passage 604 through one or more idle jets 632 or ports and one or more main fuel nozzles 634, as is known in the art. The nozzle 634 and idle fuel jets 632 may be communicated with separate wells or pockets 636, 638, respectively. In at least some implementations, the pockets 636, 638 may be closed at one end or face by suitable plugs 640.

A solenoid 642 or other electrically responsive valve may be communicated with passages in the carburetor 600 in the same manner discussed above with regard to FIGS. 20-22. The solenoid 600 may be connected to, received in, carried by or otherwise operably associated with the carburetor 600. Several embodiments of carburetors will be described with reference to FIG. 39, with different passages shown in FIG. 39 being either plugged or not formed in the various embodiments. The passages include, generally, passages A, B and C referred to above with regard to FIG. 38 and open to the fuel and air mixing passage 604, passage X open to the idle fuel jet pocket 638, passage Y open to the reference chamber 630, passage Z open to the main fuel nozzle 634 or pocket 636, passage V which communicates the idle fuel jet pocket 638 with the fuel metering chamber 622, passage W which communicates with passage Z and the fuel metering chamber 622, and passages Q and R which are open to the fuel metering chamber 622. Various combinations of these passages may be communicated with each other and the solenoid to control fuel and/or air flow in the carburetor to enable control of the A/F mixture ratio provided from a carburetor at any time, as desired. This can be accomplished electronically by controlled activation of the solenoid, and the solenoid may be actuated based on feedback from a control system and method such as that disclosed herein (e.g. based on exhaust gas temperature and/or other factors or conditions).

In one embodiment, passages A, B, C, Q, W, and X are closed or are not provided when the carburetor body 626 is formed. A first port D is communicated with the solenoid and a passage Z formed in the carburetor. A second port E is communicated with the solenoid and a passage R that communicates with the fuel metering chamber. That is, passages Z and R are communicated with each other, through the solenoid, when the solenoid is open. Accordingly, when the solenoid is open, fuel in the fuel metering chamber is available to be drawn through passage R, through the solenoid ports D and E, through the passage Z and to the nozzle 634 when the pressure differential between the nozzle 634 and fuel metering chamber 622 dictates such a flow (that is, when there is a sufficient pressure drop across the nozzle). When the solenoid 642 is closed, there is no fuel flow to the nozzle 634 because the solenoid closes the fuel flow path from passage R to passage Z and there is no other fuel flow path from the metering chamber 622 to the nozzle in this embodiment. Modulating the solenoid (e.g. opening and closing the solenoid over a given period of time, sometimes called cycling the solenoid) permits control of the fuel flow between the minimum and maximum flows, as desired.

In another embodiment, passages A, B, Q, R and X are closed or not provided. Passage C is communicated with passage Z through the solenoid 642 to permit selective communication of a subatmospheric pressure at passage C with the fuel nozzle 634 through passage Z. In this arrangement, when the solenoid is closed, the subatmospheric pressure signal at passage C is not communicated with passage Z or the nozzle 634 and the flow of fuel through the nozzle is based on the difference in pressure between the end of the nozzle in the fuel and air mixing passage 604 and the fuel metering chamber 622. When the solenoid is open, there is a minimum fuel flow through the nozzle when the engine is at idle (in the illustrated embodiment, the subatmospheric pressure signal is stronger in passage C than at the nozzle, so no fuel flow would occur through the nozzle at idle). At wide open throttle, the subatmospheric pressure at the nozzle 634 in the fuel and air mixing passage 604 is stronger than the subatmospheric pressure at passage C, so fuel flow occurs from the fuel metering chamber 622, through passages W and Z, and through the nozzle 634. However, the subatmospheric pressure signal from passage C is applied to the nozzle via passage Z and this reduces the differential pressure across the nozzle so the fuel flow at wide open throttle is less with the solenoid open than it would be with the solenoid closed. Opening and closing or cycling the solenoid permits control of the fuel flow between minimum and maximum flow rates at any engine speed or load.

In another embodiment, passages A, B, C, R, V and Z are closed or not provided. Passage Q is communicated with passage X through the solenoid 642 to permit selective communication between the fuel metering chamber 622 and the idle fuel jet pocket 638. When the solenoid is closed, there is no fuel flow from the idle fuel jets 632. When the solenoid is open, a maximum fuel flow occurs through the idle fuel jets 632. When the solenoid is cycled, the fuel flow can be controlled, as desired, between minimum and maximum fuel flow. Fuel flow through the idle jets 632 occurs primarily or only during low speed and low load operation and at wide open throttle and/or high engine loads, fuel flow may occur primarily or only through the main fuel nozzle 634 depending on the arrangement of the nozzle and fuel jets.

In another embodiment, passages A, C, Q, R, X and Z are closed or not provided. Passage B is communicated with passage Y through the solenoid to permit selective communication of a subatmospheric pressure signal from passage B to the reference chamber 630 (which may include a vent to atmosphere). When the solenoid is open, there is a minimum or no fuel flow from the idle fuel jets 632 because the subatmospheric pressure signal from passage B balances or cancels out the pressure drop across the idle fuel jets and prevents the fuel metering diaphragm from moving sufficiently to open the inlet valve. When the solenoid is closed, the fuel flow in the carburetor is the same as if no solenoid were provided in the system—a maximum fuel flow occurs through the idle fuel jets 632 at idle or other low speed/low load engine operating conditions (e.g. when the throttle valve is in its idle position or is partially open). When the solenoid is cycled, the fuel flow can be controlled, as desired, between minimum and maximum fuel flow.

In another embodiment, passages B, C, Q, R, X and Z are closed or not provided. Passage A is communicated with passage Y through the solenoid 642 to permit selective communication of a subatmospheric pressure signal from passage A to the reference chamber 630. When the solenoid is closed, fuel flow occurs as if the solenoid were not included in the system (which, as above, could be called a maximum fuel flow because opening the solenoid enleans the fuel mixture in this example as in the others so closing the solenoid prevents the enleanment. As noted previously in this disclosure, the fuel mixture could be enriched rather than enleaned as in the exemplary embodiments set forth herein). When the solenoid is open, the fuel flow is relatively reduced at engine idle and low speed/low load operation, is relatively more reduced at partial throttle openings beyond low speed/low load operation, and is comparatively further reduced at wide open throttle because the magnitude of the subatmospheric pressure at passage A increases from idle to WOT and is greatest at WOT. When the solenoid is cycled, the fuel flow can be controlled, as desired, between minimum and maximum fuel flow at all throttle valve openings.

In another embodiment, passages A, B, Q, R, X and Z are closed or not provided. Passage C is communicated with passage Y through the solenoid 642 to permit selective communication of a subatmospheric pressure signal from passage C to the reference chamber 630. When the solenoid is open and the engine is at idle or low speed/low load, there is a maximum reduction in the fuel flow, that is, a maximum enleanment of the fuel flow because the subatmospheric pressure signal from passage C is relatively strong during such engine operation. The subatmospheric pressure balances or cancels out the pressure drop across the idle fuel jets 632 and prevents the fuel metering diaphragm from moving sufficiently to open the inlet valve 612. When the throttle valve 606 is partially opened there is relatively less enleanment of the A/F mixture, and when the throttle valve is wide open, there is still less enleanment of the A/F mixture because the magnitude of the subatmospheric pressure at passage C is greatest at idle and decreases to a minimum at WOT. When the solenoid is closed, the fuel flow in the carburetor is the same as if no solenoid were provided in the system—a maximum fuel flow occurs through the idle fuel jets 632 and fuel nozzle 634. When the solenoid is cycled, the fuel flow can be controlled, as desired, between minimum and maximum fuel flow at all throttle valve openings.

In another embodiment, passages B, Q, R, X and Z are closed or not provided. Passages A and C are communicated with passage Y through the solenoid 642 to permit selective communication of a subatmospheric pressure signal with the reference chamber 630. Passages A and C could be connected together at a "t" junction upstream of the solenoid, or the solenoid may include a third port to permit communication of the three passages. When the solenoid is open, the magnitude of the subatmospheric pressure signal applied to reference chamber 630 is generally shown by the line A+C in FIG. 38. From that graph, it can be seen that the highest magnitude of the subatmospheric pressure occurs when the throttle valve is at idle and WOT. The greater the magnitude of the pressure signal, the greater the reduction in fuel flow to the fuel and air mixing passage 604, and/or the more responsive the carburetor may be to opening of the solenoid and hence the greater control can be provided over the enleanment of the A/F mixture. When the solenoid is closed, the fuel flow in the carburetor is the same as if no solenoid were provided in the system. When the solenoid is cycled, the fuel flow can be controlled, as desired, between minimum and maximum fuel flow at all throttle valve openings.

Figure 40A:
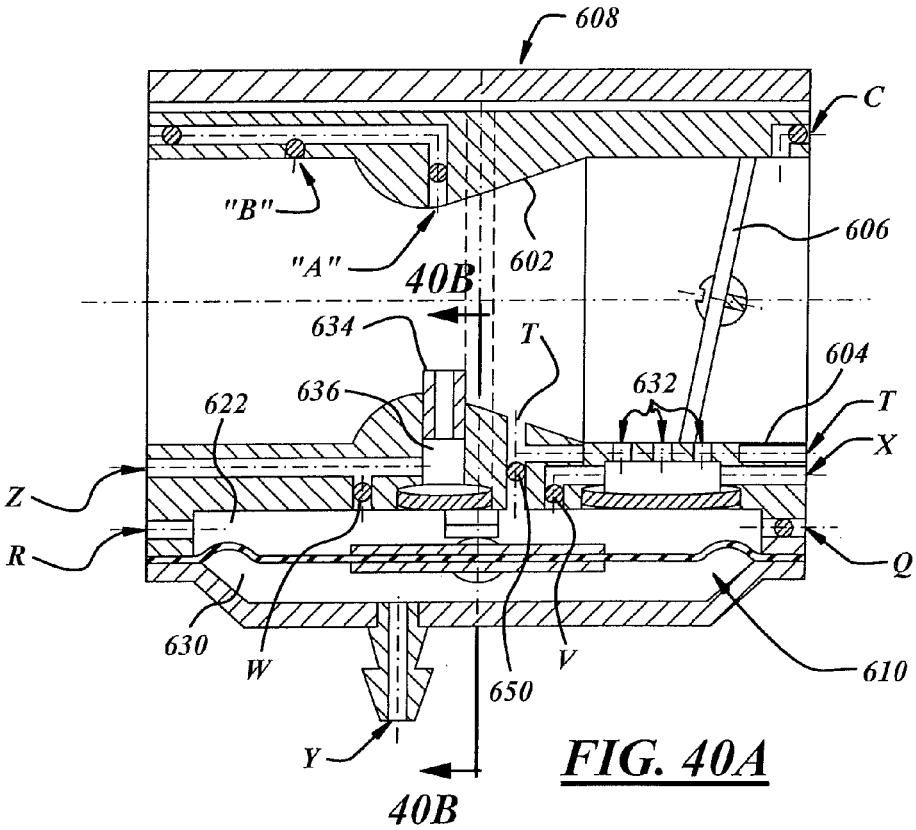
FIGS. 40A and 40B are a sectional view of another exemplary diaphragm type carburetor with which a solenoid valve may be used to adjust an air-fuel mixture ratio, and an enlarged, fragmentary sectional view of a fuel metering assembly of the carburetor.
Figure 40B:
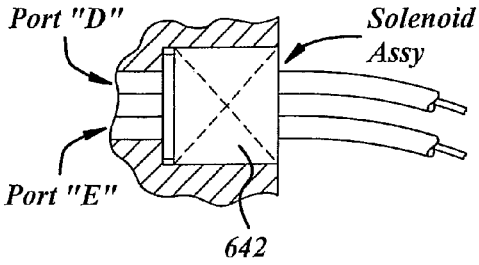
Figure 40B:
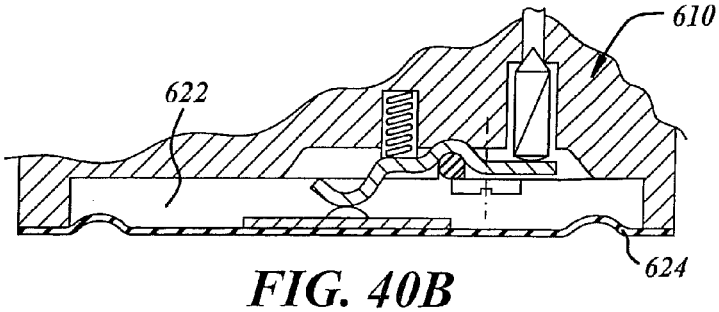

In another embodiment as shown in FIG. 40, passages A, B, C, Q, V and W are closed or not provided. An additional passage T may be provided in the carburetor, open to the exterior of the carburetor body at one end and opening within the fuel and air mixture passage 604 in the area of the venturi 602, downstream of the nozzle 634. Passages T, X and Z are communicated with passage R through the solenoid 642 to permit selective communication of the fuel metering chamber 622 with the fuel and air mixing passage 604 through passage T, the nozzle 634 (via passage Z), and the idle fuel jets 632 (via passage X). When the solenoid is closed, there is no fuel flow to the fuel and air mixing passage through the nozzle, idle fuel jets, or passage T. When the solenoid is open, the pressure drop across the nozzle, passage T and the idle fuel jets will dictate fuel flow through them, as if the solenoid were not in the system. The solenoid may be cycled or selectively opened/closed to control the fuel flow and hence the A/F mixture ratio at any throttle valve opening.

In other embodiments, passages A, B and/or C could be communicated individually or in combination with passage Z to alter the differential pressure across the nozzle 634, and hence the flow of fuel through the nozzle. In constructions where fuel flows through the nozzle only at relatively large throttle valve openings, these embodiments may only permit control of the A/F ratio during conditions when fuel would otherwise flow through the nozzle.

Likewise, in other embodiments, passages A, B and/or C could be communicated individually or in combination with passage X to alter the differential pressure across the idle fuel jets 632, and hence the flow of fuel through the idle fuel jets. In constructions where fuel flows through the idle fuel jets only at relatively small throttle valve openings (e.g. idle and partial throttle valve openings), these embodiments may only permit control of the A/F ratio during conditions when fuel would otherwise flow through the idle fuel jets.

In another embodiment, passage T communicates the fuel metering chamber with the fuel and air mixing passage between the nozzle and idle fuel jets (to do so, the plug 650 shown in FIG. 40 would be removed and a plug would be installed at the end of the passage T adjacent to the exterior of the carburetor body to prevent fuel leakage from the carburetor). So constructed, passage T may provide fuel into the fuel and air mixing passage 604 at least during a transition from low speed engine operation, which is primarily supported by fuel flow through the idle fuel jets 632, and high speed or load engine operation which is primarily supported by fuel flow through the nozzle 634. In this embodiment, passages A, B, and C may be communicated with passage Y to permit selective communication of a subatmospheric pressure signal from passages A, B and/or C to the reference chamber. The greater the magnitude of the subatmospheric pressure signal provided to the reference chamber, the greater the reduction in fuel flow to the fuel and air mixing passage, and/or the more responsive the carburetor may be to opening of the solenoid and hence the greater control can be provided over the enleanment of the A/F mixture. When the solenoid is closed, the fuel flow in the carburetor is the same as if no solenoid were provided in the system. When the solenoid is cycled, the fuel flow can be controlled, as desired, between minimum and maximum fuel flow at all throttle valve openings.

Figure 41:
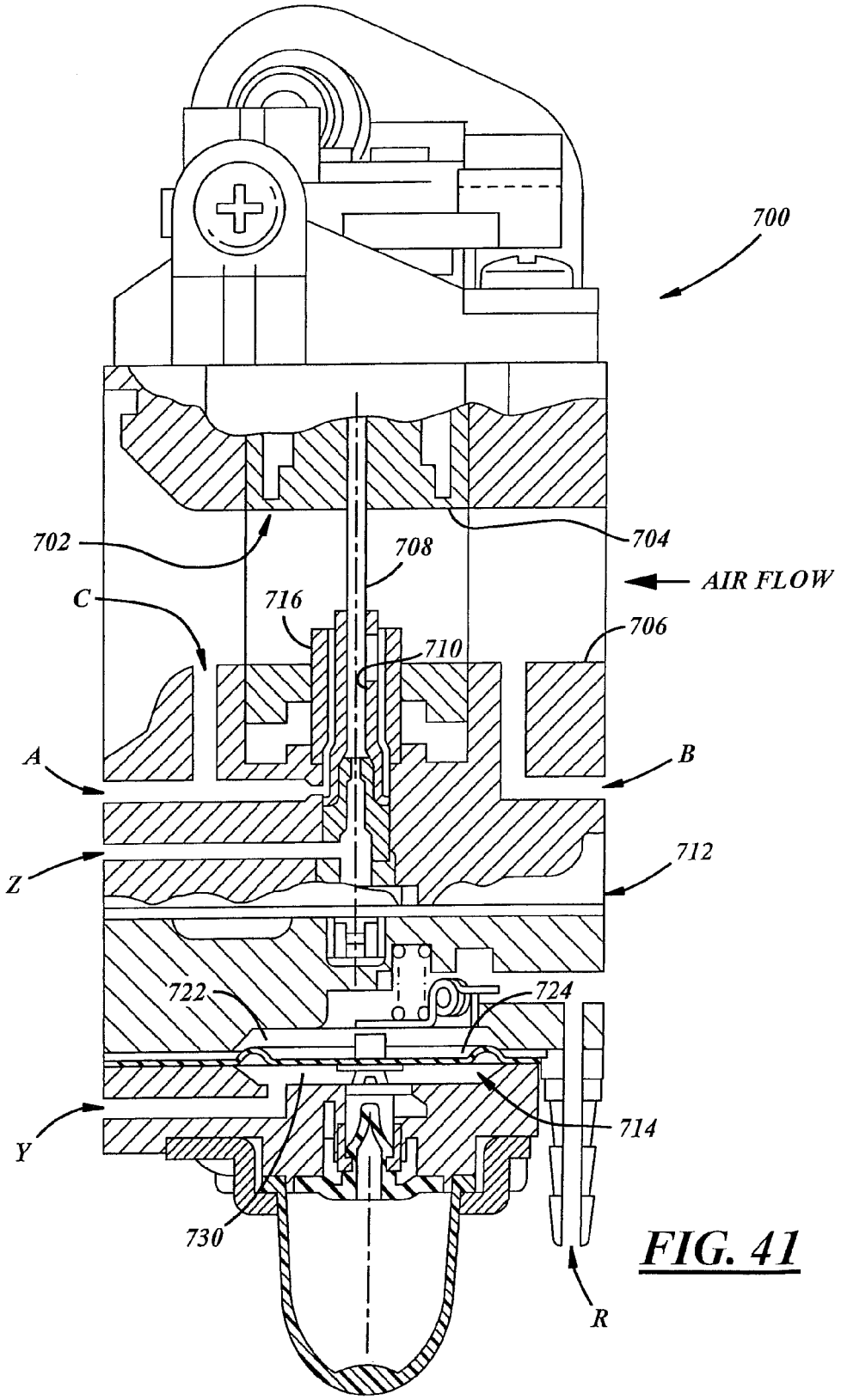
FIG. 41 is a sectional view of an exemplary rotary throttle valve type carburetor with which a solenoid valve may be used to adjust an air-fuel mixture ratio.

An exemplary rotary throttle valve carburetor 700 is shown in FIG. 41. Such carburetors may use a barrel type throttle valve 702 that is rotated to vary the extent to which a bore 704 in the barrel is aligned with the fuel and air mixing passage 706 to control air and fuel flow in and through the carburetor 700. The operation of the throttle valve 702, a needle 708 and fuel nozzle 710 associated therewith, as well as a diaphragm fuel pump 712 and diaphragm fuel metering assembly 714 may be as disclosed in U.S. Pat. No. 6,585,235, the disclosure of which is incorporated herein by reference. The diaphragm fuel pump and diaphragm fuel metering assembly may be substantially as set forth with regard to the carburetor of FIGS. 39A and 39B.

The carburetor 700 may include various passages that are communicated with a subatmospheric pressure source (e.g. various locations in the fuel and air mixing passage) and with a fuel flow passage, or the fuel metering assembly to control the flow rate of fuel, or the A/F mixture delivered from the carburetor, in generally the same manner as discussed above with regard to the various embodiments of FIGS. 39 and 40. In more detail, a passage A communicates with an air gap between a sleeve 716 and the main fuel nozzle 710 in the area of the rotary throttle valve 702 in the fuel and air mixing passage 706. A passage B may communicate with the fuel and air mixing passage 706 upstream of the throttle valve 702, and a passage C may communicate with the fuel and air mixing passage 706 downstream of the throttle valve 702 (at least when the throttle valve is in its idle position). A passage Y may communicate with a reference chamber 730 of the fuel metering assembly 714. A passage R communicates with a fuel metering chamber 722, and a passage Z communicates with the main fuel nozzle 710 between the fuel metering chamber 722 and the fuel and air mixing passage 706.

Passages A, B and/or C could be communicated individually or in combination with passage Y through a solenoid 642 in the same manner previously described, to alter the pressure in the reference chamber, and hence, alter the force acting on the fuel metering diaphragm 724. This alters the movement of the fuel metering diaphragm, and as shown, may retard the movement of the fuel metering diaphragm to limit fuel flow into the fuel metering chamber, and thereby limit fuel flow from the fuel metering chamber 722 and to the fuel and air mixing passage 706. In constructions where a subatmospheric pressure is provided to the reference chamber 730 (which is the case when passages A, B and/or C are communicated with the reference chamber 730), the A/F mixture is enleaned when the solenoid is open to permit communication of passage Y with one or more of passages A, B and C. When the solenoid is closed, the fuel metering assembly behaves normally and the fuel flow in the carburetor is as if there is no solenoid valve or related passages in the system. Because opening the solenoid enleans the A/F mixture, a maximum fuel flow occurs when the solenoid is closed. Modulating or cycling the solenoid permits control over the amount of enleanment of the A/F mixture.

Likewise, passages A, B and/or C could be communicated individually or in combination with passage Z through a solenoid 642 in the same manner previously described, to alter the pressure differential across the main fuel nozzle 710, and hence, alter the flow of fuel through the nozzle. As before, passages not needed in any given arrangement can be plugged or not formed in the first instance. In constructions where a subatmospheric pressure is provided to passage Z (which is the case with passage A, B and C), the fuel flow through the nozzle is reduced and the A/F mixture is enleaned when the solenoid is open. When the solenoid is closed, the fuel flow in the carburetor is as if there is no solenoid valve or related passages in the system. Because opening the solenoid enleans the A/F mixture, a maximum fuel flow occurs when the solenoid is closed. Modulating or cycling the solenoid permits control over the amount of enleanment of the A/F mixture.

In another implementation, passages A, B, and C are closed or not provided. Passage Z is communicated with passage R through the solenoid to permit selective communication of the fuel metering chamber 722 with the nozzle 710. In one form, the nozzle only receives fuel through passage Z so that when the solenoid 642 is closed, there is no fuel flow from passage R to passage Z and hence, no fuel flow to or through the nozzle 710. When the solenoid is open, there is a maximum fuel flow to and through the nozzle, and when the solenoid is modulated or cycled, the flow rate of fuel to and through the nozzle can be varied and controlled as desired.

So-called stratified scavenging carburetors can also be used. These carburetors may include a scavenging air passage through which air flows, although in some embodiments, a fuel and air mixture may flow through this passage, at least in some throttle positions. Representative scavenging type carburetors are disclosed in U.S. Pat. Nos. 6,688,585 and 6,928,996.

Figure 42:
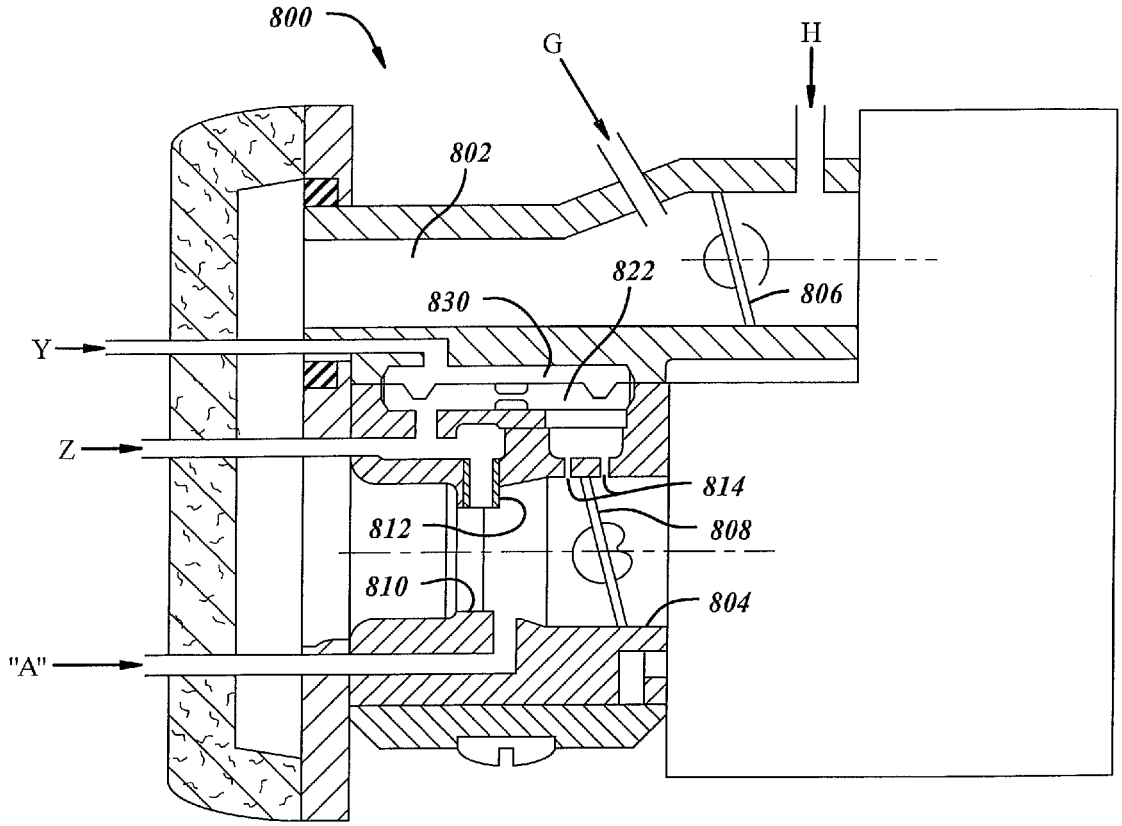
FIG. 42 is a sectional view of an exemplary stratified scavenging type carburetor with which a solenoid valve may be used to adjust an air-fuel mixture ratio.
Figure 42:
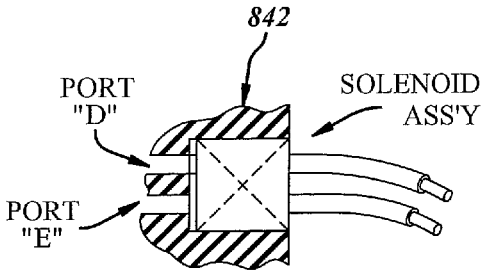

FIG. 42 shows one example of a stratified scavenging carburetor 800 having an air passage 802 that is separately formed from the fuel and air mixing passage 804. An air valve 806 in the air passage 802 may be linked or otherwise associated with the throttle valve 808 for controlled opening of the air valve 806 as a function of throttle valve movement. The air valve 806 could open in sync with the throttle valve 808, or at least initial opening of the air valve 806 could be delayed relative to initial movement off idle of the throttle valve 808, or the air valve could be separately controlled from the throttle valve (for example, by a solenoid or other driver), or any other suitable arrangement could be employed, as desired. Otherwise, the carburetor 800 may be constructed similarly to the diaphragm type carburetors previously described. The carburetor 800 may include a plurality of passages providing various pressure signals or fuel flow paths that may selectively be communicated through a solenoid 842 in various combinations to affect the A/F mixture ratio. Representative passages include: passage A which is open to the fuel and air mixing passage 804 in the area of a venturi 810; passage G which is open to the air passage 802 upstream of the air valve 806, passage H which is open to the air passage 802 downstream of the air valve 806, passage Y which communicates with a reference chamber 830 of the fuel metering assembly 810; and passage Z which communicates with the fuel metering chamber 822 and a fuel nozzle 812 through which fuel flows into the fuel and air mixing passage 804.

In one form, passages A, G and Z are closed (or not provided), and passage H is communicated with passage Y through the solenoid 842 to permit selective communication of a subatmospheric pressure signal at passage H with the reference chamber 830. Because the magnitude of the subatmospheric pressure at passage H is greatest when the throttle valve 808 is substantially closed (and the air valve is fully or substantially closed), the maximum reduction of fuel flow occurs during this engine operation. A lesser subatmospheric pressure exists at passage H in intermediate positions of the throttle valve 808 and air valve 806, and when the throttle valve and air valve are wide or fully open. Accordingly, the affect on the fuel flow at these throttle/air valve positions is less. When the solenoid is closed, the carburetor 800 functions as if no solenoid valve or passages H and Y existed (that is, the fuel flow rates are normal at all throttle/air valve positions). Modulating or cycling the solenoid permits control of the amount of enleanment of the A/F mixture, as desired.

In another form, passages A, H, Y and Z are closed and passage G is selectively communicated with passage Y through the solenoid 842. The operation of this carburetor is substantially the same as the prior carburetor except the subatmospheric pressure signal characteristics are different at passage G than at passage H. Accordingly, the relative amount of fuel flow reduction (e.g. enleanment of the A/F mixture) will correspond to the relative magnitude of the subatmospheric pressure at passage G in various throttle/air valve positions. The fuel flow through the main nozzle 812 and idle fuel jets 814 will be affected when a subatmospheric pressure source is communicated with the reference chamber 830.

Likewise, passages G and H can be selectively communicated, alone or in combination, with passage Z through the solenoid to provide a subatmospheric pressure signal acting on the nozzle 812 opposite the pressure in the fuel and air mixing passage 804. This may reduce the pressure differential across the nozzle 812 to enlean the A/F mixture delivered from the carburetor. In at least some applications, the use of passage G may not be preferred or as easy to control the A/F mixture with as with the use of passage H.

Figure 43A:
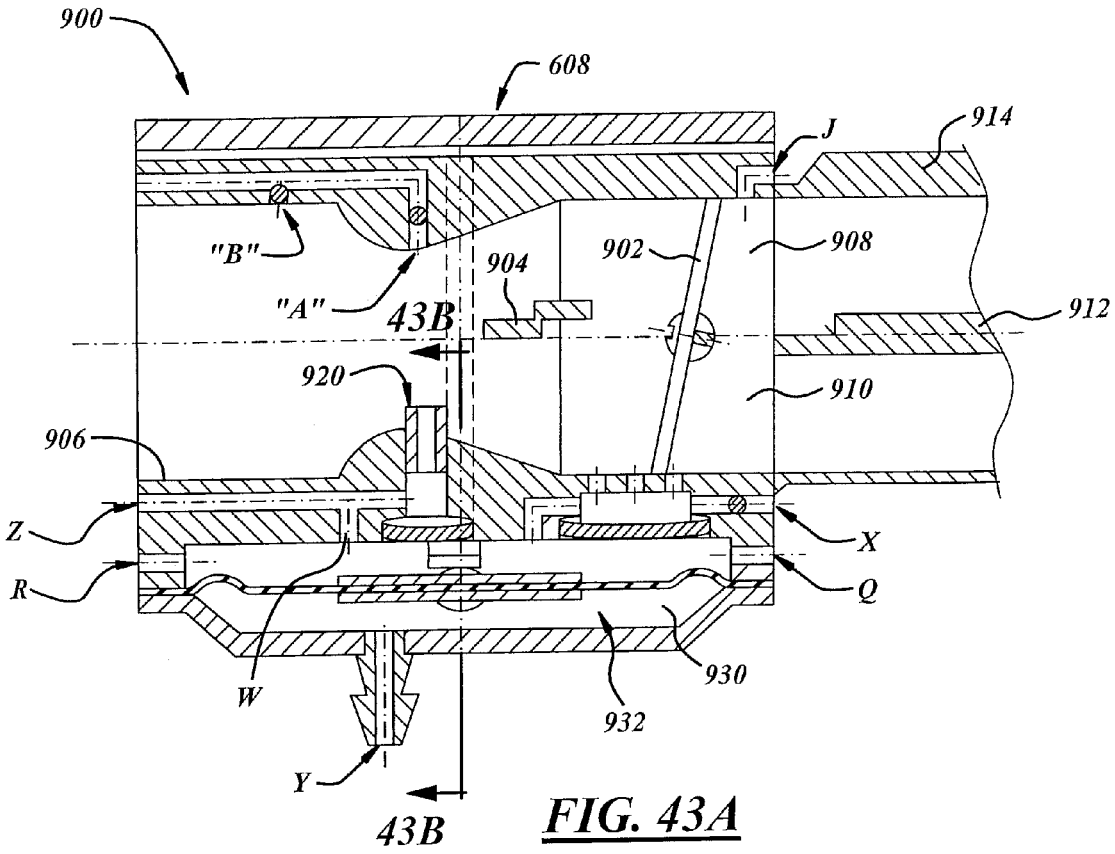
FIGS. 43 (A and B) is a sectional view of an exemplary stratified scavenging type carburetor with which a solenoid valve may be used to adjust an air-fuel mixture ratio.
Figure 43B:
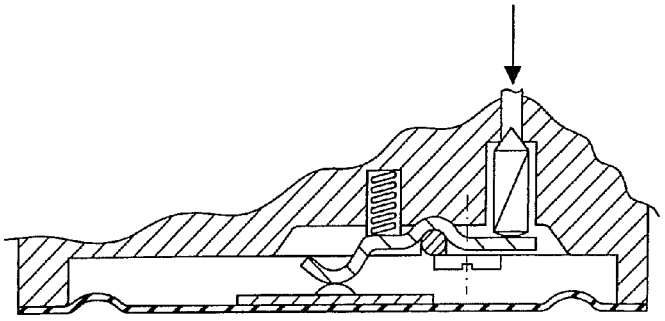

FIG. 43 illustrates another type of stratified scavenging carburetor 900 using a split or divided bore beginning, for example, at the throttle valve 902 (which may be a butterfly type valve). A divider 904 in the fuel and air mixing passage 906 provides a scavenging passage 908 and a fuel and air mixture passage 910. The two passages 908, 910 may communicate with each other while the throttle valve 902 is less than fully opened, and the throttle valve may substantially prevent communication between the two passages when it is fully opened, such as by engaging and closing on spaced apart dividing walls 904, 912 in the carburetor and/or an intake manifold 914 downstream of the carburetor. Like the previously discussed carburetors, and particularly the previously discussed diaphragm type carburetors, various passages are provided to permit control of the A/F mixture.

In one form, a passage J downstream of the throttle valve 902 (at least when the throttle valve is in its idle position) is communicated with passage Z to selectively communicate a pressure signal at passage J with the fuel nozzle 920. When the solenoid is open, there is a minimum fuel flow through the nozzle 920 (which may be zero fuel flow) at idle or low speed/low load engine operation. At WOT, the fuel flow through the nozzle is reduced when the solenoid is open. In another form, passage J is communicated with passage Y to selectively communicate the pressure signal at passage J with the reference chamber 930 of the fuel metering assembly 932. When the solenoid is open the fuel flow is reduced at all throttle valve positions. When the solenoid is closed, fuel flow is normal (as if the solenoid and passages are not present). Modulating or cycling the solenoid permits control of the amount of enleanment of the A/F mixture.

Figure 27:
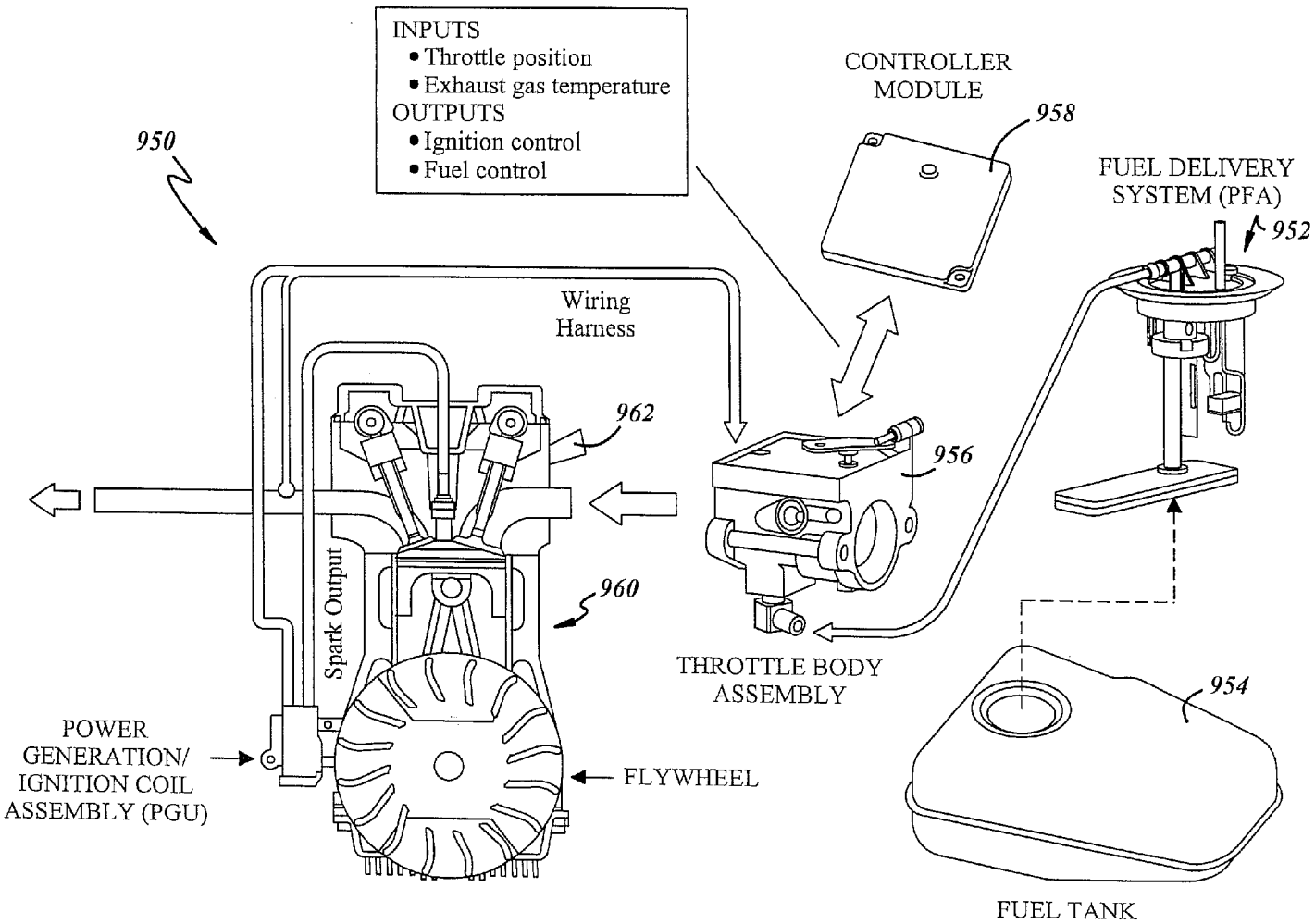
FIG. 27 is a schematic view of an exemplary fuel system for a fuel injected engine.

Further, as shown in FIG. 27, the control system, including feedback control of an A/F mixture, or of fuel flow from a charge forming device, can be applied to a fuel injection system 950. The method of controlling the fuel flow can be used to alter the amount of fuel injected into the engine such as by, for example, controlling the operation of solenoid(s) in a fuel injector. In one implementation, a fuel system 950 includes a fuel pump assembly 952 that may be carried by or mounted in a fuel tank 954, a throttle body assembly 956, a control module 958 which may be carried on or by the throttle body and an engine 960 with one or more fuel injectors 962. Fuel from the pump flange assembly could be provided to one or more passages in the throttle body. Fuel flow passage(s), air bleed passage(s) and/or subatmospheric pressure source passage(s) could be controlled by a solenoid or other valve responsive to signals from the control module. Also, in addition to or instead of adjusting the A/F mixture ratio or amount of fuel discharged from a charge forming device (examples of which may include a carburetor or fuel injector), the ignition timing can be adjusted by the control system.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

What is claimed is:

1. A method of operating an engine, comprising:

(a) determining a peak power condition for the engine by altering an air-fuel mixture ratio delivered to the engine and monitoring a change in an engine parameter that occurs as a result of the altered air-fuel mixture ratio until said monitored engine parameter indicates the peak power condition of the engine at that time;

(b) measuring a temperature associated with the engine at said peak power condition;

(c) comparing the temperature measured in step (b) with a previously determined temperature associated with a known peak power condition of the engine;

(d) determining an offset value based on the comparison made in step (c); and (e) controlling at least one of an air-fuel mixture delivered to the engine or ignition spark timing relative to top dead center of a piston of the engine based on said offset value.

2. The method of claim 1 wherein the measured temperature associated with the engine is exhaust gas temperature.

3. The method of claim 1 wherein step (a) includes altering, in more than one increment, the air-fuel mixture ratio delivered to the engine.

4. The method of claim 3 wherein, prior to step (a), an initial air-fuel mixture ratio that is richer than the air-fuel mixture ratio associated with the peak power condition of the engine is delivered to the engine.

5. The method of claim 4 wherein step (a) is accomplished by enleaning the air-fuel mixture ratio delivered to the engine in several increments until the peak power condition of the engine is determined.

6. The method of claim 3 wherein the increments are of uniform magnitude.

7. The method of claim 3 wherein the increments are of variable magnitude.

8. The method of claim 7 wherein the increments are varied as a function of the magnitude of the speed change detected from at least one prior increment.

9. The method of claim 3 comprising, providing a calibrated peak power condition and wherein the offset value is used to control the air-fuel mixture ratio delivered to the engine as a function of the difference between the actual measured peak power condition and the calibrated peak power condition.

10. A method of operating an engine, comprising:

(a) providing a relatively rich fuel and air mixture to the engine;

(b) enleaning the fuel and air mixture;

(c) sensing a change in an engine parameter that occurred after said enleaning step;

(d) determining a peak power condition of the engine based on changes in said engine parameter;

(e) determining the temperature of the engine exhaust gas at the peak power condition;

(f) comparing the exhaust gas temperature measured in step (e) with a previously determined exhaust gas temperature associated with a peak power condition of the engine;

(g) determining an offset value based on the comparison made in step (f); and (h) controlling at least one engine controllable factor as a function of the offset value.

11. The method of claim 10 wherein the engine parameter is engine speed.

12. The method of claim 10 wherein the engine controllable factor includes an air-fuel ratio delivered to the engine.

13. The method of claim 10 wherein the engine controllable factor includes ignition timing.

14. The method of claim 10 wherein step (a) of the method is accomplished by providing the relatively rich fuel and air mixture to the engine through a fuel and air mixing passage of a carburetor; and wherein step (b) of the method includes providing a control signal to a solenoid valve through which fuel or air flows to the mixing passage to enlean the fuel and air mixture to the engine.

15. The method of claim 10 wherein step (b) is accomplished by applying a subatmospheric pressure to a float bowl of a carburetor supplying a fuel and air mixture to the engine by actuating a solenoid valve to selectively communicate a subatmospheric pressure source with the float bowl to alter the air-fuel mixture ratio delivered from the carburetor to the engine.

16. The method of claim 15 wherein the subatmospheric pressure source is a fuel and air mixing passage of the carburetor.

17. The method of claim 10 wherein step (b) is accomplished by applying a subatmospheric pressure to a diaphragm of a fuel metering chamber from which fuel flows into a fuel and air mixing passage of a carburetor by actuating a solenoid valve to selectively communicate a subatmospheric pressure source with the diaphragm to alter the air-fuel mixture ratio delivered from the carburetor to the engine.

18. The method of claim 17 wherein the subatmospheric pressure source is the fuel and air mixing passage of the carburetor.

19. The method of claim 10 wherein the measured temperature associated with the engine is exhaust gas temperature.

* * * * *